US006805519B1

(12) United States Patent
Courtney

(10) Patent No.: US 6,805,519 B1
(45) Date of Patent: Oct. 19, 2004

(54) GARMENT INTEGRATED MULTI-CHAMBERED PERSONAL FLOTATION DEVICE OR LIFE JACKET

(76) Inventor: William L. Courtney, 1990 Highway One, Elk, CA (US) 95432

( * ) Notice: Subject to any disclaimer, the term of this patent is extended or adjusted under 35 U.S.C. 154(b) by 0 days.

(21) Appl. No.: 09/935,351

(22) Filed: Aug. 22, 2001

Related U.S. Application Data

(63) Continuation-in-part of application No. 09/827,831, filed on Apr. 6, 2001, now abandoned, which is a continuation-in-part of application No. 09/641,932, filed on Aug. 18, 2000, now Pat. No. 6,558,082, which is a continuation-in-part of application No. 09/618,333, filed on Jul. 18, 2000, now Pat. No. 6,666,622.

(51) Int. Cl.[7] ..... B63C 9/08
(52) U.S. Cl. ..... 405/185; 441/123
(58) Field of Search ..... 441/123, 88, 103; 2/2.5, 1, 2.15–2.17, 462–467; 405/185–187

(56) References Cited

U.S. PATENT DOCUMENTS

| | | | | | |
|---|---|---|---|---|---|
| 2,742,654 | A | * | 4/1956 | Hurt | 441/118 |
| 3,656,196 | A | * | 4/1972 | O'Neill | 128/205.13 |
| 4,324,234 | A | * | 4/1982 | Maness | 128/202.14 |
| 4,602,385 | A | * | 7/1986 | Warren | 2/2.14 |
| 4,681,552 | A | * | 7/1987 | Courtney | 441/108 |
| 4,722,710 | A | * | 2/1988 | Hagen et al. | 405/186 |
| 4,779,554 | A | * | 10/1988 | Courtney | 114/315 |
| 5,060,314 | A | * | 10/1991 | Lewis | 2/2.5 |
| 5,403,123 | A | * | 4/1995 | Walters | 405/186 |
| 5,516,233 | A | * | 5/1996 | Courtney | 405/186 |
| 5,584,737 | A | * | 12/1996 | Luhtala | 2/2.5 |
| 5,707,177 | A | * | 1/1998 | Lehrer et al. | 405/186 |
| 5,789,327 | A | * | 8/1998 | Rousseau | 442/135 |
| 5,799,329 | A | * | 9/1998 | Hauschild | 2/102 |
| 5,996,115 | A | * | 12/1999 | Mazelsky | 2/2.5 |
| 6,035,438 | A | * | 3/2000 | Neal et al. | 2/2.5 |
| 6,062,929 | A | * | 5/2000 | Hallstrom | 441/106 |
| 6,080,027 | A | * | 6/2000 | Rodemann | 441/41 |
| 6,109,338 | A | * | 8/2000 | Butzer | 165/46 |
| 6,128,784 | A | * | 10/2000 | Frank | 2/102 |
| 6,203,246 | B1 | * | 3/2001 | Courtney et al. | 405/185 |

OTHER PUBLICATIONS

Co–pending U.S. patent application No. 10/021,519, filed Dec. 7, 2001, entitled: Integrated or Attached Space Occupying Cephalic Restraining Collar for Improved Life Jacket Performance, Applicant: William L. Courtney.

* cited by examiner

*Primary Examiner*—Thomas B. Will
*Assistant Examiner*—Tara L. Mayo
(74) *Attorney, Agent, or Firm*—Daniel S. Polley, P.A.

(57) ABSTRACT

A multi-chambered torque personal flotation device for corrective turning action of a weighted individual. The multi-chambered device is capable of being adjusted to provide a wide range of buoyancy as might be needed under differing degrees of ballistic protection. An eccentric mobile buoyant system complements a massive displacement required to float the armored victim by providing the energy required to reliably initiate corrective turning action, regardless of the gear worn, position of water entry, or state of consciousness of the wearer. In the event the conscious victim desires to shed the body armor, a series of quick release members allow the victim to shed their ballistics vest while retaining their life jacket. The integrated life jacket upon separation from the heavily ballasted body armor continues to provide reliable airway protection.

21 Claims, 43 Drawing Sheets

GARMENT INTEGRATED MULTI-CHAMBERED PERSONAL FLOTATION DEVICE OR LIFE JACKET

This application is a continuation-in-part of U.S. Ser. No. 09/827,831, filed Apr. 6, 2001 and now abandoned, which is a continuation-in-part of. U.S. Ser. No. 09/641,932, filed Aug. 18, 2000 now U.S. Pat. No. 6,558,082, which is a continuation-in-part of U.S. Ser. No. 09/618,333, filed Jul. 18, 2000 now U.S. Pat. No. 6,666,622.

BACKGROUND OF THE INVENTION

1. Field of the Invention

The present invention relates generally to life jackets and other personal flotation devices ("PFDs"), and in particular to the prevention of airway submersion as a novel addition to the classic approach which is to recover the victim after they fall forward onto their face submerging their airway. Concurrently the instant invention continues to improve traditional face down corrective turning action. Central to the prevention of airway submersion is the separation of the centers of ballast and buoyancy. This not only creates increased torque around the axis of rotation that parallels the spine, but because of the anterior posterior separation creates a new axis of rotation around an axis that passes side to side through the thorax. Further improvements in controlling movement of the head, side to side, reduces the amount of torque required for reliable corrective turning action. This results in either decreased bulk of the buoyant moment or the amount of fluid or solid ballast needed to achieve improved airway protection for either inflatable or inherently buoyant personal flotation devices. With increasing concern about passive aspiration leading to drowning while face up in a mounting sea state the current embodiment includes oral nasal airway protection. Due to the morbidity and mortality of rapid onset hypothermia immediate removal from cold water requires inclusion of a personal raft within the PFD that incorporates rapid inflation, and stability in choppy seas and means to survive until rescued. The present invention also provides a garment integrated multi-chambered personal flotation device, life jacket, and the like.

2. Description of the Prior Art

Extensive pool and wave tank testing of fielded and prototype personal flotation devices ("PFDs") on divergent body types indicates the clear need for continued improvement in airway protective performance. None of the jackets tested at several joint international efforts reviewing testing methodologies provided 5-second recovery of the test subjects.

Corrective turning as assessed by every government agency has been restricted to the tester assuming a horizontal face down position taking three strokes, then the administrator assess whether the individual is rolled into a face up position within 5 seconds. Past PFD designs relied upon the common understanding and practice of placing the PFD's buoyancy high on the chest. All current PFDs tested by the author fail to provide airway protection. There have been PFD recalls and refusal to grant reciprocal approval to product already in the field based on current concerns of the inadequacy of test methodologies. Some agencies instruct their test subjects to place the arms at the sides, legs together and stretch out the back as a simulation of unconsciousness. This methodology was introduced to allow comfortable recreational life jackets to be approved. The use of this methodology for approval of commercial open ocean life jackets has precipitated the global current crisis, with agencies from one country recalling product from another country. The United States Coast Guard ("USCG") is currently increasing the rigor of testing by the inclusion of new tests more accurately assessing the capacity to commercial jackets to roll an unconscious victim from any position into an airway protected position within 5 seconds as mandated by the Code of Federal Regulations. The current challenge to improve the accuracy of testing is seriously compounded by a lack of PFDs capable of withstanding close scrutiny.

Recent joint Canadian and US wave tank testing of a international selection of "safety of life at sea" ("SOLAS") class PFDs disclosed that the ability of any life jacket to provide surface airway protection is constrained by the same laws of physics. Even if one is turned face up in mounting seas at very low wave height and frequency the face is awash in waves. As the seas mount, the ballast of the body is driven down in the trough of the wave and the head completely submerged. The buoyant means about the neck if secure extracts the victim in a cyclic plunging action. Thus safety and survival at sea is dependent upon being able to immediately remove oneself from the sea as quickly as possible to avoid hypothermic induced unconsciousness and cumulative aspiration secondary to splashing waves or total submersion that occurs in even relatively mild seas.

The vast majority if not all current jackets fail to turn an unconscious victim who enters the water face first, but since face first water entry is not part of any PFD evaluation program this finding remains unknown therefore unaddressed. Current life jackets also possess a Danger Zone, defined as the vertical position in the water from which if the wearer passes out they then fall face forward into an airway submerged moment of stability. Until now the sole management of the Danger Zone was avoidance. The average user of PFDs is ignorant of the consequence of floating in the danger zone. In fact contrary to the lethal consequences of floating upright in the water column it feels intuitive to the uniformed. The vertical position is the ideal position from which to scan or signal rescue efforts. When you float upright it is easier to monitor the horizon behind you as well as that portion in front of you.

The body has highly developed postural muscles that in coordination with the vestibular apparatus of the inner ear maintain our vertical position in space. Prior jackets relied upon well-established principles that the buoyant moment belonged high on the chest in order to optimize airway protective turning. The prior art has relied strictly upon the use of buoyant means to generate the torque needed for turning and like a sail boat that had lost it's lead keel the purely buoyant PFD suffered from a lack of orientation, that is there are points of stability that are facedown as well as face up. Hence the urgent need to identify and remedy the Danger Zone.

The prior art is restricted to very severe limits on the angle of flotation of the body off of vertical as one means to avoid entering the Danger Zone. That is if a jacket floats the wearer closer than 20 to 30 degrees off of vertical it would not pass testing and would not be approved for use. At issue is that prior Life Jackets allow the center of gravity of the jacket to be balanced above the center of buoyancy by the conscious wearer floating upright in the water column as they want to be when eagerly trying to spot search and rescue efforts. The intuitive element is that if a PFD allows the center of gravity to be located directly above the centroid of buoyancy the system is in balance and so requires very little muscular movement to maintain this position in gravity. However, the problem occurs as the water environment quickly wicks away the body's heat leading to hypothermia, obtundation and eventually loss of consciousness. Upon loss of consciousness the victim can no longer maintain their vertical position in space, they can not even hold their head erect. The debility is so complete they cannot remove their face from the water.

Reviewing the mechanics of the Danger Zone, while conscious the victim can effortlessly balance themselves upright but when the head drops forward the center of gravity suddenly also shifts forward, and the individual slumps face down.

The entire global PFD community currently accepts the SOLAS standard for turning. A SOLAS Approved Life Jacket will roll an unconscious victim from any position into and airway protected position within 5 seconds. However that same community relies some variation of the Three-Stroke Test to confirm performance to that standard. PFD design has come to rely upon the assistance provided by the tester to the serious detriment of performance. One current test methodology simulates unconsciousness by instructing the tester to take three strokes, pull the arms to the sides, place the legs together, straighten the back then drop the head. This very complex maneuver aligns the body along the axis of rotation reducing the amount of torque the Life Jacket needs to generate in order to roll the victim over. The majority of the torque is generated from the water displaced by the buoyant moment. While the Three-Stroke test arose to facilitate the creation of comfortable recreational PFDs that same test replaced more passive simulations of unconsciousness. Clearly that more passive tester requires a Life Jacket of greater torque to perform corrective turning.

Both the commercial and recreational market place is currently full of Life Jackets that rely upon tester participation to compensate for insufficient torque. While these comfortable jackets take up less space aboard vessels allowing for the carriage of more passengers they fail the unconscious user. When the head drops forward shifting the center of gravity in front of the center of buoyancy the unconscious users slowly rocks forward covering their airway with water. An accurate simulation of loss of consciousness involves the production of minimal or ideally no kinetic energy. Under current efforts to review validity of current three stroke test methodologies, newer static tests of currently fielded Tested and Approved product although low volume, comfortable and stowable, fail to turn them into a face up position within the mandated 5 seconds.

The current standards are the product of a very large committee. 190 countries each advocating the interests of their individual manufactures has led to an assembly of contradictory mandates. For example, one has to be able to swim, while wearing the Life Jacket, a distance that exceeds what the average American is capable of swimming even without a Life Jacket. One needs to be able to climb into a life raft which is very challenging even when the individual is not wearing a PFD. The Life Jacket needs to position the user upon completion of the corrective turn simultaneously within narrow limits for freeboard, head angle, body angle and face plane while not obstructing the view of the horizon. The same comfortable, snug, low profile Life Jacket must be stable in mounting seas. One size needs to be able to fit anyone and the user needs to be able to put it on from either the front or back in less than 1 minute from the first time the user sees it in the dark. This must all be accomplished in a vest that is so comfortable that it will be worn continuously, so small it will fit under the seat and usually sell for $11.00. Consequently, given these requirements, no current PFDs in the field perform to the standard as denoted in the Federal Code of Regulations.

The third party tester is thus charged with determining whether fielded Life Jackets are capable of rolling an unconscious victim floating face down into and airway protected position within 5 seconds. If the jacket allows a balance to be achieved when conscious, when the wearer looses consciousness, the head drops, moving the center of gravity forward and the wearer's face ends up in the water. At this point the life jacket has the sole responsibility to effect a corrective turning action. Few, if any, fielded life jackets are capable of corrective turning without the assistance of movement on the part of the wearer. Even if a life jacket could reliably turn the unconscious victim into an airway-protected position; the wearer is exposed to airway submersion during the recovery that will result in some degree of aspiration during the corrective turning action. If the amount of aspirated water accumulates to 200 cc the victim moves from near drowning to drowning.

Additionally, the simplest and lightest ballistic vest are made from KEVLAR brand fibers. In addition to the KEVLAR brand fiber vest the individual might place solid armor plates on the front and/or back. Further complicating the airway protection of the heavily armored individual is the divergent range and location of armaments and gear. As the amount of buoyancy is increased simply to keep the soldier or officer afloat the shear size of the buoyant device becomes a source of stability in the face up as well as face down situation.

It is to the effective resolution of the shortcomings of the prior art that the present invention is directed.

SUMMARY OF THE INVENTION

The present invention provides a novel PFD that increases the amount of airway protective torque generated by the Life Jacket. Complementing the disclosed separation of the centers of gravity and centers of buoyancy to increase the generated torque are disclosures reducing the amount of torque required by stabilizing the victims head in line with the axis of corrective turning action. The present invention also prevents airway submersion, rather than allowing the victim to fall face first into the water then attempting to recovery the victim within the allotted 5 seconds which is common with conventional PFDs. The creation of an axis of rotation through the waist relies upon moving the ballast posterior and superior while shifting the center of buoyancy down and away from the axis of rotation. This axis pulls the obtunded victim straight back completely avoiding submersion.

The inclusion of ballast in the PFD results in two opposing forces participating in initiation and completion of corrective turning. In one embodiment a solid ballast, such as lead, is used because its high specific gravity allows the smallest diameter sphere per unit mass. The smaller ball can traverse smaller containers, also reducing cost. The smaller contained mobile eccentric ballast occupies less space within the cover of the PFD resulting in the preservation of the amount foam displacement means. In an alternative embodiment, water is introduced into the container, in lieu of solid ballast. The water is quite heavy when in the air and is uniquely neutrally buoyant when under water. The solid ballast is capable of staying near the perimeter where it reinforces the side high position with its reduced freeboard if not out right airway submersion.

The fluid ballast preferably flows over minor imperfections in the container's inner surface. The relocation of the fluid ballast begins immediately once the victim crosses the inflection point in the corrective turning action. The fluid ballast can relocate on a partial basis, rather than the all or nothing outcome of the solid ballast. While lead shot ballast of small diameter flows similar to a liquid it is not neutral once submerged and may not be reliable in traversing a soft fabric container where water can negotiate and surface with impunity.

The primary goal of the life jacket is to protect the airway upon entrance and during the initial shock that ensues. If trauma occurred prior to entry such as being struck by the boom of a sailboat then face up flotation is critical. If the individual is conscious depending on the water temperature they have sometimes less than an hour to exit the water or suffer a drop in core temperature that will lead to loss of consciousness. The Life Jacket must therefore also carry with it the means to exit the water. Bridging the two chest straps a life raft acts as a cummerbund holding the PFD to user. Once stable the PFD is removed.

The present invention also provides a valise that is securely attached to the life raft so that as the raft kites during inflation it will not blow away across the seas. Assisting this is a wrist lanyard at the opening of a windsock inflation means. The windsock is held aloft till full, then the neck is closed and the entrap air milked into the chambers of the raft either simultaneously or sequentially through the use of different pressure relief valves. Due to the extreme difficulty of controlling a six-foot inflatable in high winds a secondary body lanyard attaches the raft to the victim. If there is no wind the windsock can be shaken to scoop up air and then transfer that air to the raft. This rapid inflation occurs without the use of expensive, heavy, bulky compressed gas and inflation apparatus, which requires frequent maintenance and fears of failure at many points. Additional novel uses of the windsock further improve safety and survival at sea such as filling it with water to serve as a sea ballast, which helps hold the raft to the water's surface. In the event that the raft overturns on a breaking wave the sea ballast quickly reorients the raft and its victim if securely restrained within the raft.

A quick release cover serves not only to keep the victim aboard if it happens to overturn, but also to protect the victim from sunburn, as well as serve as a means to capture rain or wind as the weather improves. Approximately, one half of the cover can be quickly releasable in the event that the raft does not flip back over, when overturned, to allow the victim to slip out. When the windsock is attached at multiple points, one can preferably be the center of the body where it inflates the floor as well as one or two perimeter points of inflation. Once in the raft the windsock opening can be closed converting it into a sea ballast bag. A fill tube accessible to the raft's occupant allows the ballast bag to be filled. The ballast fuses the raft to the water's surface and supplies a massive keel in the event of broach.

If the seas are not breaking, the windsock can be detached and the reinforced perimeter attached at three points identified by grommets to allow the windsock to serve as a steering sea anchor orienting the raft in the waves. Once the storm is over the windsock with reinforced receiving pouch and lash cord can be attached to a paddle handle and serve as a spinnaker or sail as the victim attempts to move towards shipping lanes to improve chances of rescue. The windsock can be constructed from waterproof coated fabric and can also serve as a funnel to collect and store rain water. If the windsocks inner face is black or dark the inclusion of a piece of clear plastic allows the construction of a solar still capable of capturing potable condensate.

Thus, the invention provides for a fluid ballast, alone or in combination with a solid ballast means, that is functionally directed to different locations within the boater's personal flotation device or diver's Buoyancy Compensator BC through a rigid or flexible container. Complementing the effect of the shifting ballast on the PFD's airway protective turning action is the torque generated by the structurally enhanced buoyant means. The invention allows both the amount of ballast and buoyancy needed to effect reliable face flotation to be reduced to their minimum by a disclosed inverted configuration of the buoyant moment. Shifting the center of buoyancy away from the axis of rotation creates a longer arm and thus more torque per unit of displacement. Further the inverted configuration results in the buoyant force acting through the apex of its triangular configuration creating a hinge which confers flexibility. That flexibility allows the buoyant moment to shift off to the side thereby helping to initiate turning.

The size of the connection between the inferior anterior buoyant means and the posterior superior cervical ballast allows escape of the submerged buoyant means to initiate turning. If the apex is overly narrow without the buoyant means moves without control, dissipating the energy needed for rotating the victim's face out of the water. The apical joint also flexes about the thorax increasing comfort. In addition the triangular configuration establishes an open space to allow unimpeded arm movement during swimming as required for PFD approval.

The integration of ballast and buoyant moments into a continuous structural base layer improves transfer of torque from both the fluid/solid ballast and the opposing extended buoyant arm. The particular arrangement disclosed allows the unconscious victim to be pulled straight back thereby avoiding face down flotation rather than first allowing face down flotation then attempting to roll them over onto their back. The prevention of drowning relies upon a new described turning action about an axis through the waist. The disclosed product because of its combined use of dual arms demonstrates marked improvement in classic rotation about the spine previously the only identified or assessed corrective turning action. The disclosed adjustable cervical collar includes a mandibular shelf preventing both anterior posterior movement as well as side to side movement.

Controlling the considerable ballast of the head reduces the amount of torque required of the transpontine ballast and buoyant moments. In current automatically inflated PFD on face first entry, the neck is driven through the jacket opening and product failure consistently occurs. To assist in controlling the head and neck, the present invention provides overlapping and pneumatically compressed locks assist in maintaining necessary control of the heads ballast. Decreased need for torque converts into a smaller PFD leading to increased comfort, compliance and therefore improved utility in preventing drowning. Due to mounting concerns from wave tank tests about drowning while floating face up several novel airway protective devices are disclosed that complement the airway protection that arises from either prevention of airway submersion or the rapid recover from the face down position in the event it occurs.

Furthermore, compliance with children is a serious problem, the child's vest is not only improved functional fluid ballast, its inclusion in a clear tube with brightly colored fish swimming around as the water moves improves the chances of being worn as well as providing enhanced airway protection. Additionally, survival at sea, if one does not immediately drown, is proportional to the rate of heat loss or passive intrusion of water from breaking waves. Disclosed is a rapid manual inflation means for a personal raft stowed within the back of the PFD. After inflation, the means of inflation can be used as a sea anchor to orient the vessel in building seas. In breaking seas the inflation means can be converted to an Icelandic sea ballast to secure the raft to the waters surface. Once the storm had past the detachable inflation means can then be held aloft to function as a sail to move the raft towards shipping lanes to improve chance of rescue. The raft inflation means constructed of coated fabric now acts as a funnel to collect and store rain. If constructed of dark coated fabric and can be combined with a clear cover and now serve as a solar still, dramatically extending the duration of safety and survival at sea from an hour to weeks.

Thus, in one embodiment the invention provides for a fluid ballast, alone or in combination with a solid ballast means, that is functionally directed to different locations within the boater's personal flotation device ("PFD") or diver's Buoyancy Compensator BC through a rigid or flexible container. Complementing the effect of the shifting ballast on the PFD's airway protective turning action is the torque generated by the structurally enhanced buoyant means. The invention allows both the amount of ballast and buoyancy needed to effect reliable face flotation to be reduced to their minimum by a disclosed inverted configuration of the buoyant moment. Shifting the center of buoyancy away from the axis of rotation creates a longer arm and thus more torque per unit of displacement. The invention provides a vertically eccentric PFD, combining inferior and anterior shift in the center of buoyancy with superior posterior shift in the center of gravity, generating torque needed for improved corrective righting action of the PFD.

In another embodiment, the present invention also provides a multi-chambered high torque PFD for powerful corrective turning action of a weighted individual. Disclosed is a multi-chambered device capable of being adjusted to provide a wide range of buoyancy as might be needed under differing degrees of ballistic protection. The disclosed eccentric mobile buoyant system complements the massive displacement required to float the armored victim by providing the energy required to reliably initiate corrective turning action, regardless of the gear worn, position of water entry, or state of consciousness of the wearer. In the event the conscious victim desires to shed the body armor, a series of quick release means allows the victim to shed their ballistics vest while retaining their life jacket.

The individual wearing body armor or heavy equipment on or around the water creates a challenge in the event of sudden entry. In a military setting each strike plate weighs over 9 pounds, typically the individual is also carrying significant armaments, or additional gear. The individual need s not only to float but to be assured that if they injured before suddenly entering the water that an integrated PFD will also orient them into a face up situation. DO to the shear mass attached to their person the buoyant moment attached needs to support the gear as well as the unconscious wearer. As the size of the bladders used to support the armored individual their size creates a secondary problem stability face down as well as face up. Additionally while the use of 9 lbs. of ballast on the back of the victim can augment the corrective Turing action of the integrated life jacket system it is possible that the individual may only have placed a plate on the front of their vest dramatically shifting the centers of ballast and buoyancy. Obviously arrangement of extra ammo, weapons and communication gear may also be of assistance like wise it may also be a detriment to the life jacket system. Further it is desirable that the Life Jacket be able to be activated while wearing the body armor but latter the victim may desire to drop their body armor with out loss of their life vest and thus it is desired that the integrated life jacket upon separation from the heavily ballasted body armor continue to provide reliable airway protection. Currently there are no ballistics vests that provide the unconscious victim with reliable corrective turning action yet alone to consistently provide airway protection under the wide variety of conditions disclosed.

DESCRIPTION OF THE PREFERRED EMBODIMENTS

Figure 1:
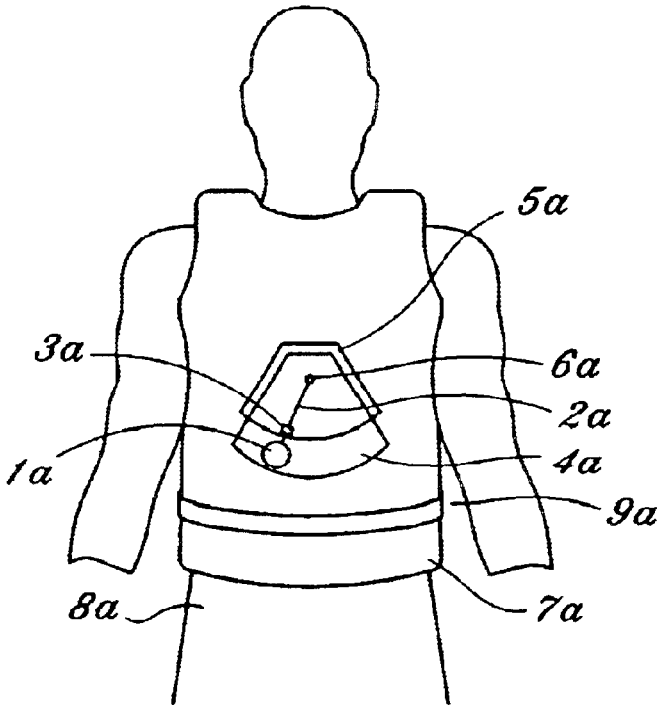
FIG. 1 is a posterior view of a vest style personal flotation device ("PFD") illustrating middling mobile ballast.
Figure 2:
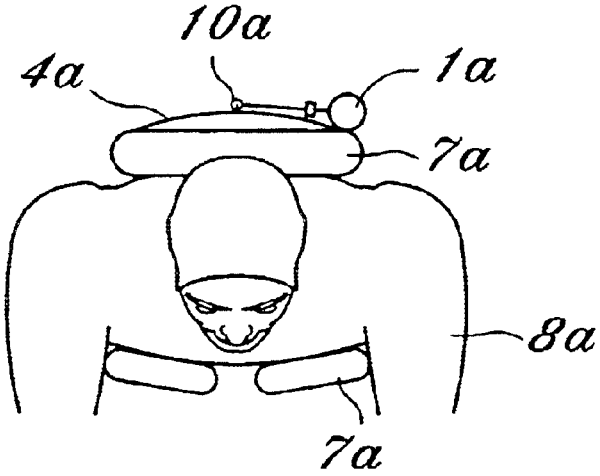
FIG. 2 is a cephalic view of a victim wearing a vest style PFD illustrating the eccentric positioning of mobile ballast.
Figure 3:
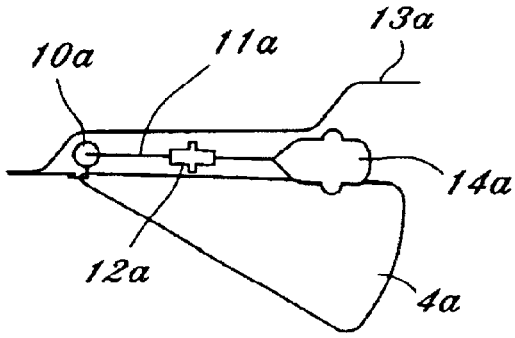
FIG. 3 is a side view of a mobile ballast attachment means illustrating numerous components facilitating mobility of the ballast member.
Figure 4:
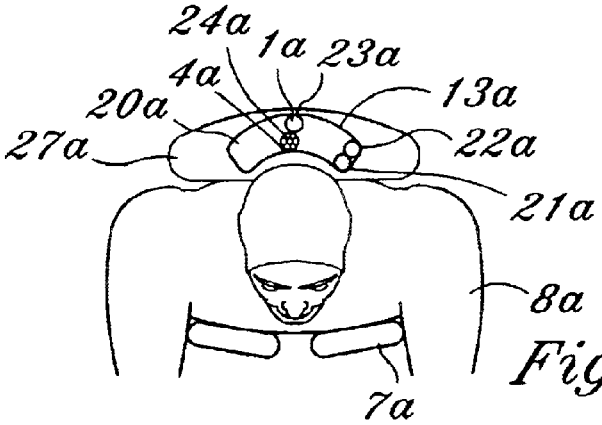
FIG. 4 is a cephalic view of a victim wearing a vest style PFD illustrating a freely mobile ballast within a container that redirects the ballast's movement as the victim rolls.
Figure 5:
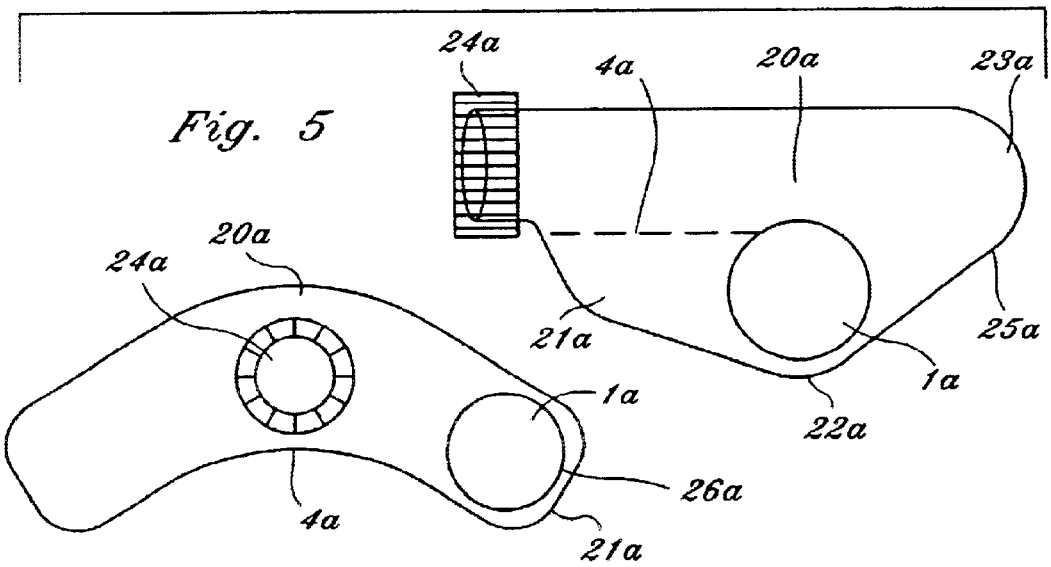
FIG. 5 is a lateral and cephalic view of the mobile ballast's container illustrating the multiple points of stability, as it is reoriented in three dimensions.
Figure 7:
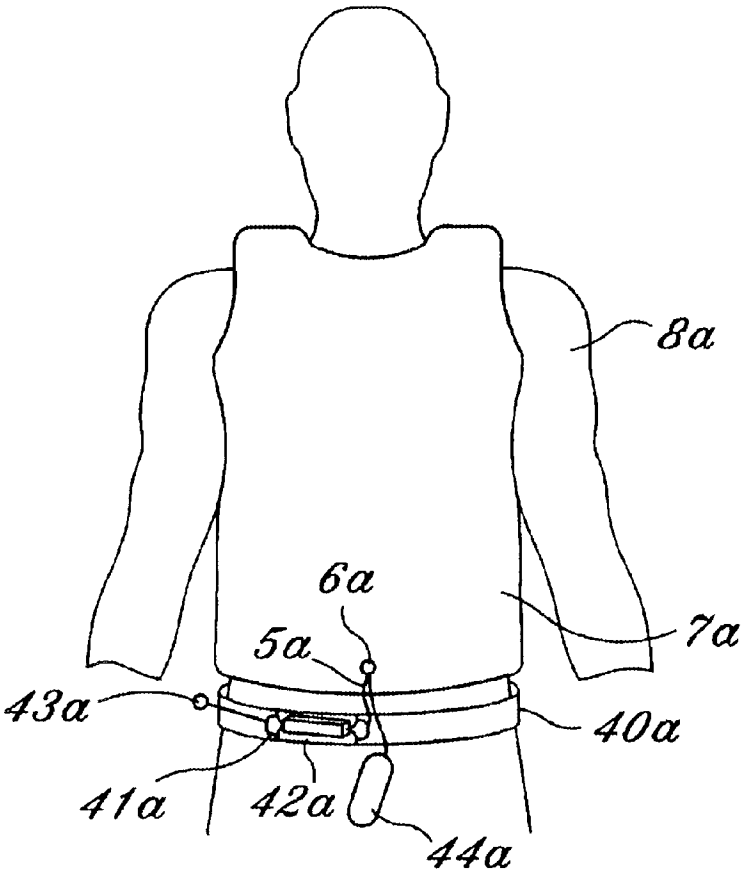
FIG. 7 is a posterior view illustrating a dual position minimally active eccentric fixed keel that can be released by the wearer into a maximally active mobile position.
Figure 6:
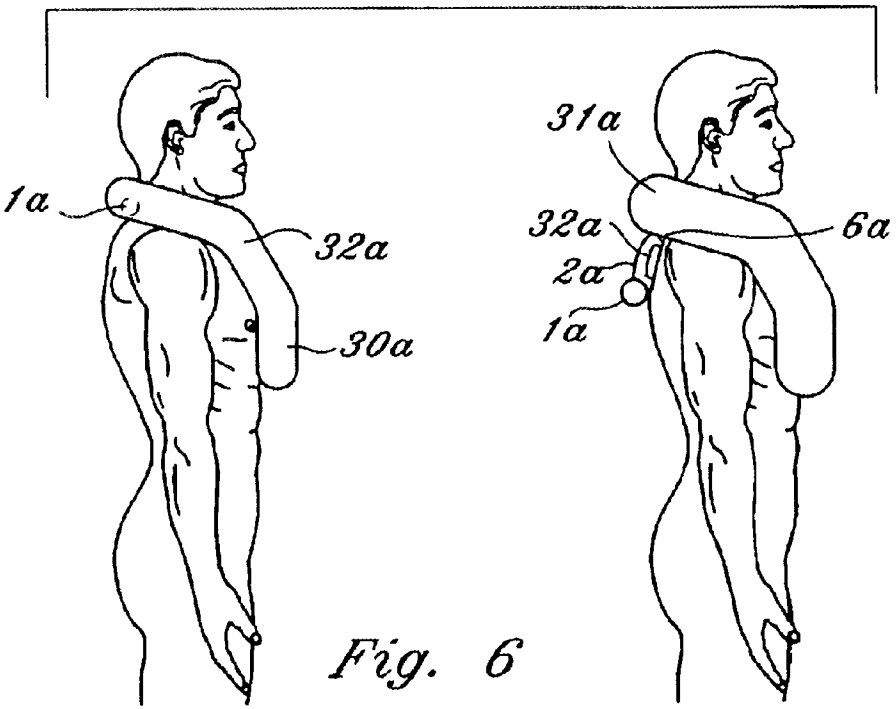
FIG. 6 are lateral views of a deflated then inflated PFD illustrating stowage then deployment of the ballast member.

FIGS. 1 through 8 illustrate swing keel embodiments for a ballasted personal flotation device ("BPFD") which allows the use of a relatively small (light) keel (weight/ballast) to enhance comfort and compliance of a personal flotation device ("PFD") while retaining the efficacy necessary to self rescue a unconscious victim. PFD is defined, for all of the above and below disclosure, to include all various traditional personal flotation devices, as well as buoyancy compensators, and other types of dive gear. While permanent eccentric placement of the ballasting member achieves enhanced rotation, it leaves the victim floating off to one side, placing one corner of the mouth in closer proximity to the waters surface i.e. decreasing freeboard, a parameter used by testing laboratories to determine PFD efficacy. The placement of the mobile ballasting moment 1*a* on a centrally attached flexible 2*a* or rigid arm 11*a* allows movement of the keeling member towards either the left or right side. Once set in motion the keeling moment gains momentum, accelerating the victim about their axis of rotation, towards the position of greatest stability i e. where the ballasting moment is suspended beneath the center of buoyancy rather than balanced above it and the victim's airway is consequently positioned out of the water.

The keel's arm can either be flexible 2*a* or rigid 11*a*. The swing of the keel is preferably constrained such that its course allows access to the left or right about a caudal arc but restricted in its cephalic swing such that the ballasting member cannot strike the victim's head. The location of attachment 6*a* of the keel's arm can be variable as dictated by location of the PFD's buoyant members or the individual's anatomy, i.e. such as one who has had a lung or limb removed with its dramatic impact on surface positioning. In general a central positioning provides the greatest symmetric freeboard. The keel's range can be limited by rigid 13*a* or flexible 5*a* member that constrains range of motion but ideally without impinging upon the ballasting member in such away that it would impair freedom of movement. A rigid cover 13*a* is preferred in protecting the head of the victim from being struck by the keel and provides reliable constraints upon the lateral and posterior range of motion. To reduce cost, a fabric cover 5*a* sewn above the keel arm 2*a* can alternatively be provided and determines the keel's lateral and posterior range of motion.

To enhance mobility of the keel a spherical design la promotes easy rotation about its arc, though other shapes are considered within the scope of the invention. Comfort, aesthetics and therefore compliance argue for a portion of the keeling member to be more cylindrical 14*a* to reduce the protuberance of the keel from the back of the PFD.

A swivel 3*a* integrated into the flexible arm 2*a* or rigid arm 11*a* of the swing keel can be provided to reduce resistance of the ballasting member rolling along its arc. Swivel 3*a* eliminates the opposition to rotation that can arise from twisting the rigid or flexible arm that attaches the keel to the BPFD and/or eliminates the drag that can arise as the keel is skidded or dragged along the surface rather than rolled.

Modification of the dorsal surface of the PFD into a complementary convexity 4*a* further reduces the incidence of the center of ballast to be stabilized above the center of buoyancy. While the foam of the jacket could be shaped into a convex surface 4*a* to meet this need, the storage of the BPFD might result in the high density keel deforming the foam, creating a depression with significant memory such that when the PFD is pressed into use the depression might entrap the keel allowing the victim to once again be stabilized in a face down position. Ideally convexity 4*a* is formed of some rigid material. The rigid surface can be independent or fused to the PFD's closed cell foam. Rigid convex surface 4*a* further reduces the coefficient of friction between rolling swing keel 1*a* and the surface of the PFD over which the keel is rolling. The improved ease of movement of the rigid keel upon the rigid convexity further contributes to the reduction in keel mass without sacrificing reliable airway protection.

A rigid container 20*a* can alternatively contain the ballasting member, to be freed from the constraints of the flexible or rigid arm. Fully enclosed the ballast sphere la could roll across a surface designed to enhance self-rescue. In the face down position the keel preferably resides on a rigid convexity 4*a* initiating movement to the left or right lateral gully the lowest point to the left or right upon face down entry into the water. Upon reaching the lateral gully of the container the surface would angle off towards the legs or Caudal gully 22*a*. This inferior movement of the mobile ballast 1*a* complements the naturally occurring motion of the victim where the initial axial rotation is supplanted by a pendular motion as the legs swing from the flexed position of the face down position into the extended position of a victim floating face up. The containers third low point, the posterior gully 23*a* would attract the mobile keel from either the left or right caudal gully 22*a*, moving the ballast away from the back of the victim, establishing then stabilizing the victim in the safe zone, approximately thirty (30°) degree off of dead vertical. The dangerous zone is identified as vertical to less than approximately twenty (20°) degrees off of vertical, in which position the head of the unconscious victim can flex forward submerging the victim's face and/or seriously compromising the victim's airway. The rigid container 13*a* provides a three-dimensional rigid surface upon which the keel can easily relocate, directing the mobile ballast 1*a* through a progressive series of angled surfaces complementing and thereby driving the complex maneuvers associated first with initiation of rotation then converting the victim's rotary motion into a cephalo-pedal swing and finally stabilizing the unconscious victim in the airway protected surface position known as the "safe zone".

The container if sealed 24*a* can contribute an inflatable element equal to its displacement minus the mass of the keel, to the buoyant means of the PFD. The "neutral" buoyant mobile ballast "swing" keel can thus be integrated into the body of the PFD, reducing bulk and thereby enhancing comfort appearance and therefore supporting the compliance critical to real world efficacy. Any decrement in comfort is outweighed by the superior performance of the BPFD over current PFDs.

The BPFD shifts the onus of rotating the unconscious victim from buoyancy alone to a system combining ballast and buoyancy. The secondary gain associated with the advent of the BPFD is that buoyancy now relieved of the task of rotation can be relocated from the ventral area to the peri-cervical-cephalo area where its displacement can be employed to improve freeboard enhancing victim viability in an inclement sea state rather than sitting uselessly above the water line upon the chest of the unconscious victim. Additionally, with the improved physics of self rescue accomplished by using a combined ballast/buoyant PFD, some of the buoyancy previously employed for rotation in prior art PFDs can be eliminated reducing bulk and further increasing comfort and compliance.

For the individual occupied around the water environment, a soft coating of the mobile keel 26*a* and/or inner surface 25*a* of the container can be provided to mute the sound of the movement of the ballasting member 1*a*, promoting day in/day out comfort and compliance while retaining the advances of BPFD's reliable airway protection.

Environmental concerns mandate that the keeling members, ideally of high density comport with environmental responsibility. Given the life span of the fabric bodice of the PFD it is preferred that a non-lead keel be selected, though such is not considered limiting. The corrosive marine environment can be negotiated by an epoxy coated ferrous material that would exceed the life span of the other component of the PFD and not lead to a lead recovery problem.

There is currently a movement under way to convert the current complex classification of PFD's which is Type I through V into a more succinct and clear labeling of life jackets, Type A & B. Clear labeling would identify Type A as Airway Protective and Type B as a Buoyant Aid but not airway protection. The Type B can be identified with a pictograph showing a slash across a victim floating in a face up position. Complementing the new direction in PFD nomenclature, a quick release coupling 12*a* in the swing keel's arm 5*a* can be provided to allow the recreational boater required to wear PFD to comply with the law by routinely wearing a Type B Buoyant Aid, but in the event of deteriorating weather or impending emergency the connection of ballasting member 1*a* would allow the boater to upgrade the performance of their Type B PFD into a Type A Airway Protective PFD.

For the individual engaged in or about water, mobile ballast member 1*a* can be restrained in an inactive position 42*a* until released in the event of an emergency into its central active position 44*a*. Such release converts the BPFD from Type B into Type A. Ideally the outer shell of the PFD 50*a* continues down towards the waist to envelope a secure belt 40*a* to which the inactive immobilized ballast member 41*a* is secured by a quick release means 42*a*. In one embodiment, a pair of hook and/or loop fastening members can be closed or the immobilized ballast member 41*a* by a releasable piece of hook and/or loop fastening member connected by a pull cord 43*a* to the front of the BPFD. The secure belt holding the ballast in close and tight proximity to the body of the wearer 8*a* allows the ballast to be comfortably borne by the hips of the wearer rather than swinging about on their back. The dual position BPFD is preferably used with active water sports where the decision to convert from Buoyant Aid to Life Jacket occurs rarely, in contrast to the commercial Type A jacket which is only donned in the event of an impending emergency water entry.

Additionally the mobile ballast 1*a* can be specifically adapted to inflatable PFD where it is stowed and restrained within the cover. Upon inflation of the buoyant chamber the mobile keel would be released into its active position.

Some of the advantages achieved with and/or features of one or more of the embodiments illustrated in FIGS. 1 through 8 include, but are not limited to, the following: (1) Mobile ballast member integrated into the buoyant means of a personal flotation device; (2) Mobile ballast member attached to life jacket by flexible means; (3) Mobile ballast member attachable at variable positions to the life jacket by flexible means; (4) Mobile ballast member attached to life jacket by flexible means held in inactive position until released; (5) Flexible means connected through swivel to ballast member; (6) Flexible means connected through quick release coupler to ballast member; (7) Mobile ballast member attached to life jacket by rigid means; (8) Rigid means connected through swivel to ballast member; (9) Rigid means connected through quick release coupler to ballast member; (10) Ballast member of spherical configuration to facilitate movement along arc; (11) Rigid convex surface over which ballast member rolls throughout the arc of rotation determined by attachment means; (12) Rigid convex surface integrated with displacement foam of life jacket; (13) Rigid cover limiting range of motion of ballast member; (14) Flexible cover limiting range of motion of ballast member; (15) Enclosed container restricting range of motion of ballast member; (16) Enclosed container with convex surface—With second intersecting surface angled caudally—With third intersecting surface angled dorsally; (17) Enclosed container permanently sealed off to create buoyant means, less than, equal to or greater than ballasting means; (18) Enclosed container reversibly sealed off to create buoyant means, less than, equal to or greater than ballasting means; (19) Container and or ballast means coated with sound absorbing material; (20) Mobile Ballast secured quick release inactive position—Secured to belt about waist; (21) Belt loosely connected to PFD contained in Fabric of outer shell; (22) Quick release mobile ballast secured to crotch strap securing PFD to wearer; (23) Mobile ballast immobilized within storage shell of inflatable PFD, released upon inflation; and (24) Inflatable.

FIGS. 9 through 15 illustrate the eccentric fixed and mobile ballasted life jackets embodiments of the present invention. While sufficient ballast placed along the posterior midline of a PFD will create instability of the face down position and therefore eventually initiate the airway protective roll, central positioning requires significantly more ballast and time to destabilize the face down position. The current invention provides several embodiments that allow a relatively small keel to achieve, more rapidly and comfortably, reliable airway protection. Given that a stackable Type 1 PFD only weighs 3–5 lbs., the addition of excessive amounts of high density ballast is quite noticeable and uncomfortable to the wearer. Previously discussed tank mounted ballast for a typical midline keel weigh from the 6–8 lbs. The present invention reduces the weight to 1–2 pounds of highly effective eccentric mobile ballast.

In the fixed posterior midline position discussed above, the keel is stabilized directly above the center of buoyancy, the horizontal distance of the keel from the axis of rotation is consequently zero and the rotational energy generated by the fixed midline keel is also unfortunately zero. A keel located top dead center is described as being at zero (0°) degrees on the circumference about the victims axis of rotation.

When the keel is at ninety (90°) degrees the horizontal distance from the axis of rotation is at its maximum and therefore, for a given amount of ballast, so is the effort applied in rotation of the victim about their axis. When the keel is at one hundred eighty (180°) degrees it is suspended directly beneath the victim and the entire system's center of buoyancy. The effect of gravity upon the keel at one hundred eighty (180°) degrees is straight down once again i.e. no energy is being applied in an attempt to rotate the victim about their axis. This position, with the keel one hundred eighty (180°) degrees, places the victim face up airway protected and is the only stable moment in a correctly ballasted self rescuing BPFD (Ballasted Personal Flotation Device). In the event that a large wave throws the victim over onto their face, once again the keel will seek its lowest point, suspended directly beneath the center of buoyancy, restoring airway protection.

The rate of self rescue is dependent upon numerous factors in addition to size of the keel and are discussed below. Compliance (the presence of the Life Jacket on the victim at the onset of a water emergency) has been shown to be critical in drowning prevention as opposed to the PFD carried aboard the vessel but stowed rather than worn. The eccentric mobile ballast of the present invention by either its site of attachment off of the midline or its rapid movement away from the midline is able to initiate the self rescue roll with relatively less energy input i.e. less weight. The eccentric keel optimizes the rotational energy per unit mass allowing reliable airway protection to coexist with wearer comfort which has been shown to be a non-negotiable bottom line necessary to achieve real world compliance and therefore efficacy.

Figure 11:
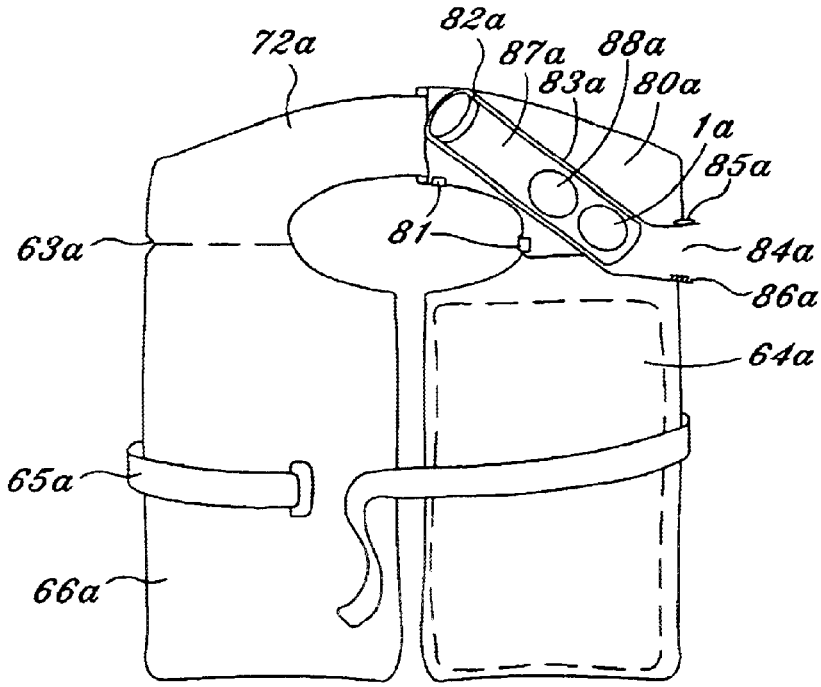
FIG. 11 is a posterior view of a yoke collar style or stackable PFD illustrating an externally attached eccentric cylindrical container for a mobile ballast member that can be put in place without having to remove the jacket.
Figure 12:
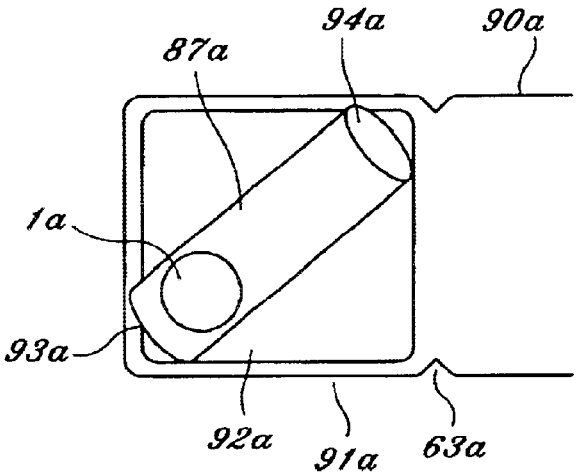
FIG. 12 is a lateral view of a yoke collar PFD showing the integrated form of FIG. 11 where the mobile ballast and containment means are embedded in the foam of the neck of the jacket.
Figure 67:
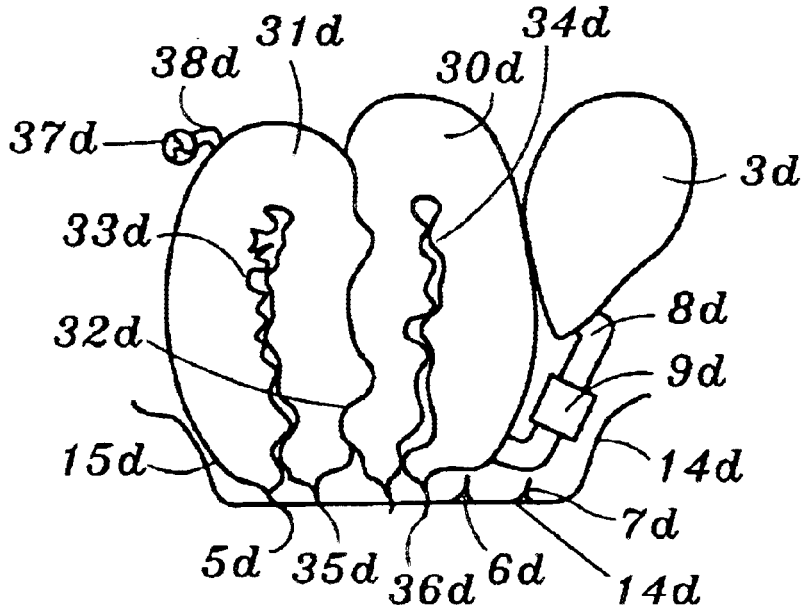
FIG. 67 is a side view of the abdominal chambers showing the inferior and superior bladders attached in the tightest configuration producing the lowest volume/lowest profile abdominal bladder.

There are a wide variety of prior art life jackets, with each design group unique in how they locate ballast about the victims neck and torso. What is referred to as the stackable PFD is a flat PFD that allows easy stowage. Some jurisdictions require the highest rated Life Jackets to roll a face down unconscious victim into and airway protected position within five (5) seconds in calm fresh water. FIGS. 9 through 15 illustrate a Yoke Style Collar or stackable PFD 66*a* having pericervical buoyant means 71*a* that supplies the displacement of the cervical collar 72*a*. FIG. 67 shows a relatively simple, reliable attachment means for securing one or more ballast moments to the perimeter of an existing PFD. Without any ballast the existing PFD is a buoyant aid, i.e. only capable of airway protection if the conscious wearer can position themselves in a face up position. This buoyant aid may be all that can be tolerated or necessary. If an emergency were to arise and the wearer was in warm water wearing minimal clothing a single ballast element is sufficient, if the emergency arise in an inclement environment in which the impending water victim is wearing thermal protective clothing, two or more elements maybe required to right an unconscious victim draped in water logged clothing. The eccentric ballast attachment member 126*a* is preferably comprised of a cylindrical ballast 100*a* which is threaded onto a strap 124*a*. The strap is secured by attachment means 121*a* to the mounting strap 120*a* that envelopes the PFD. The mounting means 120*a* is secured by fastener member 122*a* which preferably makes a reliable connection by relying upon multiple overlapping surfaces. If this closure mechanism were to fail the ballast would drop away and the life jacket would be reduced back to an airway submerging buoyant aid. Similarly cover strap 123*a* secures and protects the ballast belt 124*a* from being snagged and possibly released with the same consequences described above. Stiffener 125*a* supplies critical rigidity necessary to prevent ballast 100*a* from sliding from its position on the PFD's lateral surface onto the PFD's ventral, dorsal or medial surface where the selected ballast may be insufficient to effectuate the self rescue roll. Notably ballast 100*a* is specifically selected so that it can be transferred to an integrated mobile ballast PFD as shown in FIG. 12. Once the ballast is located in a tubular containment member 87*a* it can be continued to be used indefinitely, allowing its cost and ecological impact to be minimized.

Typically, a PFD's inherently buoyant means is comprised of multiple layers placed symmetrically about the wearer. However, the size of eccentric ballast can be reduced removing a portion of the buoyant means whether inherently buoyant, inflatably buoyant or of mixed origin. The eccentric placement of buoyant means about the PFD can be used to facilitate the self rescue roll by reducing the symmetry as well as by reducing the size of the buoyant moment that must be submerged by the ballast during the initiation phase of self rescue (zero to ninety degrees).

Figure 13:
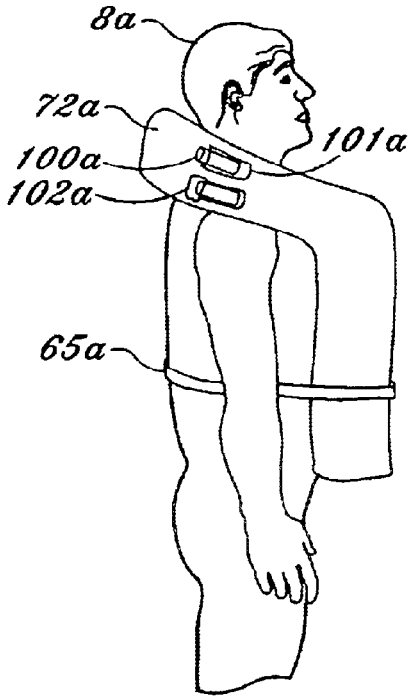
FIG. 13 is a lateral view of a yoke collar PFD while being worn and showing multiple external pouches built into the fabric of the jacket that allow the user accessible adjustment of an amount of ballast without having to remove the vest.
Figure 14:
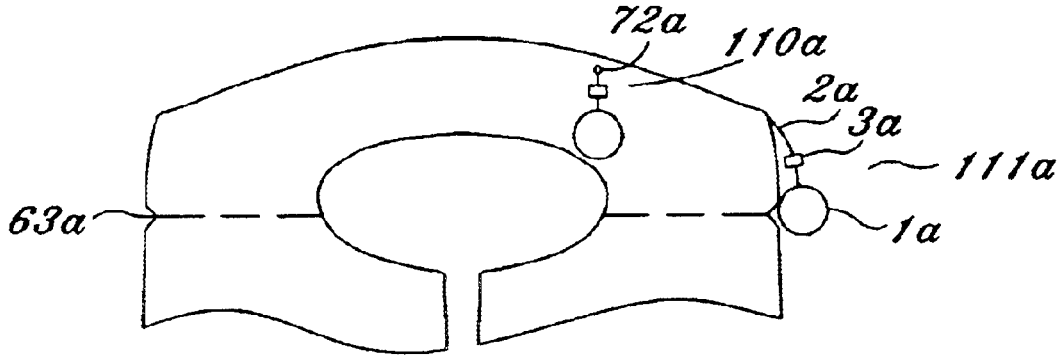
FIG. 14 is a posterior view of a cervical portion of a yoke collar style PFD illustrating eccentric placement of quick release mobile ballast members, one of which can preferably be added while wearing the PFD, one of which preferably cannot.
Figure 15:
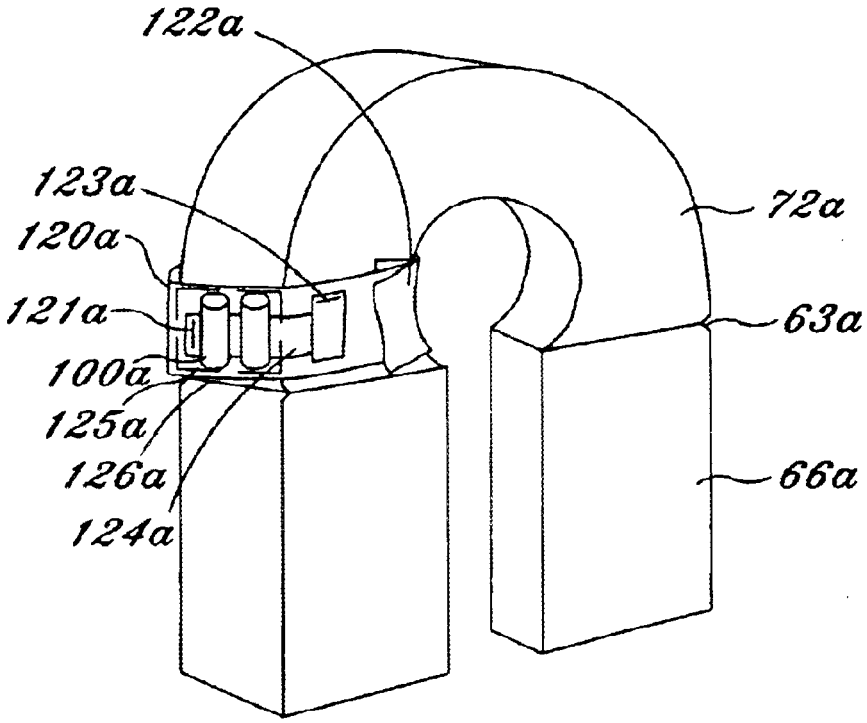
FIG. 15 is a right anteriolateral view of a yoke collar style PFD showing an externally attached eccentric fixed ballast system that can be adjusted while wearing the PFD.

The fixed, eccentric ballast as shown in FIG. 13 integrated into the construction of a new PFD locates the containment means 101*a* in an accessible area for wearer manipulation in the field. Significantly the jacket does not have to be removed in order to convert the jacket from a buoyant aid device into a Life Jacket with varying strengths of active self rescue. FIG. 15 shows a "fix" for PFDs currently in existence. The eccentric fixed ballast means 100*a* are only applicable to those select PFDs which through specific placement of the buoyant means of the PFD, only need assistance with the initiation phase of the self rescue roll, i.e. zero (0°) to ninety (90°) degrees. Once PFDs of this design are moved out of the stable face down position the buoyant means alone is capable of completing the phase two of self rescue, i.e. ninety (90°) to one hundred (180°) degrees.

Other PFD designs in order to achieve reliable airway protection with minimal amounts of ballast require mobility of that ballast means to assist not only with phase one initiation but with phase two completion of active self rescue. A mobile ballast requires a containment means to limit and direct the keels movement to effectuate the conversion of stabilize face down flotation into face up. In PFDs of this design an eccentric fixed keel will roll the victim off their back and onto their side where they become stabilized in a side high position. However, the unconscious victim's flaccid airway is severely flexed to the point of obstruction and their airway remains submerged. In this side high position the victim often rapidly succumbs to Shallow Water Drowning. Notably both the eccentric fixed and mobile ballast elements rely upon being located off the midline to achieve phase one rotation with a minimum amount of ballast.

Figure 9:
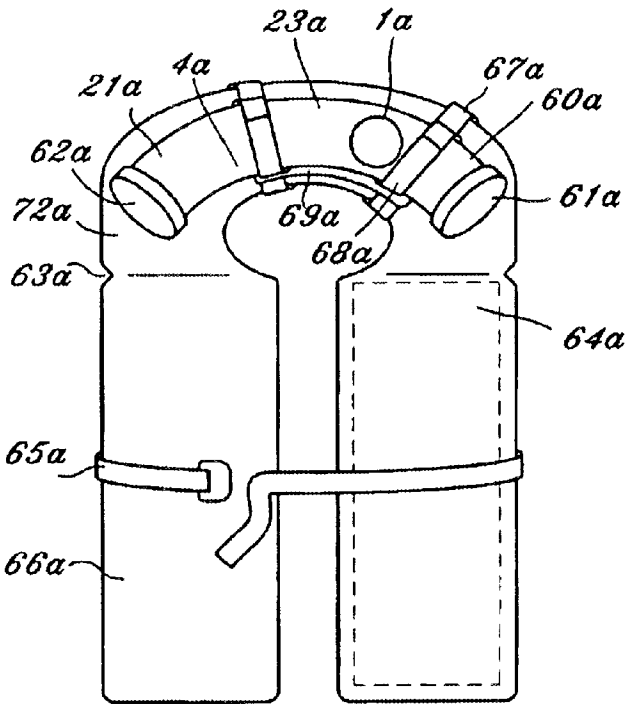
FIG. 9 is a posterior view of a yoke collar PFD with an attached mobile ballast contained in a sealed semi-circular container.
Figure 10:
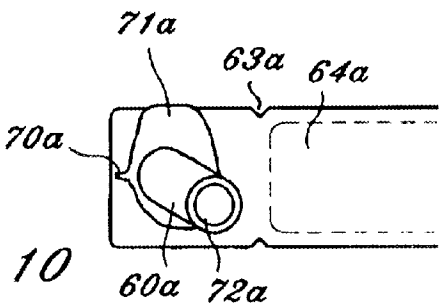
FIG. 10 is a lateral view of a yoke collar PFD illustrating a PFD in accordance with the present invention constructed to accommodate a recyclable contained mobile ballast member.
Figure 8:
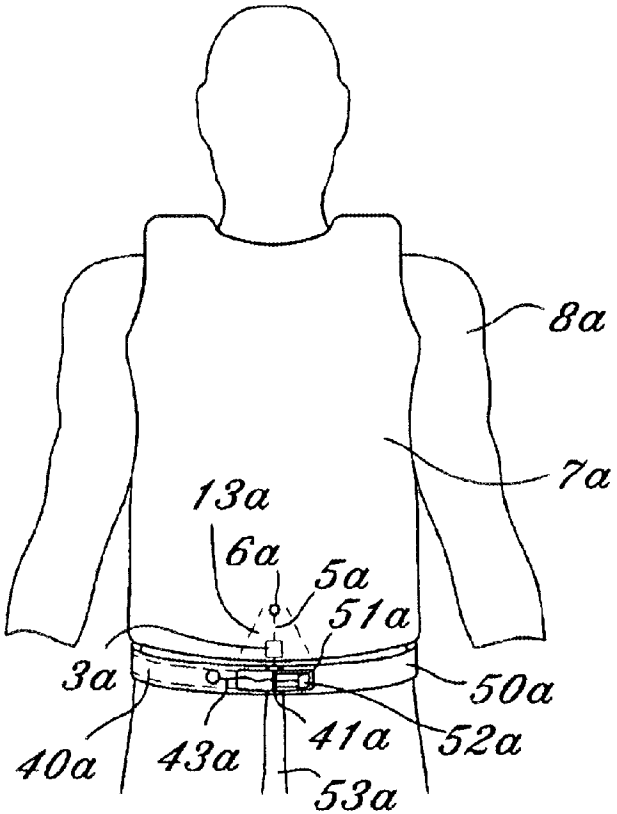
FIG. 8 is a posterior view showing an immobilized ballast member that can be released by the wearer into an active mobile position.

As seen in FIG. 9, another embodiment is shown where an exterior attachment of a semi-circular container 60*a* containing a mobile ballast 1*a* allows existing jackets to acquire active self rescue. Container 60*a* and mobile ballast is of such a design that it can also be used within the cervical collar of a new stackable PFD. Container 23 and ballast 1 have a longer useful life expectancy than the fabric lives of several current PFDs. This recyclable feature allows the cost to be spread out over many jackets and minimizes the disposal problems presented by high density metals such as lead. Furthermore, the stackable PFD 66*a* of FIG. 11 shows a straight container means 87*a* within a fabric sleeve 83*a* attached to a fabric hood 80*a* secured to stackable PFD 66*a* by attachment means 81*a* allowing an in field fix of an existing stackable PFD. One advantage of straight container means 87*a* is it allows the use of one, two, as well as three or more mobile ballast elements 1*a* since they all stack up the same corner of the PFD. With semicircular 60*a* containment means 23*a*, mobile ballast 1*a* elements are preferably provided in an odd number (i.e. 1, 3, 5 . . . ) to prevent an even distribution of the ballast elements. With only two elements one could be located at each end effectively balancing each other out leaving the victim floating face down. The advantage to multiple elements is that the container diameter can be reduced allowing easier manipulation as well as comporting with the size restrictions of infant or children's PFDs.

The stacking linear containment means finds slightly divergent applications in other PFD designs. The multiple stacking of the ballast elements moves and facilitates container 23*a* relocation as is necessary in effecting the first phase of active self rescue (i.e. zero (0°) to ninety (90°) degrees), then the ballast must relocate to the other end to optimally facilitate phase two of the active self rescue roll( i.e. ninety (90°) to one hundred eighty (180°) degrees.

While cervical container means 60*a* and 87*a* benefit from being closed in that they contribute displacement in the critical cephalic area, helping to maintain freeboard, the distance measured from the corner of the mouth to the water's surface, when used within the back of a vest style PFD, perforated end caps 101*a* allow the air to exhaust so that the container's displacement does not oppose the containers relocation during the conversion from phase one to phase two of the active self rescue roll.

Some of the advantages achieved with and/or features of one or more of the embodiments illustrated in FIGS. 9 through 15 include, but are not limited to, the following: (1) Eccentric Single or Multiple ballasting means, Attached to Inherently buoyant, Inflatable buoyant, or Hybrid buoyant, Personal Flotation device; (2) Fixed Eccentric ballast means; (3) (New Construction) Internal or external Integrated Fixed eccentric ballast member Accessible for placement and or removal, Inaccessible, combination of partially inaccessible with the option to add additional ballasting elements; (4) (Fix of in existing products) Externally Attached eccentric ballast member, with independent reversible or Permanent attachment means, accessible, inaccessible, mixed; (5) Ballast Means, cylindrical or spherical for use in fixed and mobile ballast systems; (6) Mobile ballast member integrated into the buoyant means of a personal flotation device; (7) mobile ballast member attached to life jacket by flexible means; (8) mobile ballast member attachable at variable positions to the life jacket by flexible means; (9) Mobile ballast member attached to life jacket by flexible means held in inactive position until released; (10) Mobile ballast attached midline; (11) Eccentric mobile ballast member attached at point off midline; (12) Flexible means connected through swivel to ballast member; (13) Flexible means connected through quick release coupler to ballast member; (14) Mobile ballast member attached to life jacket by rigid means; (15) Rigid means connected through swivel to ballast member; (16) Rigid means connected through quick release coupler to ballast member; (17) Ballast member of spherical configuration to facilitate movement along arc; (18) Rigid convex surface over which ballast member rolls throughout the arc of rotation determined by attachment means; (19) Rigid convex surface integrated with displacement foam of life jacket; (20) Rigid cover limiting range of motion of ballast member; (21) Flexible cover limiting range of motion of ballast member; (22) Enclosed container restricting range of motion of ballast member; (23) Enclosed container with convex surface—with second intersecting surface angled caudally—with third intersecting surface angled dorsally; (24) Enclosed container permanently sealed off to create buoyant means, less than, equal to or greater than ballasting means; (25) Enclosed container reversibly sealed off to create buoyant means, less than, equal to or greater than ballasting means; (26) Vented non-buoyant container for mobile ballast; (27) pivoting straight container attached at laterally, swinging cephalo-caudal; (28) container and/or ballast means coated with sound absorbing material Inflatable; (29) stiffener means; (30) asymmetric buoyant means; and (31) mobile buoyant means.

Figure 16:
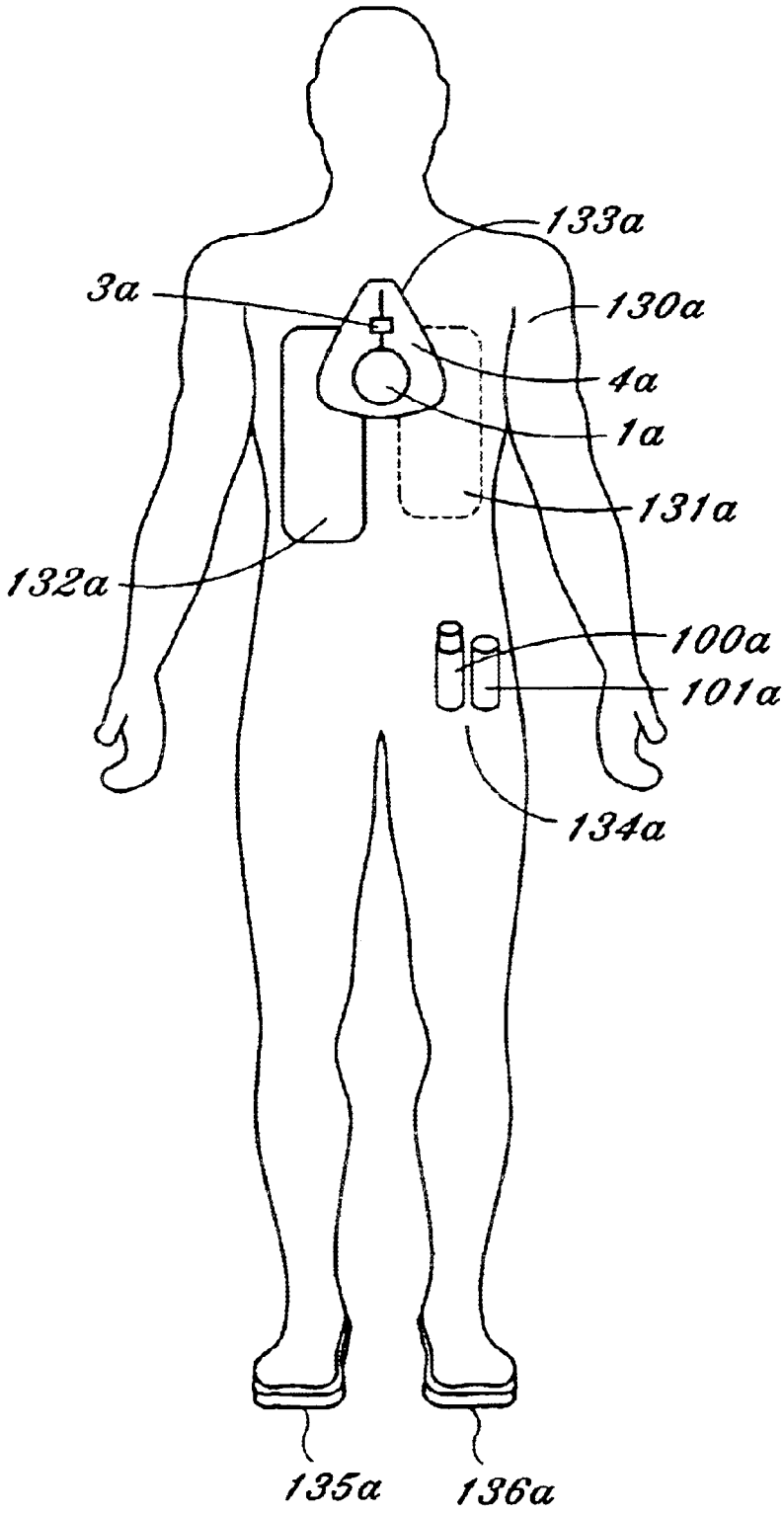
FIG. 16 is a posterior view of a thermal protective suit illustrating multiple fixed and mobile ballast and buoyant members.

Individuals employed offshore are often supplied with whole body thermal protective garments 130*a* as seen in FIG. 16. Currently despite the garments massive buoyant moment such individuals are also required to wear a life jacket. The inclusion of eccentric fixed and mobile ballast and buoyant means of the present invention allows the buoyancy inherent in the thermal protective garment 130*a* to fulfill the dual purposes of warmth and surface support. FIG. 16 is a posterior view of one such exposure suit or thermal protective garment 130*a*. The traditional neoprene suit of a wind surfer or water enthusiast is likewise capable of protecting core temperature as well and is also considered with the scope of the invention. A ventral eccentric buoyant means 131*a* combines with a posterior eccentric buoyant means 132*a* to help destabilize the face down position. The addition of multiple ballast members such as a midline mobile ballast system 133*a* with an eccentric fixed ballast system maybe sufficient for a tight fitting neoprene protective garment. In the exposure suits designed for north sea offshore oil rigs there is a need for peripheral ballast members, 135*a* and 136*a* to assure the victim will maintain a heads up position. Preferably, the identified direction of turning is reinforced by the placement of eccentric ballast such that there is sufficient energy to initiate the first phase of self rescue, i.e. the size of 136*a* exceeds 135*a*. In the vertical position this difference is negligible.

Some of the advantages achieved with and/or features of the embodiments illustrated in FIG. 16 include, but are not limited to the following: (1) Thermal protective gear with one or more eccentric fixed buoyant means; (2) Thermal protective gear with one or more eccentric mobile buoyant means; (3) Thermal protective gear with one or more eccentric fixed ballast means; (4) Thermal protective gear with one or more quick release eccentric fixed ballast means; (5) Thermal protective gear with one or more eccentric mobile ballast means; and (6) Thermal protective gear with one or more quick release eccentric mobile ballast means.

Figure 17:
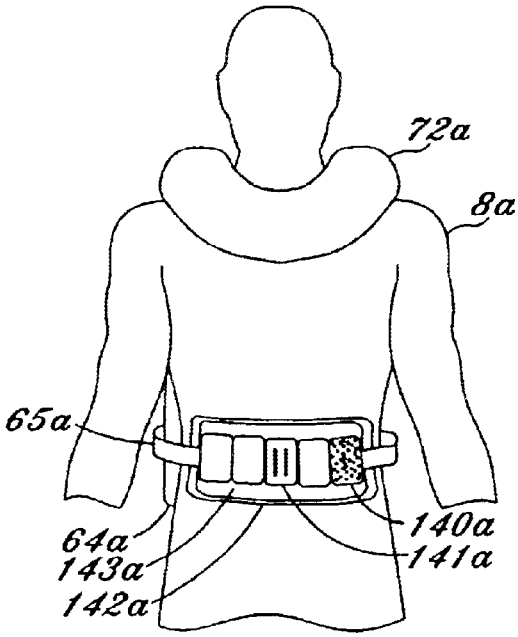
FIG. 17 is a posterior view of a yoke collar style PFD illustrating a fixed hemi-circumferential ballasting member.

FIG. 17 illustrates a PFD Strap ballast embodiment in accordance with the present invention. One PFD design that is popular in children is a yoke type collar PFD or stackable PFD. The children's PFD does not lend it self to the same solution as the adult, i.e. the eccentric fixed ballast locate along the lateral cervical area. The combination of the child's body density, narrow pulmonary fields and predominance of mass in the cephalic area makes them resistant to the lateral ballast moment. FIG. 17 shows the wearer 8*a* wearing a stackable PFD 72*a* held by strap 65*a*. The ballast moment is spread by attachment means 142*a* along the posterior width of the individual. The ballast may be a lead shot 140*a*, though such is not limiting. Lead shot 140*a*, in a soft coating, preferably conforms to the body's surface. Alternatively, lead shot 140*a* may be comprised of small rigid blocks of ballast such as 141*a*. The posterior horizontal distributed ballast means 142*a* is located upon the back of the wearer 8*a* and held in place from slippage there from by a stiffener that conforms to the wearer 143*a*.

Figure 18:
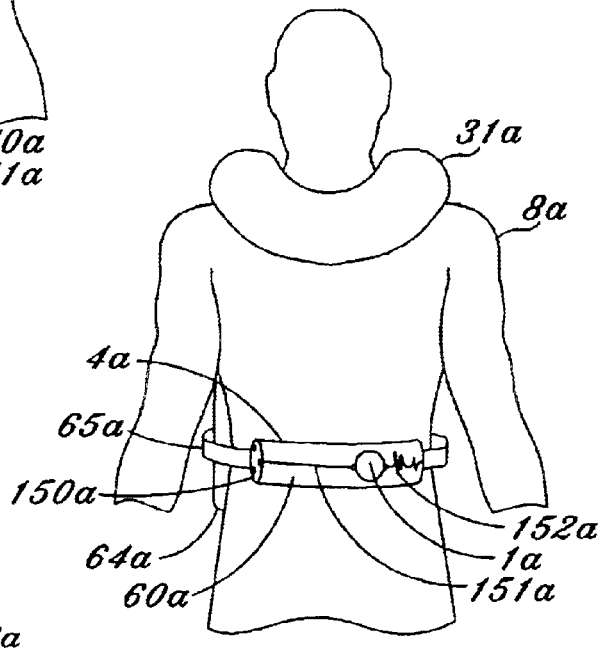
FIG. 18 is a posterior view of a yoke collar style PFD illustrating a mobile ballast secured via multiple attachment points crossing a victim's midline within a ventilated container.
Figure 19:
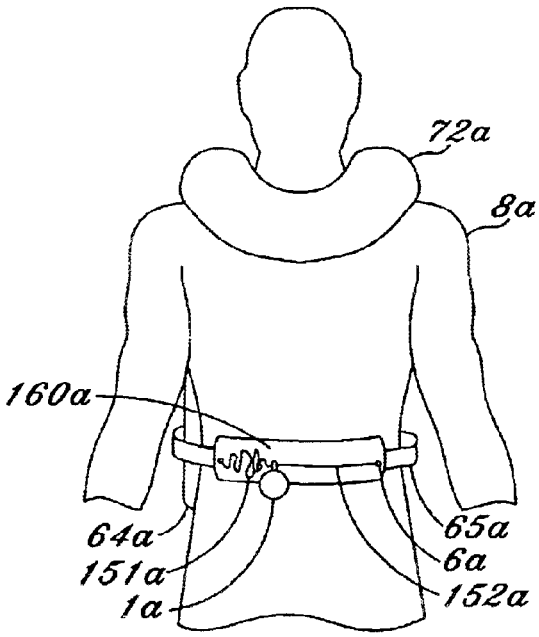
FIG. 19 is a posterior view of a yoke collar style PFD illustrating a mobile ballast secured via multiple attachment points crossing a victim's midline secured to a PFD strap but otherwise open for unlimited range of motion.

Alternatively, in FIG. 18 the child 8*a* wearing an inflatable PFD 31*a* achieves the keeling action from mobile ballast contained within a container 60*a* with curved surface 4*a*. The mobile ballast 1*a* is preferably attached to both ends ventilated end caps 150*a*, which allow water end thereby avoiding placement of a counterproductive buoyant moment low on the victim's back. Mobile ballast 1*a* is suspended from diametric points via left flexible means 151*a* and a right flexible means 152*a*. This dual suspension transfers across the midline of the victim to the opposite side of the ballast's location. FIG. 19 adapts this dual suspension to a strap attachment means 160*a* that can be added or built into the PFD strap 65*a*. Unrestrained mobile ballast 1*a* is free to roll to either side yet when it reaches the end of its flexible arm 151*a* or 152*a* it exerts a turning force across the midline. As the self-rescue roll nears the end of the second phase, the mobile ballast is suspended from both arms and is located in the midline, swung away from the victim, stabilizing them in the safe zone. Due to the lack of a container that invariably restricts motion and consequently location, the open device can be of smaller size for a given rate of turning.

Some of the advantages achieved with and/or features of the embodiments illustrated in FIGS. 17 through 19 include, but are not limited to, the following: (1) Horizontal band of ballast, fixed or mobile along PFD Strap or belt or back of vest; (2) Body Stiffener conforming sized and conforming to the wearer; (3) Mobile ballast suspend from left and right arms; (4) Attached to PFD Strap; (5) Contained in ventilated means—With curved surface beneath mobile ballast Eccentric and Mobile Ballast and Bouyancy Parts List (FIGS. 1 through 19)

1*a* Mobile Ballast Member
2*a* Flexible Arm
3*a* Swivel
4*a* Curved Surface
5*a* Flexible Retaining Cover
6*a* Arm Attachment Point
7*a* Life Jacket
8*a* Wearer of PFD
9*a* Lower Edge of PFD Fabric Back Panel Covering Ballast Components
10*a* Pivoting Attachment Point
11*a* Rigid Arm
12*a* Quick Release Coupler
13*a* Rigid Retaining Cover
14*a* Conical Mobile Ballast
20*a* Container for Mobile Ballast Member
21*a* Lateral Gully Low Point

22*a* Caudal Gully Low Point
23*a* Posterior Gully Low Point
24*a* Airtight Lid for placing/servicing mobile ballast member
25*a* Sound Reducing Coating of inside of Container
26*a* Sound Reducing Coating of Mobile Ballast Member
27*a* Surrounding Foam of PFD
30*a* Stowed Inflatable PFD
31*a* Inflated PFD
32*a* Deflated PFD Retaining Cover
40*a* Secure belt
41*a* Inactive Immobilized Ballast Member
42*a* Quick Release Retainer Means
43*a* Quick Release Activation Means—Pull Cord
44*a* Activated—Mobile Ballast Member
50*a* Continuation of Outer Shell of PFD
51*a* Loop Portion of Hook and Loop Fastening Member/Quick Release Means
52*a* Hook Portion of Hook and Loop Fastening Member/Quick Release Means
53*a* Crotch Strap
60*a* Semi-Circular Container
61*a* Foam Pad insulating end cap
62*a* Resealable End Cap
63*a* Flexible Fabric Joint between Thoracic-Ventral and Cervical-Dorsal
64*a* Ventral Buoyant Means
65*a* PFD Strap
66*a* Yoke Collar Style or Stackable PFD
67*a* Resealable Closure for container
68*a* Cervical Foam Pad
69*a* Semicircular Fabric Hood
70*a* Resealable Closure Means
71*a* Layers of closed cell foam
72*a* Cervical collar of stackable PFD
80*a* Fabric Hood
81*a* Hood Attachment means
82*a* Tube Cap
83*a* Tube Sleeve Cover
84*a* Tube Sleeve Cover Opening
85*a* Tube Sleeve Closure Means, Loop Portion of Hook and Loop Fastening Member
86*a* Tube Sleeve Closure Means, Hook Portion of Hook and Loop Fastening Member
87*a* Straight tube Containing Mobile Ballast
88*a* Second Mobile Ballast Element
90*a* Ventral Surface of PFD
91*a* Posterior Surface of PFD
92*a* Cervical Buoyant Means Embedding Container means
93*a* Posterior-Medical End of Container Means
94*a* Ventral-Lateral End of Container Means
100*a* Eccentric Fixed Ballast Means
101*a* Ballast Container Means
102*a* Sealable Container Cover
110*a* Eccentric Inaccessible Mobile Ballast Element
111*a* Eccentric Accessible Mobile Ballast Element
120*a* Mounting Means for addition of Ballast, Strap
121*a* Attachment Point of Ballast Belt
122*a* Secure Closure Means
123*a* Safety Cover for termination of Ballast Belt
124*a* Ballast Belt for secure mounting of eccentric ballast
125*a* Stiffener Means
126*a* Eccentric Ballast Attachment Means
130*a* Thermal Protection Garment
131*a* Ventral Eccentric Buoyant Means
132*a* Posterior Eccentric Buoyant Means
133*a* Midline Mobile Ballast System
134*a* Eccentric Fixed Ballast System
135*a* Single Eccentric Peripheral Ballast Means
136*a* Multiple Eccentric Peripheral Ballast Means
140*a* Shot Ballast
141*a* Solid Block Ballast
142*a* Posterior horizontal distributed ballast means
143*a* Stiffener sized to conform to wearer
150*a* Ventilated End Cap
151*a* Left Flexible Arm
152*a* Right Flexible Arm
160*a* Attachment means for multiple suspended mobile ballast As seen in FIGS. 20 through 38 a combined ballast and signaling device which is neutralized by attachment to an eccentrically buoyant PFD is disclosed and generally designated as reference numeral 1*b*. It is recognized that the role of the eccentric or midline, fixed or mobile, ballast or buoyant moment confers improved airway protection upon personal flotation devices ("PFDs"), which have been defined above. It is disclosed herein that the ballast associated with certain required attachments when appropriately sized, located and if required, minimally augmented, can confer a synergistic dual advantage enhancing airway protection as well as enhancing visibility to search and rescue efforts.

Standards agencies have not only approved but require that certain types of PFDs particularly commercial Safety Of Life At Sea ("SOLAS"), Off-Shore Type 1 Life Jackets carry a lighting or illumination means 2*b* for assisting in the night time search and rescue efforts of individuals lost at sea. Other individuals making passage on lightly crewed vessels carry telemetry devices 40*b* that awaken sleeping crew alerting them to a man over board situation as well as demarcating their position on an electronic locating device aboard the vessel. Others advise carrying personal EPIRBS 25*b* (a signaling device) for assisting their being located day or night while adrift. These and other devices routinely attached to the PFD when specifically sized and located can supply the ballast that is critical in order to replace PFD stabilized airway submersion with active self rescue. i.e. a PFD that is capable of reliably rolling an unconscious victim's face out of the water without their assistance or reliance upon sea state to initiate the Life Jackets turning.

Since every PFD requires a different ballasting arrangement as previously disclosed, certain PFD designs may require the ballasting/powering element 24*b*, 37*b* to be connected to the light, strobe, transmitter, etc., preferably via a conductive cable 23*b*. Other PFDs, because of their design, lend themselves to a easier solution in which the batteries, case and appliance are all contained at a solitary site, where the mass of the device confers enhanced airway protection while concurrently providing wearer operable access to the signaling device. If necessary, an additional battery 11*b* or batteries can be added to assure that the requisite ballast requirement is met for active self rescue. Additionally, the materials for the container 12*b* might be selected to help fulfill a portion of the ballast requirements of a particular PFD, i.e. steel or lead instead of plastic. Further, as some devices exposed to moisture are packed in petroleum jelly 14*b* to decrease detrimental effects of water within the device, the packaging medium can be selected to meet or exceed the specific gravity of water so that the entire volume of the containment means contributes positively to the ballasting moment rather than sealing in air which would reduce the net ballast moment. A variably sized high density plug 13*b* can be attached as required by the individual PFD to meet the PFD's specific ballast needs, i.e. the remainder of the ballast and signaling device remains constant but if a particular brand PFD requires 2 lbs. instead of 1 lb., a different plug 13*b* can be attached. Attachment means 16*b* allows quick and secure retrofitting of PFDs in the field. Attachment means 16*b* can be an arm member, preferably rigid, whose distance from the PFD can be varied allowing the attached appliance increased range of motion and therefore increased efficacy in imparted rotational energy per unit mass of the combined ballast and appliance.

A new PFD would locate grommets to specify the exact location of existing ballasted appliance identifying where a ballasted appliance needs to be attached in order to assure ballast mediated airway protection. O-ring sealed switch 17*b* allows operation by the wearer. Alternately, the appliance device may be water activated in the event of unconscious water entry.

Ballasted signaling device 1*b* can be instantly mounted such as by a locking hook and loop fastening strap member 5*b* or safety pins 16 onto PFDs currently in the field allowing a fix to airway submersion that does not result in the attachment of yet another device to the PFD where it not only clutters the appearance but may confuse an obtunded individual seeking to differentiate their strobe light from their ballast fix (i.e. in the event of hearing a search and rescue vehicle approaching at night). Given the difficulty associated with trying to change regulatory standards to allow the attachment of a purely ballasting member to a PFD with its concomitant reduction in the net buoyancy of a life jacket, a combined ballast appliance device 1*b* of the present invention, only slightly augmented with additional ballast if necessary, can be immediately shepherded into the field without the paper work and time required to change international standards to accommodate the consequential reduction in the net buoyancy that would occur upon attachment of ballast on PFDs in the field. With newly constructed PFDs, the placement of the additional eccentric displacement means 101*b* on the ventral leg opposite the side where the ballast moment is attached 100*b* will neutralize any effective net loss of buoyancy.

Additionally, the intentional placement of a buoyant member 2*b*, 34*b* on the PFD can supplant or complement the need for a ballasting member in order to achieve active self rescue. Buoyancy can be located in several places such as along the ventral midline of the victim 34*b*, where it alone or in combination destabilizes the airway submerged face down position. As previously disclosed a midline buoyant bubble wants to rise to the surface, shifting the wearer sufficiently off center so that the main buoyant elements of the PFD, with or without attached ballasting means, can come into play and thereby roll the victim over into an airway protected position.

Furthermore, an eccentric placement of a buoyant member 34*b*, 2*b* may take advantage of the differences of the right pulmonary fields preponderance of displacement versus the left lung field which is reduced by the volume of the intrusion of the pericardial sac with its fluid and muscular contents. While there is a predictable incidence in which the location of the heart is reversed, it typically is not a factor to be ignored in positioning.

Any container sized, sealed and or selected so as to be sufficiently buoyant, such as the device purely for displacement 34*b* or one with alternate function such as a means of illumination 2*b*, can be located in either a midline or eccentric position and if of sufficient buoyancy it alone can shift the victim out of the zero (0°) degree face down position. Obviously, separation of a products buoyant moment from its ballasting moment and thereby positioned to optimize turning, could combine in a synergistic fashion to accomplish enhanced airway protection while assisting in search and rescue. If additional batteries are needed for ballast purposed, they can also provide for extended operation or increased brilliance and range of signaling devices, that may also prove life saving.

Figure 24:
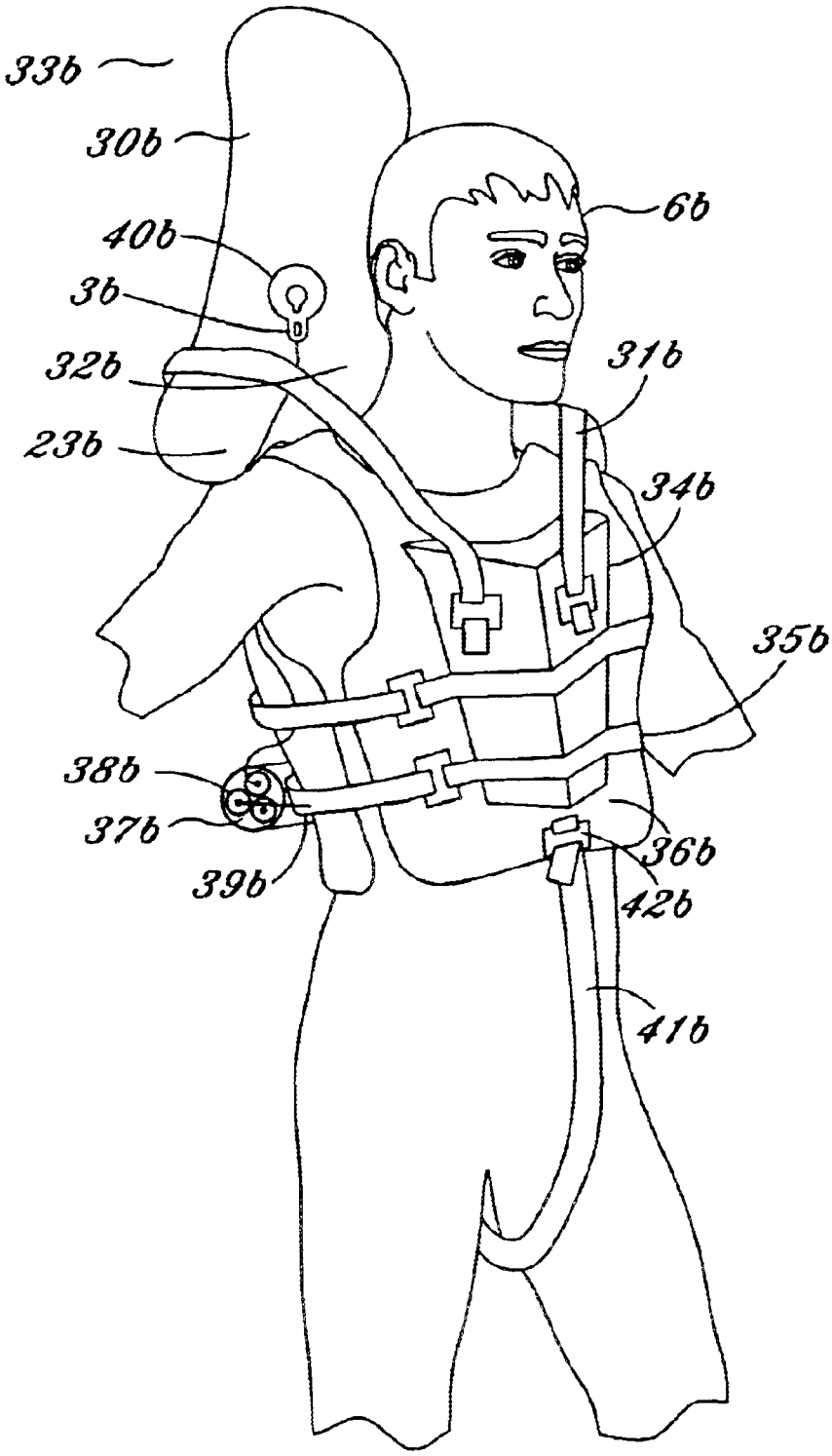
FIG. 24 is a left anterio-lateral view illustrating a two part PFD with eccentric central anterior buoyant means and second cephalo-cervical buoyant means with dual arm mobile ballasting battery means.

As part of the responsibility for turning over the unconscious victim is borne by ballast, the buoyant means can be redistributed to where more of its displacement is located about the head and neck 33*b*. In this place, increased freeboard is achieved for a given displacement PFD. A side entry PFD as seen in FIG. 24 allows the central ventral position to be occupied by an asymmetric ventral buoyant means 34*b* where the displacement mimics a horse collar life jacket. The central preponderance creates an instability of the face down position and drives the first phase of self rescue, 0° to 90° degrees. The lateral ventral component only has to be sufficient to power the rescue through phase 2, 90° to 180° degrees. Complementing this is the dual arm mobile ballast battery means 37*b* which is attached across the victims midline so that the rotational energy will be applied past 90° degrees. The mobile ballast comes back to a central position once the victim reaches 180° degrees or face up. The cephalo-cervical cradle 33 can be securely snugged up by the wearer operating straps 31*b* locking the head from rolling off to the side. Secure and correctly positioned straps and fasteners are preferably provided to prevent the wearer from slipping down in the PFD. Furthermore, a crotch strap 41*b* with secure fastener means 42*b* is also preferably provided for keeping the buoyant moments in their correct position on the flaccid victim.

Figure 20:
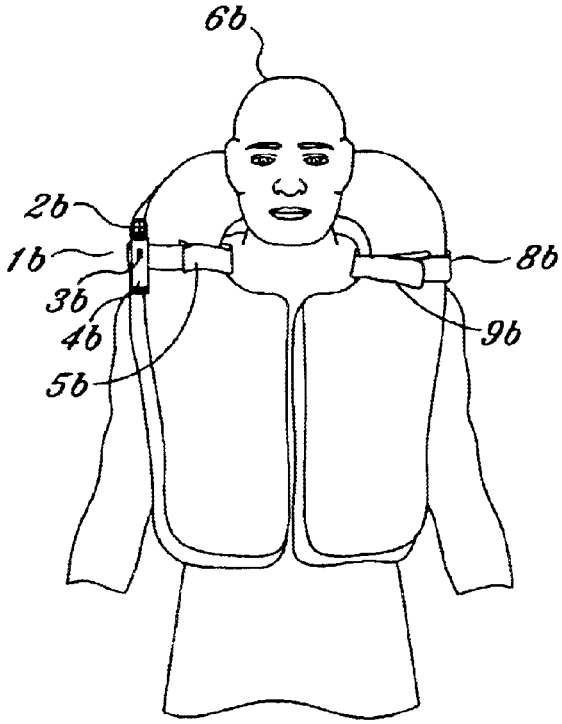
FIG. 20 is an anterior view of an individual wearing a yoke collar style PFD, illustrating an eccentric, fixed combined illumination and ballast means.
Figure 25:
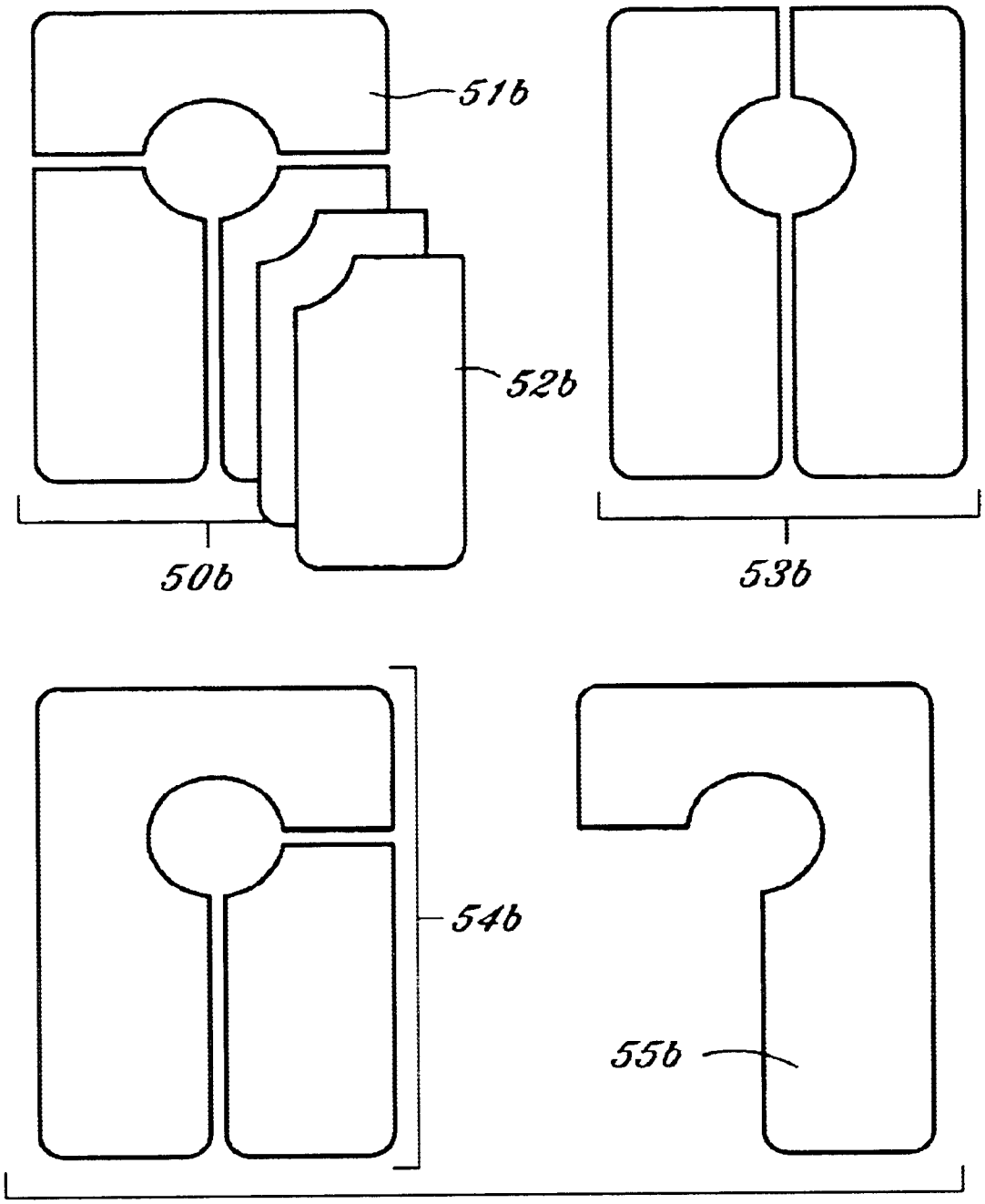
FIG. 25 is a frontal view of yoke collar style PFD foam members showing existing and disclosed alternate configurations for internal foam layers.
Figure 26:
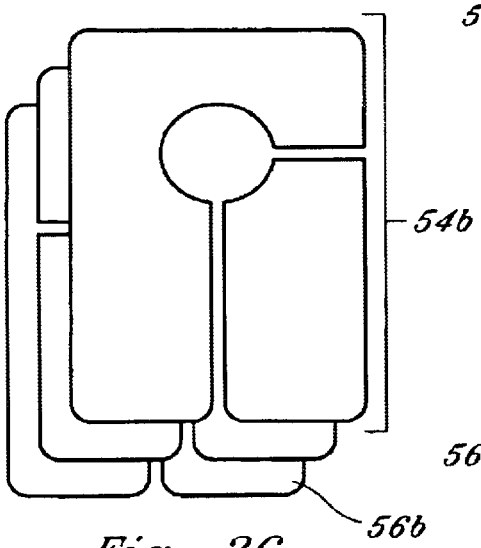
FIG. 26 is an anterior view of stacked foam layers preserving uniform foam thickness throughout the PFD.
Figure 35:
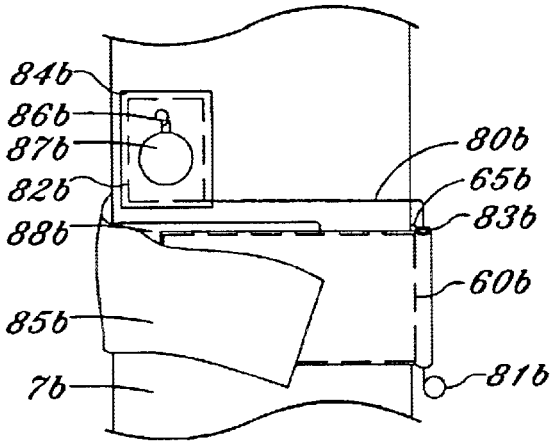
FIG. 35 is an enlarged view of a cervical-ventral joint of a yoke collar style PFD illustrating an externally attached rigid swing arm attachment of eccentric mobile ballast.

FIG. 25 shows a current configuration for a yoke collar style PFD, generally designated as reference numeral 50*b*, which includes three pieces of foam that currently comprise each layer, one cervical piece 51*b* and two ventral pieces 52*b*. This configuration has been grand fathered in to its current position as an industry standard based on ease of sewing and assembly. Configuration 50*b* stacks all the foam joints bilaterally in the lateral cervical area. In FIG. 20. the locking attachment means 5*b* not only secures the combined ballast and appliance device and stiffener to the outside perimeter where it prevents the ballast and combined signaling devices migration from the ideal point of attachment, the stiffener also preferably structurally ties together the ventral and cervical foam of the PFD. As seen in FIG. 35 the stiffener can be shaped as a right angle where the anterior stiffener 65*b* can be neutrally buoyant while the lateral stiffener 60*b* can be constructed out of a high density material and thereby comprise an internal fixed ballast. The combination of stiffeners on two sides preferably locks the combined ballast and signaling device securely to the PFD.

FIG. 25 illustrates a relatively simple solution for a newly constructed PFD which preferably includes additional units of ventral foam piece 52*b*. In a SOLAS grade PFD, depending on the thickness of foam selected by the manufacturer, as little as two additional pieces of foam on top of the usual 8*b* piece construction produces enough of a difference in the left versus right ventral buoyant members to shift the flaccid victim off center and thus initiate phase one of active self rescue.

Figure 32:
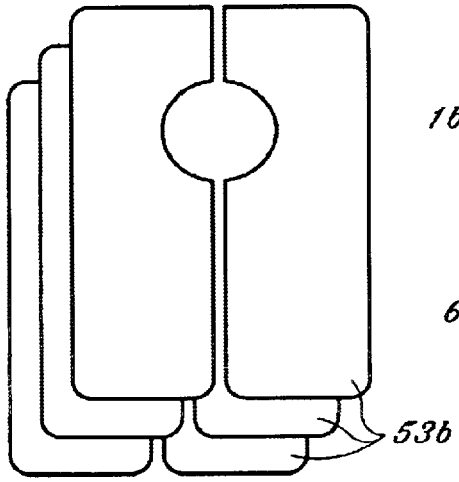
FIG. 32 is a frontal view of a PFD stack comprised solely of two piece layers with the joints located at the posterior cervical midline.

Another cost effective configuration for a newly constructed PFD, is a PFD built from a simple two piece foam layer arrangement 53*b* then stacked as in FIG. 32. This eliminates the lateral joint and thereby allows the attachment of the lateral ballast a more complete purchase on the ventral and a portion of the cervical displacement means.

Figure 30:
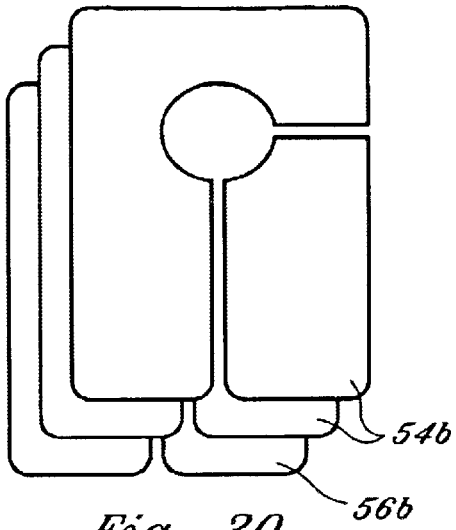
FIG. 30 is a frontal view of a PFD stack comprised of a single piece over sized base layer with the balance being two piece layers with the joints all on one side opposite the ballast.
Figure 31:
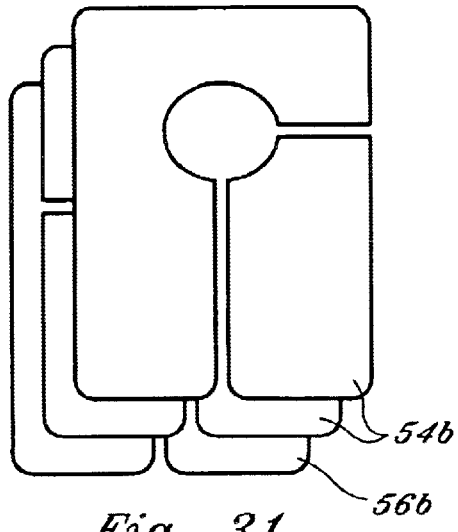
FIG. 31 is a frontal view of a PFD stack comprised of single piece over sized base layer two piece layers with the joints on alternating sides.
Figure 33:
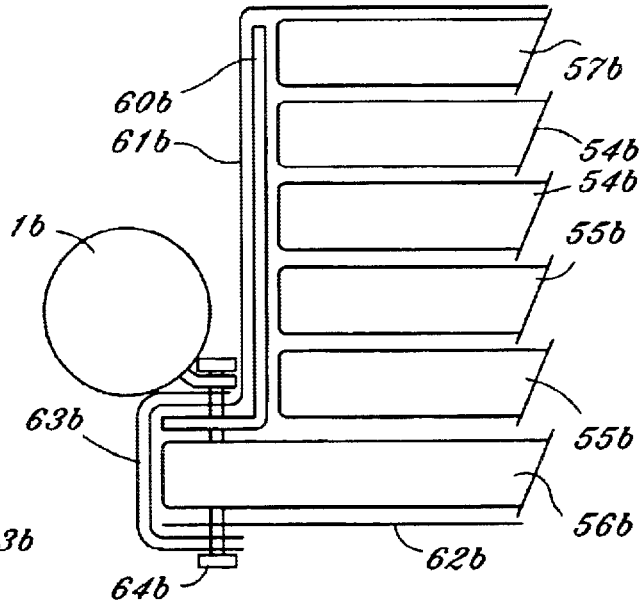
FIG. 33 is a cross sectional view of a cervical area of a yoke collar style PFD illustrating attachment of combined ballast and appliance to oversized foam base, coated fabric shell and 90 degree two part stiffener means the lateral component of which may be constructed of high density material.

Adding considerably to the complexity of sewing the fabric shell and then stuffing that fabric shell with the foam layers, are the foam layer stacking arrangements as shown in FIGS. 30 and 31. An oversized base layer 56*b* as seen in FIG. 33 allows the anterior coated fabric shell 61*b* and the posterior coated fabric shell 62*b* to be sewn through the foam base layer integrating the PFD structurally. Currently PFD fabric is uncoated allowing it to stretch and loosen resulting in increased laxity of the cervical-ventral joint. A coated one side fabric can greatly extend the life of the PFD and if the applied SOLAS tape were sufficient and the coating was placed outside there can be fabric protection form UV, petroleum products, salt water, etc. Depending on whether the PFD is designed to be classified as a PFD that will be required to carry a signaling device, the stiffener can be in part or completely comprised of high density ballasting means 60*b* which can be joined to the fabric and foam at the peripheral seam or encased in a pocket along the side of the PFD. A binding tape 61*b* covers and reinforces the joint. The combined ballast and signaling means 1*b* is secured via fastener means 64*b* at the ideal site as determined by the arrangement of buoyant means in a particular PFD.

Compliance from a child asked to wear a PFD all day long may necessitate greater flexibility of the lateral cervical joint as in the alternating stacking arrangement of FIG. 31, yet the base layer and alternating layers supply improved structural integrity to the foam elements that must effectively receive and transfer the rotational energy from the ballast means to the victim. FIG. 30 shows a stacking arrangement which will confer even greater rigidity on the ballasted side since there are no lateral cervical joints. While this results in less flexibility and comfort it increases efficacy per unit mass of ballast. On the opposite side of FIG. 82 all the joints lie in a line conferring greatest flexibility for ease of entry allowing the PFD to flex about this joint while donning the device. PFDs constructed as in FIGS. 30 and 31, as do all PFDs, benefit from the inclusion of an eccentric fixed buoyant moment in the side opposite from the side carrying the ballast moment. This can be achieved through the use of foam pieces such as 52*b* or 55*b* as sown in FIG. 25.

Figure 29:
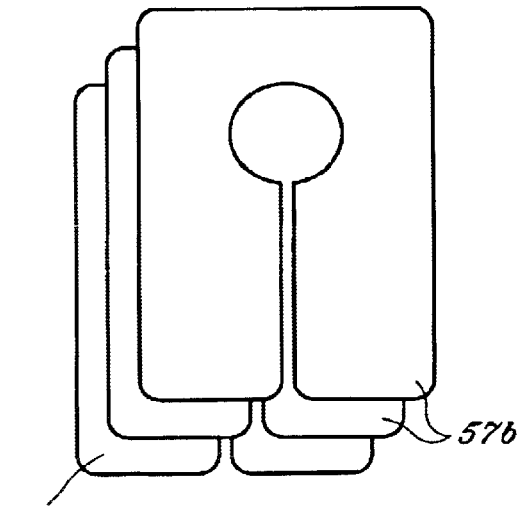
FIG. 29 is a frontal view of PFD stack layers comprised entirely from continuous single piece layers.

Certain Types of PFDs designed for commercial cold water use where the wearer is likely to be wearing thermal protective clothing can include the foam layer stacking arrangement. FIG. 29 is comprised of solid single pieces 57*b* resting upon an oversized base layer 56*b* and sometimes capped by another oversized layer conferring the greatest PFD structural rigidity short of solid foam. The use of layers confers a real advantage in conforming the PFD to the wearer and in adjusting to movement by the wearer as the PFD is bent over the wearer and as the wearer bends, twists etc. Ideally such a stacking arrangement includes the minimum buoyant offset such as foam piece 55*b*, to assure minimal performance under ideal conditions, i.e. tester wearing only a bathing suit as it currently is the sole testing standard despite its short comings when mapped to a real world disaster in the open ocean.

The reduction or elimination of the lateral cervical joint allows the rotational energy of the combined ballast and appliance to more fully applied to rolling the PFD and wearer into a face up position. In current PFDs a lot of the energy is used to deform the fabric shell twisting the lateral cervical joint. The energy that is transferred impacts primarily either the posterior cervical part 51*b* or the ventral foam part 52*b* where it acts independently and if the ballast is insufficient to the PFD inadequately attached to the wearer, the ballast will be suspended below the buoyant component allowing the airway to remain submerged. Current PFD foam layer structure requires unnecessarily excessive ballast to be attached in order for the PFD shell to first be twisted, next the ventral component moved then the cervical before the victim can be rolled into an airway protective position.

Figure 27:
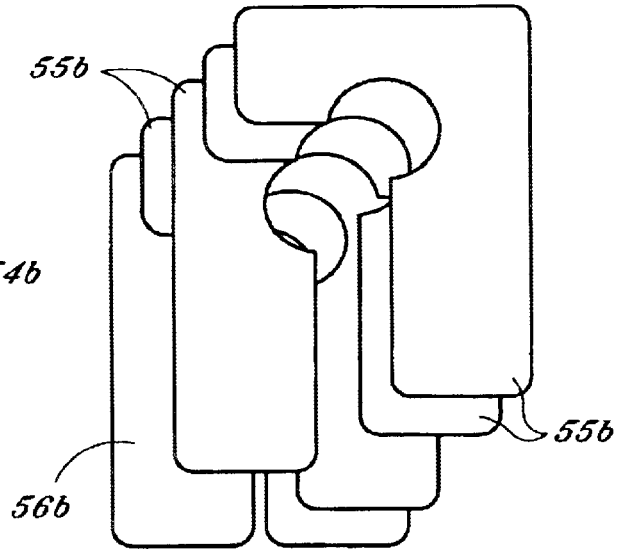
FIG. 27 is an anterior view of stacked foam layers with interlocking layers which result in an increased cervical displacement relative to ventral component.
Figure 28:
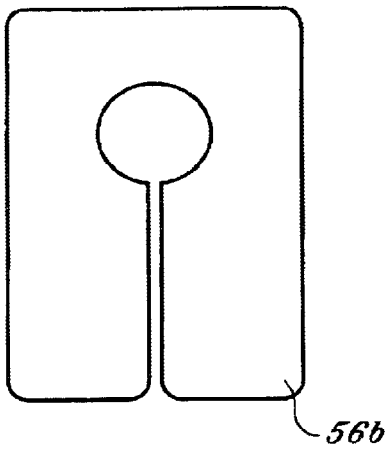
FIG. 28 is a frontal view of a yoke collar style PFD oversized and complete single piece base foam layer.
Figure 34:
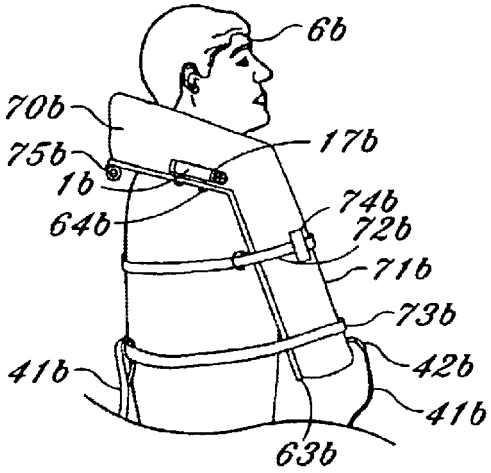
FIG. 34 is a left lateral view of a yoke collar style PFD illustrating amplified cervical displacement means relative to reduced ventral means and attachment of combined ballast and appliance member to oversized foam base/fabric shell held securely by foam layer compressing chest strap(s).

Ideally, the yoke collar style PFD shape can be retained yet free board optimized while keeping the ballasting appliance to a minimum by using a stacking arrangement as shown in FIG. 27. As shown, the PFDs foam layers build upon an oversized base layer 56*b*. Succeeding layers then alternate partial single piece layers 55*b* such that there is a preferential build up of displacement behind the head and neck of the wearer. Depending on how many layers are stacked, this can result in an effective conversion of ventral displacement means toward the neck where it can now be used to enhance free board rather than sit out of water upon the chest of the victim where the majority of the ventral foam can be found and where it does not contribute to displacement or free board. This stacking arrangement in a finished PFD is shown in FIG. 34. The inclusion of two additional ventral elements on one side relative to the other incorporates the fixed eccentric buoyant means necessary and sufficient to meet minimal turning performance. Positioning the combined ballast and signaling device on a vertical pivoting attachment along the opposite ventral buoyant means improves the aggressiveness of the airway protective turning moment of such a PFD.

The efficacy of the PFD, as measured by its airway protection, is enhanced if the buoyant ventral means 100*b*, which in FIG. 34 is shown as the right side of the PFD, is constructed with enhanced displacement relative to the left side or ballasted ventral means 101*b*. This creates an eccentric fixed buoyant means that destabilizes the face down position. If the PFD's differential ventral buoyant means are adequately designed and constructed, an eccentric inherently buoyant PFD can be sufficient to provide airway protection. Ideally, the combination of a ventral buoyant discrepancy combined with a correctly located and attached combined ballast and signaling device provides the PFD with a brisk and reliable rotation of the victim out of the face down position and into the face up position with the least amount of physical divergence from the currently configured PFD as stowed aboard many commercial vessels.

The above advantages as detailed in the PFD constructed from foam layers applies to the solid foam PFD. The enhanced ventral buoyant moment complements the correctly positioned ballast or combined ballast and appliance. That combined efficacy allows for a shift of some of the displacement towards the head and neck where it increases the distance from the waters surface to the victim's airway.

Towards further securing the effective application of energy per unit of ballast 1*b* towards effective self rescue rotation, is cinching strap 72*b*, which encircles the ventral stacked foam layers on the ballasted side of the PFD. Once the PFD is placed on the wearer the foam layers slide into their final position at which time strap 72*b* is now tightened, compressing the foam layers. Once the strap is tightened it connects the stacked layers to the oversized base layer where they connect to the fabric shell and combined ballast and signaling means. A second strap 73*b* can also be provided and encircles the opposite ventral stack further unifying the PFD structurally. Certain body types and or use of thermal protective clothing, make the in water vertical position markedly stable and may require an additional posterior cervical mobile or fixed ballast device 75*b*, similarly attached to the base foam layer and fabric shell of the PFD.

For an individual working in foul weather wearing significant amounts of clothing it can be important to further amplify the rotational energy supplied per unit mass of a ballast regardless of its source. FIG. 35 illustrates an externally applied rigid lever arm 80*b* with an attached 90° degree stop 81*b* that prevents the ballast from swinging past the 90° degree point. In the active position the ballast is moved away from the victim's axis of rotation and held in this position of greatest rotational impact on the face down victim. A second significant advantage of amplifying the ballast's impact by moving it outboard is that it lengthens the lever arm from the vertical axis, generating the additional leverage needed to pry the flaccid victim out of the face forward slump. When the victim is vertical in the water column in what is called the 'PFD Dangerous Zone', i.e. 0° to 20° degrees from vertical, just before losing consciousness there is a strong tendency for the victim to slump forward when they pass out. If the victim slumps forward he or she may hang from their PFD, airway crimped and face in the water, where he or she may quickly drown. With the swing ballast at its greatest distance from the victims vertical axis, the victim is rocked off to the side where the ventral buoyancy is now free to rise towards the surface, swinging the person on their back, airway protected.

Figure 21:
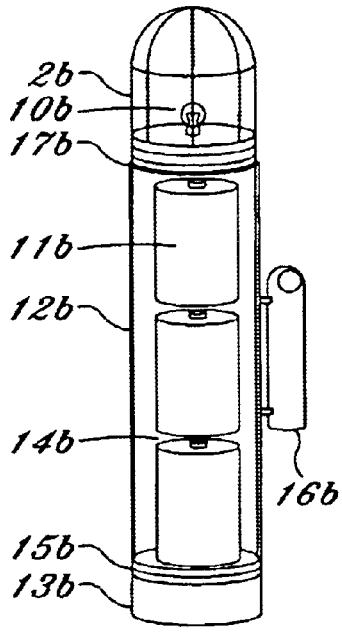
FIG. 21 is an enlarged view of a combined illumination and ballast means showing thickened high density walls, extra batteries, variably sized high density solid base plug and neutrally buoyant packing material.
Figure 22:
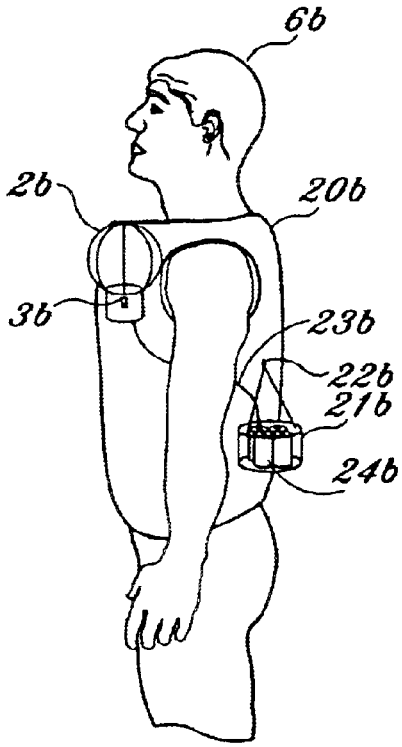
FIG. 22 is a left lateral view of a vest style PFD illustrating left anterior buoyant globe appliance and posterior mobile ballast power means.
Figure 23:
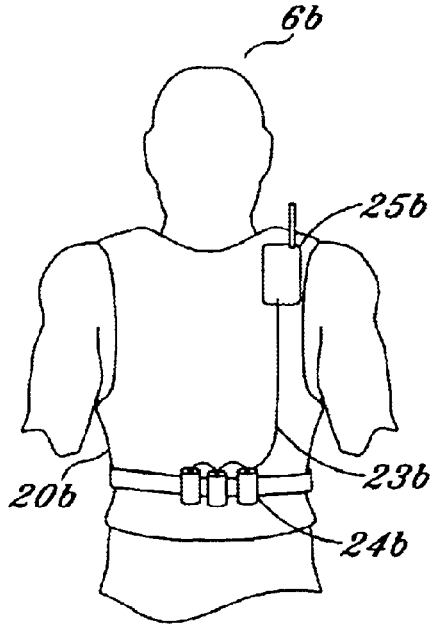
FIG. 23 is a posterior view of a vest style PFD illustrating fixed horizontal ballasting batteries connected to eccentric transmitter means.
Figure 36:
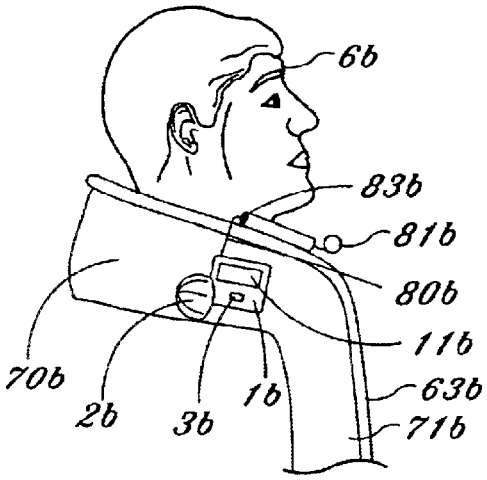
FIG. 36 is a left lateral view of a yoke collar style PFD with combined ballast and signaling device attached via an integrated 90 degree swing arm.

Arm 80*b* and stop 81*b* are preferably connected to a ballast plate 82*b* upon which can be mounted an attachment cover supporting a range of additional ballasting devices via a quick release attachment means 86*b* for securing a simple ballast 87*b* or a combined ballast and appliance such as is shown in FIG. 21. The swing arm is attached by a secure locking means such as might be comprised of an outer jaw 85*b* and inner jaw 88*b*. A stiffener of ballasting stiffener 60*b* improves the conversion of the torque applied to the tubular arm guide 83*b* into rotation of the wearer rather than into deformation of the PFD. FIG. 36 shows an integrated eccentric mobile swing arm with a combined ballast and appliance device 1*b* with additional ballasting power supply 11*b*, regulated by switch 3*b* power signaling/illumination device 2*b*. The tubular hinge 83*b* is preferably secured to the over sized top layer of foam further improving the transfer of the kinetic energy of the ballast into rotation of PFD buoyant means. As the efficacy per unit mass is advanced the buoyant means of the PFD can be reallocated from subserving the responsibility of rolling over the obtunded victim to support the flaccid victim's head and neck, i.e. buoyancy can be removed from ventral means 71*b* and placed behind the head and neck 70*b* conferring increased freeboard or distance of the victim's nose and mouth from the water line.

Figure 37:
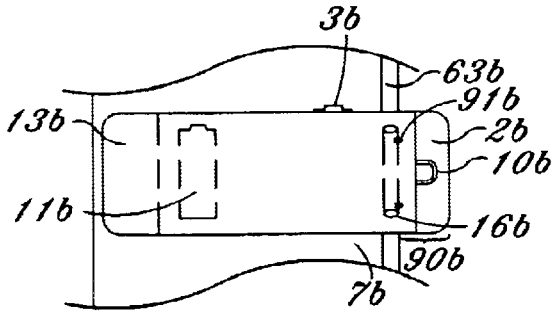
FIG. 37 is an enlarged view of a left lateral cervical-ventral joint illustrating the location of buoyant stop and ballasting swing ends of combined ballast and signaling device with pivoting attachment means parallel to the anterior face of the PFD.

SOLAS Life Jackets when used commercially are required to carry an illumination or signaling device, a preferred embodiment of such is shown in FIG. 37 demonstrates how the combined ballast and signaling means is divided into a long arm that extends towards the rear of the wearer. At the extreme end of the long arm is located the highest density ballast so that when the combined ballast and signaling device swings about attachment means 16*b* that pivots freely through mounting means 91*b*, the ballasted end is moved laterally to the point furthest from the axis of rotation. Alternatively, when the victim is floating face up, the long arm of the ballast end swings the device back adjacent the lateral edge of the PFD which now positions the short buoyant arm straight up so that the illumination means 2*b* is out of the water and visible from 360° degrees. If the victim enters the water face down or is rolled over onto their face by a wave, the long arm of the device swings out approximately 90° degrees moving the ballast to its optimal position of approximately 90° degrees to the victim's axis of rotation. In this position, the ballast is maximally effective at applying torque to the victim and their PFD in order to rotate their face out of the water. As the long arm of the ballasted end of the device approaches 90° degrees the short buoyant arm is simultaneously moved medially where the impact of the buoyancy is reduced to its minimum in terms of opposing active self rescue. The short buoyant arm of the combined ballast and signaling device preferably acts as a 90° degree stop arresting the swing from perpendicular to horizontal relative to the ventral face of the PFD. In the stop position, the short buoyant arm of the device rests against the face of the PFD.

Figure 38:
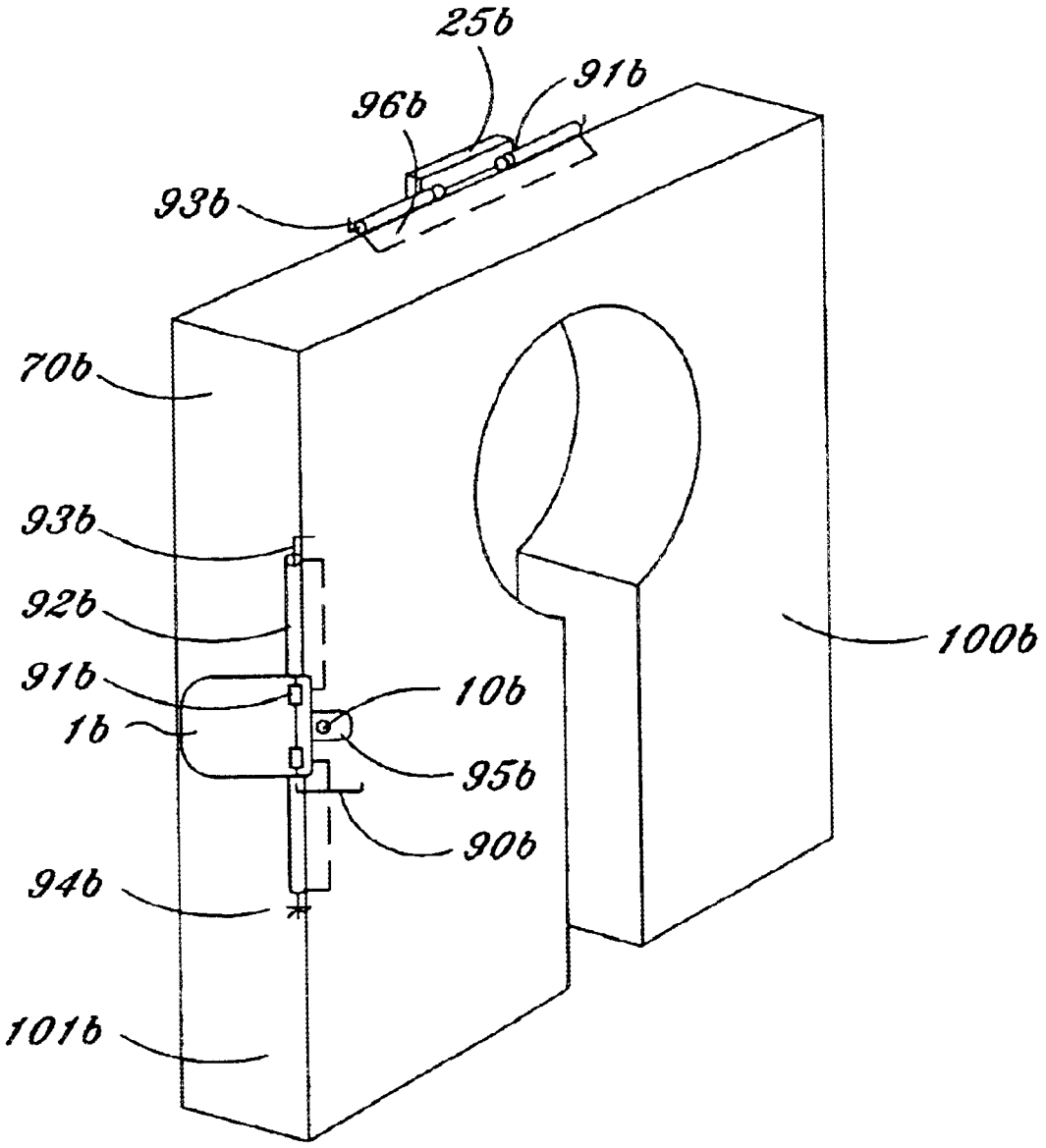
FIG. 38 is an enlarged anterio-lateral view of a yoke collar style PFD illustrating secure, rigidifying standardized integrated mounting means of combined ballast and appliance.
Figure 39:
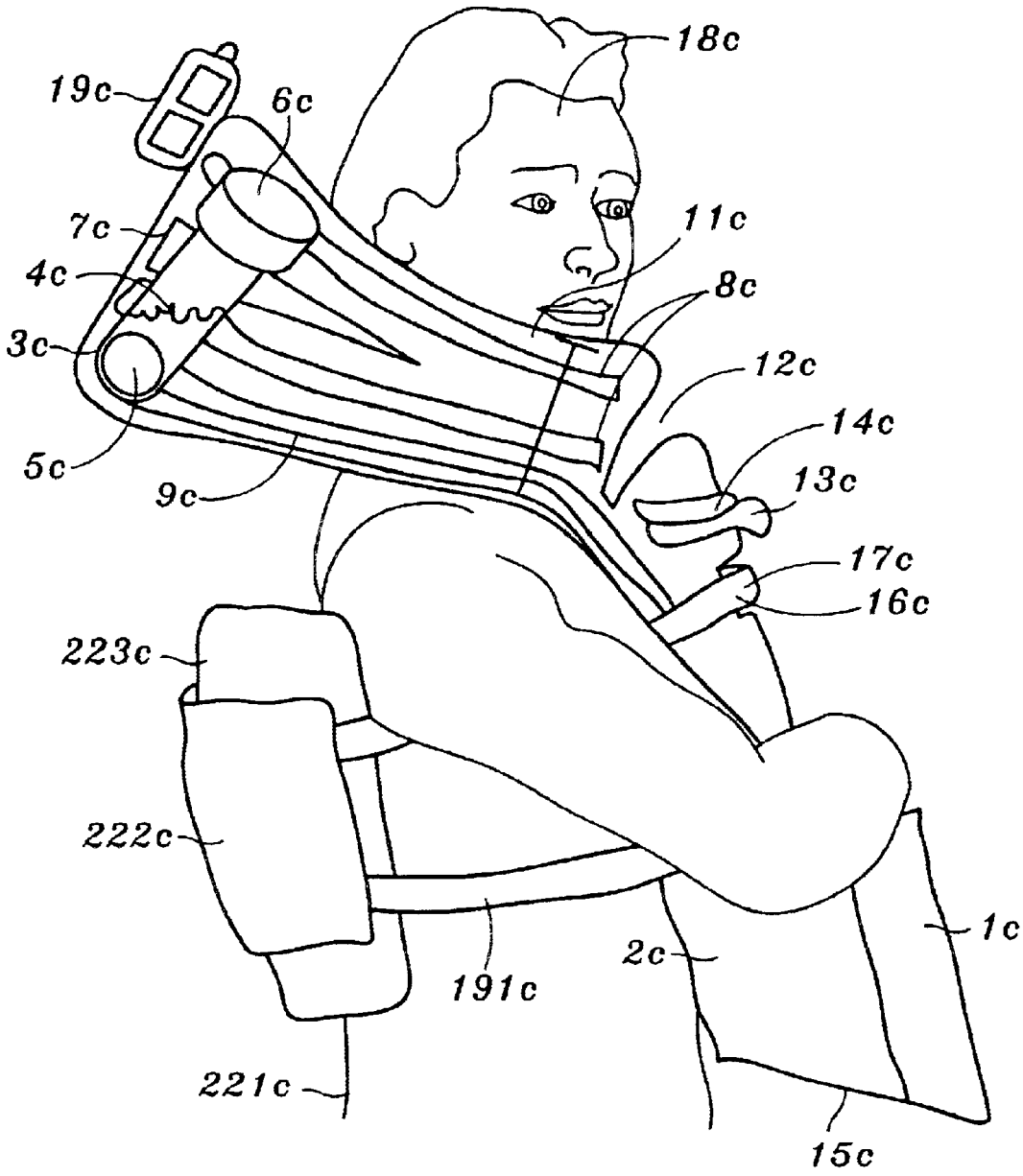
FIG. 39 is a right lateral view of an interior structure for a vertically eccentric Life Jacket in accordance with the present invention.
Figure 40:
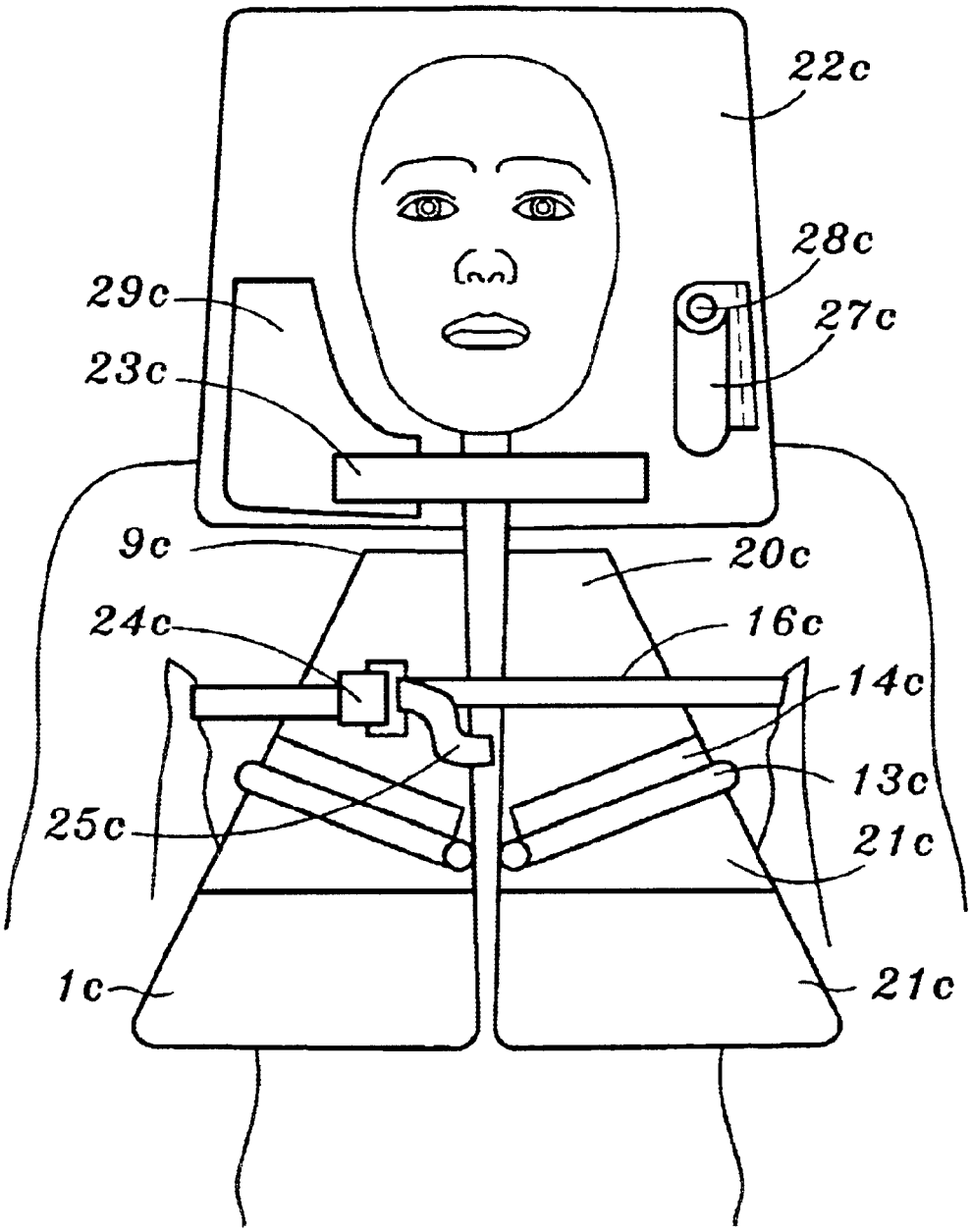
FIG. 40 is a frontal view of the bell-bottom ventral buoyant means of the vertically eccentric life jacket.
Figure 41:
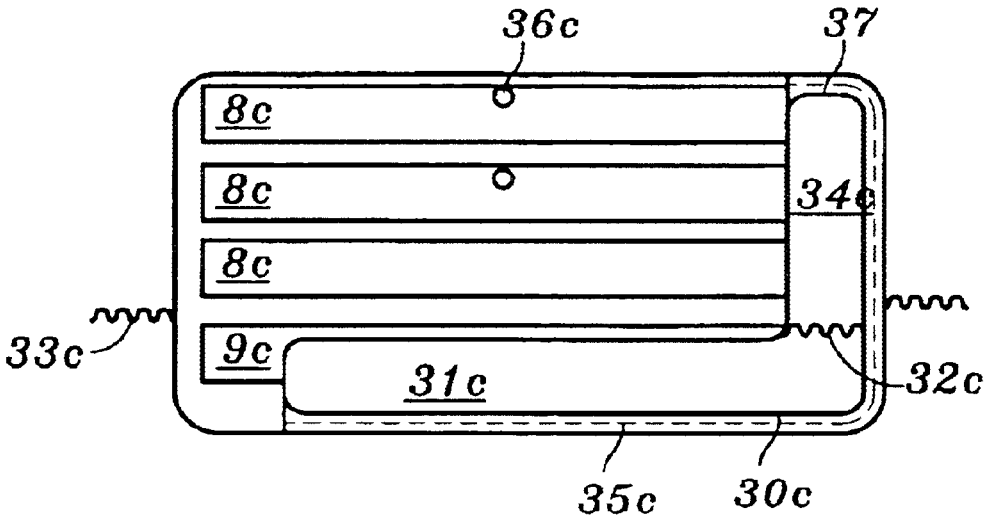
FIG. 41 is a superior view of the position of the gas liquid container within the posterior cervical layers of the adjustable collar.
Figure 42:
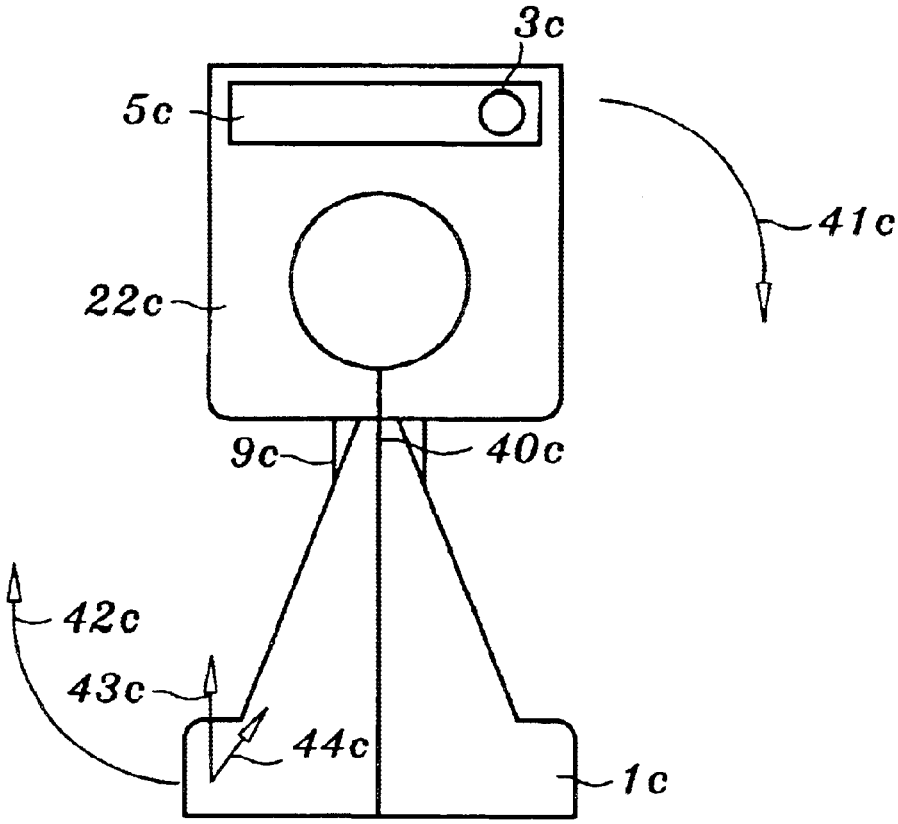
FIG. 42 is a frontal view of the vector analysis of the combined effects of contained mobile eccentric ballast and inverted ventral buoyant means.

FIG. 38 also illustrates a secure and simple mounting means for a combined ballast and appliance. Preferably, a sewable plastic piping 92*b* is integrated into the seam of the PFD spaced to accommodate the appliance's hinge means 91*b*. The section of tubing can be die cut to be removed leaving the sewable flange so that the space for the appliance can be consistently close for optimal support yet sufficient to allow easy assembly. Hinge pin 93*b* serves multiple functions; it secures combined ballast and signaling device 1*b* through the sleeve means integrated into the PFD 92*b* in a secure but preferably releasable manner. It rigidifies the cervical-ventral joint. The placement of multiple sewn in sleeves 92*b* which contain their hinge pin 93*b*, with or without a combined ballast and appliance device, can supply rigidification of the cervical-ventral joint complementing PFD turning due to ballast(s) at other locations. Furthermore, when sleeve means 92*b* is sewn onto the oversized foam layer 63*b* it further advances the transfer of the positional energy of the ballast into rotation of the PFD/victim reducing the amount of ballast required for reliable active self rescue.

PFD with Attached Combined Ballast and Signaling Parts List (FIGS. 20 through 38)

1*b* Combined ballast and signaling means
2*b* Continuous or stroboscopic illuminating means
3*b* Wearer operable appliance switch
4*b* Elongated battery containment means
5*b* Locking attachment means for securing ballasted signaling device
6*b* PFD wearer
7*b* Yoke Collar Style PFD
8*b* Cervical Side Joint stiffener
9*b* Cervical joint strap and stiffener for non-ballasted side
10*b* Light source
11*b* Additional ballasting batteries
12*b* Thickened high-density wall of container
13*b* Variably Sized High density plug
14*b* High density water excluding packing medium
15*b* O-Ring sealed threaded connector
16*b* Secure attachment means
17*b* O-Ring Sealed Switch
20*b* Vest Style PFD
21*b* Mobile ballast battery container means
22*b* Single attachment point
23*b* Conductive cable connecting ballasting batteries to appliance
24*b* Additional parallel ballasting batteries
25*b* Signaling Device
30*b* Cephalic Cradle portion of second buoyant means
31*b* Dual securing straps for cephalo-cervical buoyant cradle
32*b* Cervical cradle portion of second buoyant means
33*b* Cephalo-Cervical Cradle
34*b* Asymmetric ventral buoyant means
35*b* Dual securing means for ventral buoyant means
36*b* Thermal protective inner liner for two part PFD
37*b* Dual arm mobile ballast battery means

38*b* Ballasting battery units
39*b* Right arm attachment point
40*b* Appliance
41*b* Crotch strap
42*b* Secure Fastener Means
50*b* Existing foam components for Yoke Collar Style PFD
51*b* Cervical foam component of a traditional Yoke Collar Style PFD
52*b* Ventral foam component of Yoke Collar Style PFD
53*b* Alternate configuration for foam layer showing Single Posterior-Cervical Joint
54*b* Alternate foam layer configuration showing two piece layer with Single Side Cervical Joint
55*b* Alternate Single Piece layer combining cervical and ventral components
56*b* Over sized single piece base foam layer
57*b* Regular sized single piece foam layer
60*b* Combined Internal Ballast Component and lateral Stiffener
61*b* Ventral Coated Fabric Cover
62*b* Dorsal Coated Fabric Cover
63*b* Binding Tape
64*b* Combined Ballast and Appliance Fastener means
65*b* Anterior Stiffener
70*b* Amplified Cervical Displacement means
71*b* Relatively reduced ventral displacement means
72*b* Ballast attachment side, PFD Foam Layer Compressing chest strap
73*b* Alternate side PFD Foam Layer Compressing chest strap
74*b* Chest strap retainer guide
80*b* Rigid Swing Arm of mobile ballast
81*b* 90° degree Range of Motion Stop
82*b* Internal Ballast Plate
83*b* Tubular liner guide
84*b* Ballast Attachment cover
85*b* Locking Attachment means for mobile swing ballast and lever arm
86*b* Quick Release attachment means for ballast
87*b* Ballast means
88*b* Inner Locking Jaw
90*b* Buoyant arm of device
91*b* Hinge Pivot means of appliance
92*b* Sleeve means integrated into PFD
93*b* Hinge pin means
94*b* Hinge pin retainer means
95*b* Reduced Volume Buoyant Arm
96*b* Die cut sewable plastic sleeve means
100*b* Enhanced non-ballasted ventral component
101*b* Relatively diminished ballasted ventral component Some of the advantages achieved with and/or features of one or more of the embodiments illustrated in FIGS. 72 through 81 include the following: (1) Combined Rotational and Functional Ballast attached to Life Jacket; (2) Ballast that is comprised in total or part by power supply means; (3) Ballast that is comprised in total or part by signaling, illumination or appliance means; (4) Ballast that is comprised in total or in part by containment means; (5) Ballast that is comprised in total or in part by high density component to offset buoyant functional components; (6) Ballast that is comprised in total or in part by neutral or negative packing fluid/gel; (7) Ballast that is comprised in total or in part by high density stiffener/attachment means complementing functional ballast means; (8) Fixed midline functional ballast/power supply/appliance; (9) Fixed eccentric functional ballast/power supply/appliance; (10) Mobile midline functional ballast/power supply/appliance; (11) Mobile eccentric functional ballast/power supply/appliance; (12) Dual Arm Mobile functional ballast/power supply/appliance; (13) Ballast power supply connected to remote appliance; (14) Attached buoyant device eccentric; (15) Attached buoyant device midline; (16) Eccentric shaped midline buoyant means; (17) Independent cephalo-cervical buoyant cradle means; (18) Buoyant thermally protective inner shell of PFD; (19) Rigid arm attachment means for mobile eccentric functional ballast/power supply/appliance; (20) Interchangeable variable rigid arm length of attachment means for mobile eccentric functional ballast/power supply/appliance; (21) Flexible arm attachment means for mobile eccentric functional ballast/power supply/appliance; (22) Neutrally buoyant ballast and foam means attached at opposite sides to PFD; (23) Placement of ballast offsetting foam in ventral leg opposite of site of ballast attachment; (24) Reduced single sided lateral cervical joints, through foam layer design(selection, construction); (25) Reduced bilateral cervical joints, through foam layer design; (26) Eliminates single sided lateral cervical joints, through foam layer design; (27) Eliminates bilateral cervical joints, through foam layer design; (28) Oversized foam base layer sewn into fabric shell of life jacket; (29) Oversized foam top layer sewn into fabric shell of life jacket; (30) Alternating incomplete foam layers increasing cervical displacement relative to ventral displacement; (31) Alternating incomplete foam layers increasing the buoyant lateral ventral displacement relative to the opposite ballasted ventral side; (32) Alternating incomplete foam layers increasing both cervical displacement means relative to ventral and increasing the buoyant lateral ventral displacement relative to the opposite ballasted ventral side; (33) PFD of solid foam construction with eccentric displacement means; (34) PFD of solid foam construction with left right ventral components of unequal displacement means; (35) PFD of solid foam construction with cervical and ventral components of unequal thickness of displacement means; (36) PFD of solid foam construction with eccentric displacement means where side with attachment means for ballast or combined ballast and appliance device is reduced relative to the opposite ventral means; (37) PFD of solid foam construction with eccentric displacement means where side with attachment means for ballast or combined ballast and appliance device is reduced relative to width and or thickness and or length of the opposite ventral means; (38) PFD of solid foam construction with eccentric displacement means where side with attachment means for ballast or combined ballast and appliance device is reduced relative to wedge shaped opposite ventral buoyant means; (39) Ballast sided foam layer compressing strap means; (40) Bilateral foam layer compressing strap means; (41) Rigid swing arm with stop; (42) Rigid swing arm supported by tubular hinge; (43) Rigid swing arm with attached ballast component; (44) Fabric encased ballast plate; (45) Tubular fabric webbing encased ballast plate/framework; (46) Dual eye ballast attachment points for attaching ballasted signal device; (47) Stiffener attached to swing arm hinge; (48) Rigid swing arm with stop attached to inherent buoyant means; (49) Wearer operable ballasting appliance attached to rigid swing arm with stop; (50) Water activated ballasting appliance attached to rigid swing arm with stop; (51) Appliance housing with Horizontal mounting means; (52) Appliance housing with Horizontal mounting means paralleling illumination means; (53) Appliance housing with Horizontal mounting means paralleling signaling means; (54) Appliance housing with Horizontal mounting means paralleling appliance means; (55) Mounting means of Ballasted signaling device separating housing into buoyant and ballasting sections; (56) Mounting means of Ballasted signaling device separating housing into short buoyant and long ballasting sections; (57) Container means of combined ballast and signaling device with reduced buoyant illumination component of short buoyant arm that stops against the anterior face of PFD; (58) Container means of combined ballast and signaling device with enhanced ballast at extreme end of long ballast arm that stops at the greatest distance from the PFD axis of rotation; (59) Pivot means dividing combined ballast and signaling device into buoyant anterior stop arm and ballasted rigid posterior swing arm; (60) Dual position ballasted signaling device, ballast lateral in prone position; (61) Dual position ballasted signaling device, ballast medial in supine position; (62) Buoyant signaling means forward of pivot means; (63) Buoyant signaling means forward of pivot means adapted to lie parallel to anterior face of PFD in active position; (64) Buoyant signaling means forward of pivot means adapted to extend perpendicular to PFD in face up position and lie along anterior face of PFD in ballast active face down position; (65) Dedicated ballast and Power located ballast posterior of pivot means; (66) Sewable plastic sleeve hinge component means; (67) Die cut sewable single piece hinge component; (68) PFD with integrated hinge means; (69) PFD with plastic sewn in hinge means; (70) PFD with multiple standardized hinge components; (71) PFD with ventral cervical hinge component with hinge pin; (72) PFD with ventral cervical hinge component with rigid hinge pin; (73) PFD with ventral cervical hinge component with semi-rigid hinge pin; (74) PFD with ventral cervical hinge component with hinge pin with combined ballast and appliance device; (75) Illumination or appliance strap means that splints one or both lateral cervical joints; (76) Stiffener means externally applied that splints one or both lateral cervical joints; (77) Stiffener means integrated during construction that splints one or both lateral cervical joints; (78) Attachment means stiffener on both lateral and anterior sides; (79) Lateral attachment means stiffener constructed of high density material; (80) Anterior attachment means stiffener constructed of low density material; and (81) Non Inflatable PFD constructed of coated fabric.

FIGS. 39 through 65 illustrate further embodiments for ballast personal flotation devices and related accessories.

Figure 54:
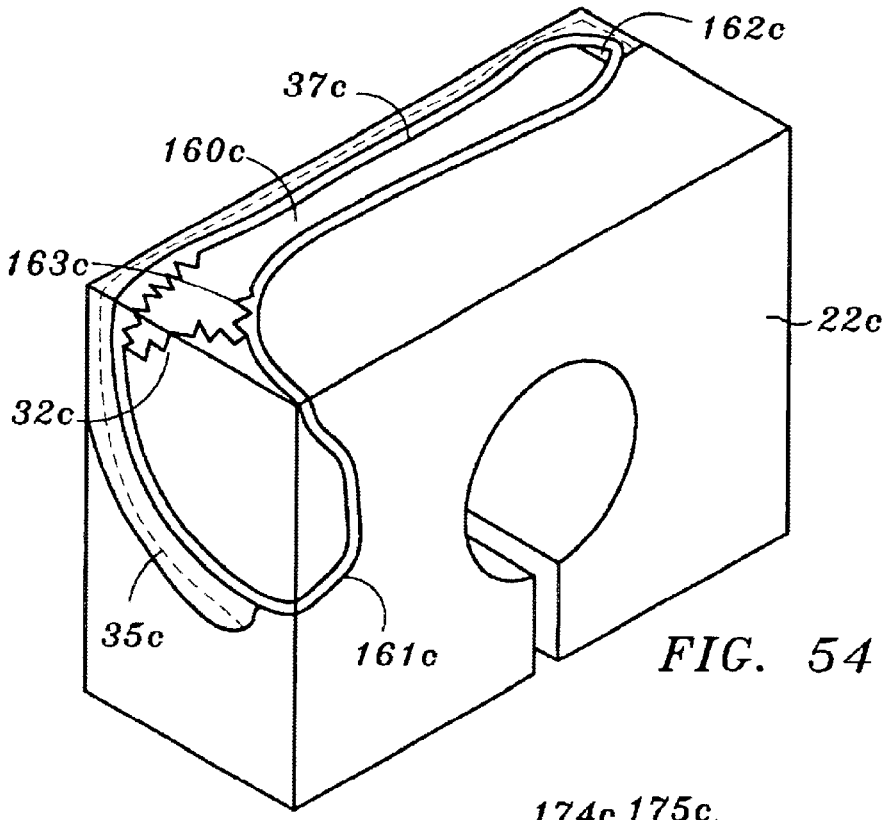
FIG. 54 is a superior three quarter view illustrating conformation of the inner welded container for a mobile liquid ballast to outer fabric tube cover directing shifts in ballast location within the adjustable cervical collar.
Figure 55:
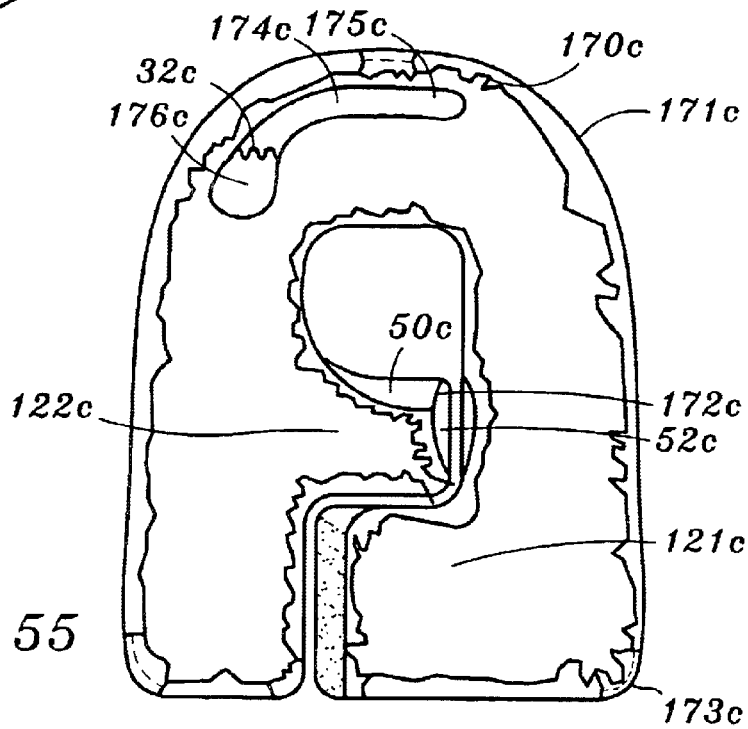
FIG. 55 is an anterior view illustrating the use of fabric outer shell to shape an over sized inner air retentive bladder. The sewn fabric shell allows the creation of shapes not easily accomplished by single walled inflatable jackets. In this particular application allows the creation of an effective cervical lock preventing the head from sliding down between the ventral buoyant arms on face first entry into the water.

The anterior buoyant means 1*c* and the ventral inferior buoyant means 2*c* shifts the PFD center of buoyant down and anyway from the axis of rotation of the victim. This supplies the raw torque required to roll a flaccid diver. The anterior and lateral buoyant means has vectors that are not in line with the any structural members of the PFD, consequently the buoyant force of the anterior member rises straight up but through its attachment to the PFD and victim rocks the victim back. At the same time the posterior and superior positioning of the directed mobile ballast 3*c* shifts the center of gravity up and back. Under the force of gravity the ballast means pulls the victim back. This diametric positioning of the centers of gravity and centers of buoyancy creates a new corrective turning action heretofore unassessed during the testing and approval process. By moving the ballast and buoyant forces a greater distance from the axis of rotation you optimize the torque generated per unit mass or displacement. For a jacket of the same amount of displacement the foam means can be relocated into a triangular bell bottom shape, see FIG. 40. From the frontal view the lateral extensions can be visualized as diagrammatically outlined in FIG. 42. At the lateral edge of the anterior buoyant means the vertical arm 43*c* of the buoyant force is unopposed and attempts to rise. The kinetic energy pivots about point 40*c* converting into a circular motion 42*c*. This is synergistically complemented by the solid ballast moving within the container 3*c* creating rotary motion 41*c* also about pivot point 40*c*. The ballast moment either fluid 31*c*, fluid 31*c* and solid 5*c*, or just solid, the fluid level 4*c* can interface with either a gas such as air or a collapsed space such as 34*c*. As the victim falls face first into the water the fluid 31*c* ballast relocates under the influence of gravity from the posterior position into an eccentric outboard lateral anterior position where it shifts the center of gravity 41*c*, freeing the ventral buoyant means to complete the corrective turning action. The fabric container can be either single wall as in 51*c* or double wall as in 161*c*. In FIG. 54, the double wall construction with inner bladder 160*c* and outer fabric layer 161*c* allows the shifting fluid ballast 31*c* to be more accurately shaped and directed. The fluid ballast easily traverses surface irregularities 163*c* and allows rapid smooth transition from inactive to active. Notably, where the fluid is water based, it converts from a source of ballast when held aloft in the air behind the victim's head, to become neutral as the victim rolls from face down to face up.

Figure 48:
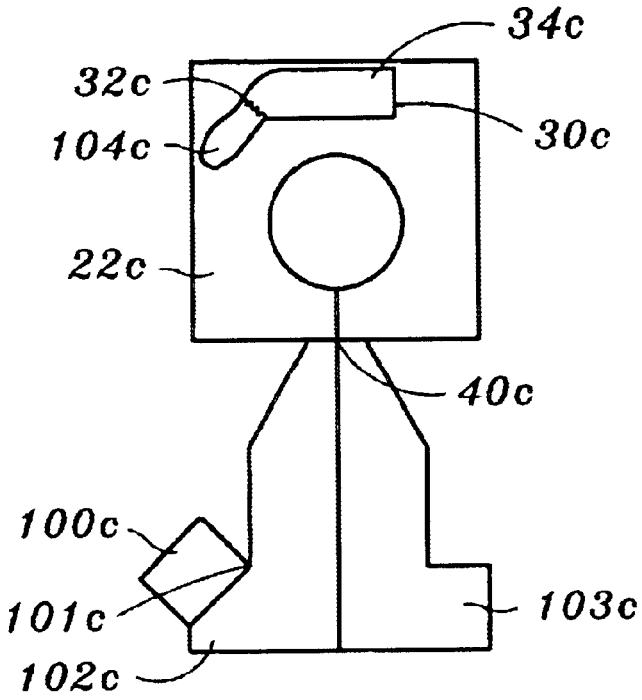
FIG. 48 is an anterior view illustrating the mobile eccentric buoyant means attached via flexible arm.
Figure 49:
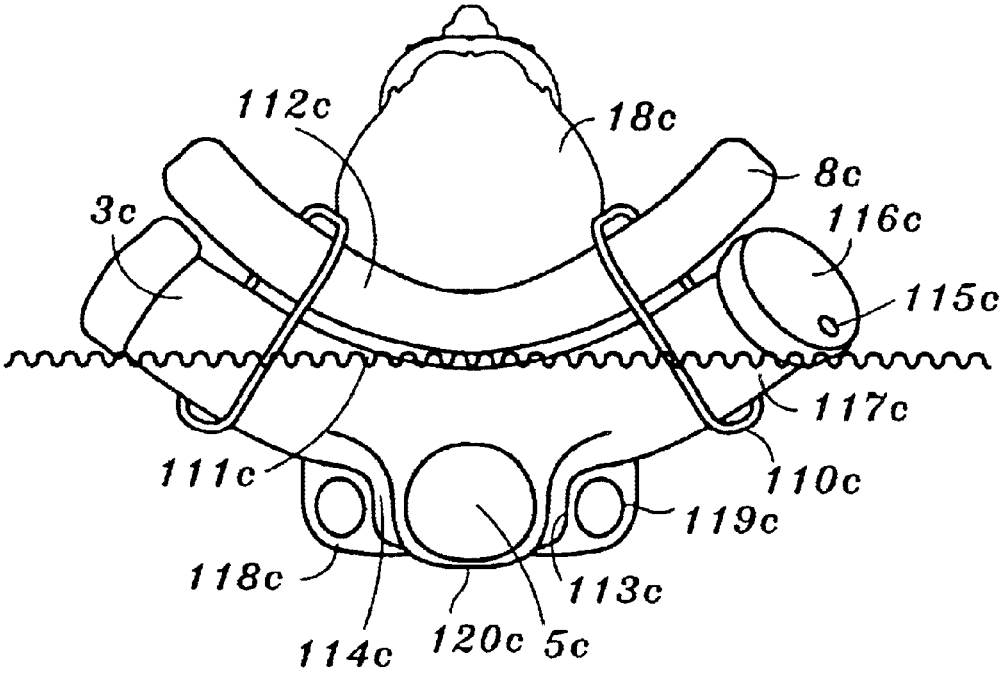
FIG. 49 is a superior view illustrating a rigid container combining fluid and solid ballast shaping the foam into a convexity cradling the head.
Figure 50:
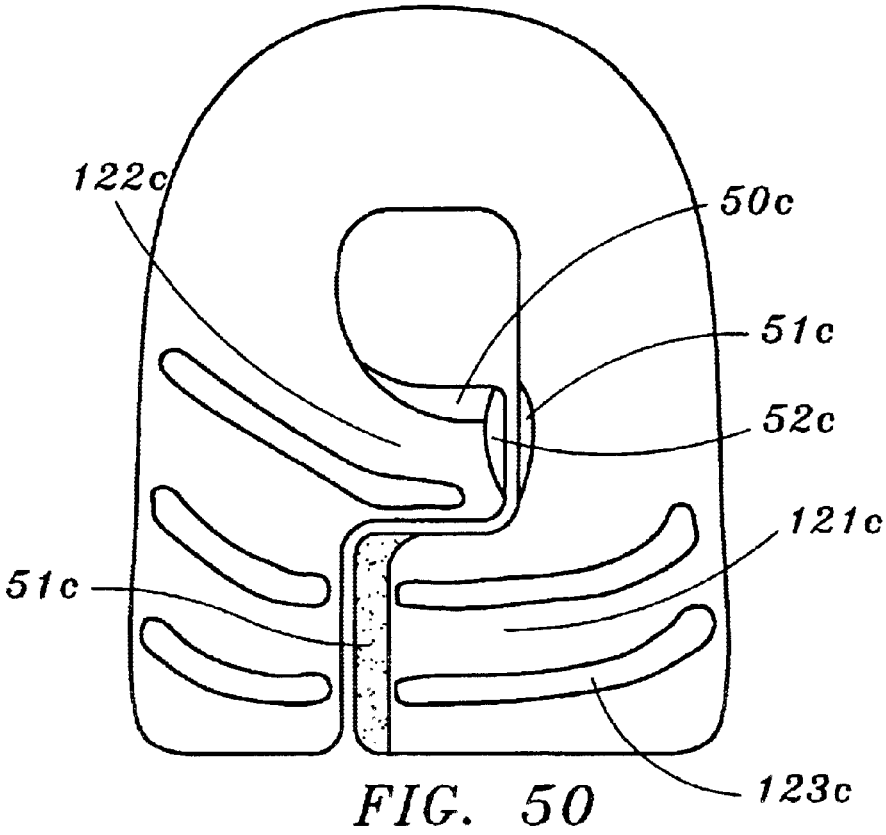
FIG. 50 is an anterior view illustrating an inflatable PFD or diver's jacket incorporating an overlapping inflatable lock and demonstrating oral nasal splash guards.
Figure 51:
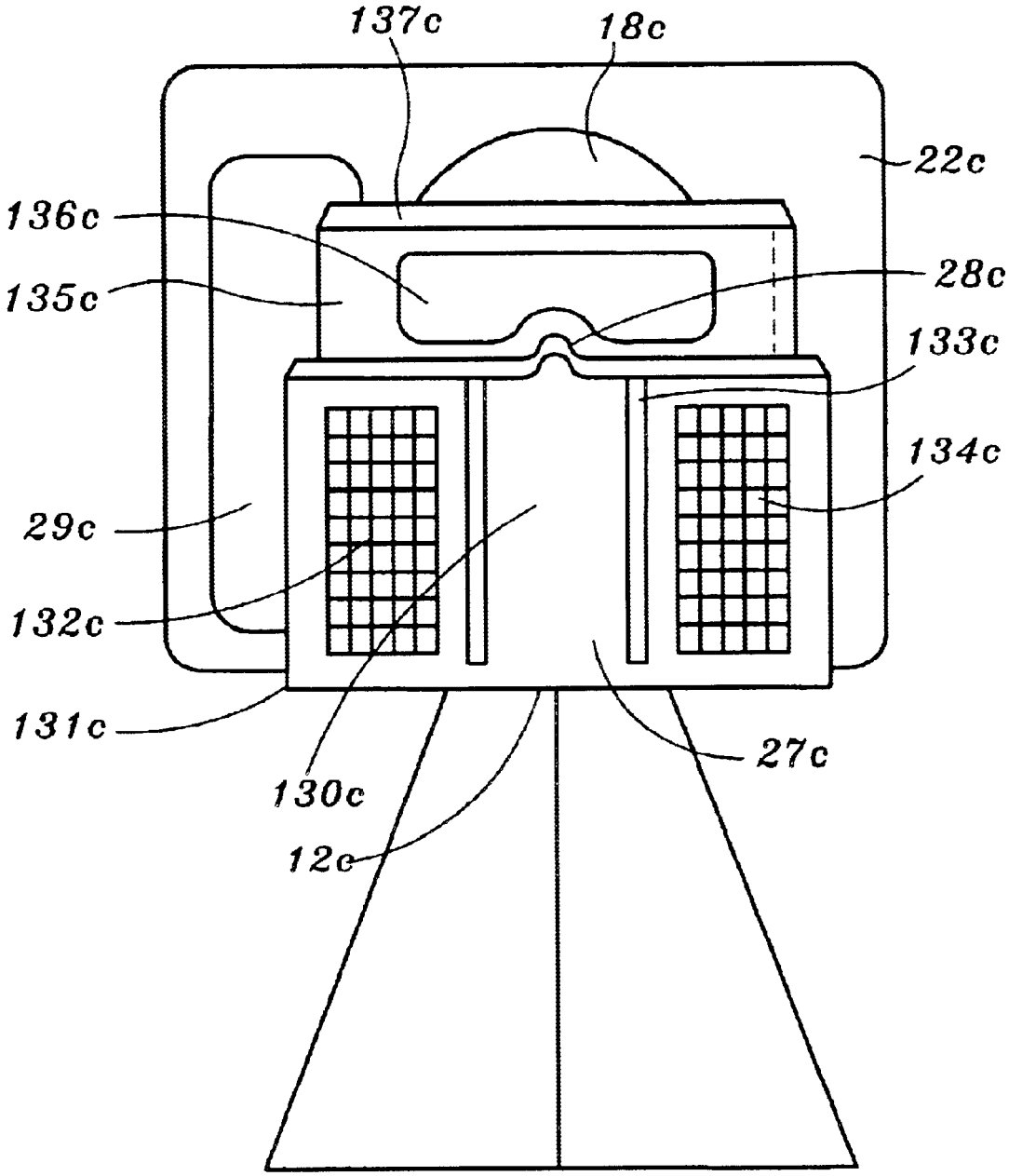
FIG. 51 is a superior view of the contained mobile eccentric ballast and fixed midline ballast elements conforming variably sized cervical foam collar.
Figure 52:
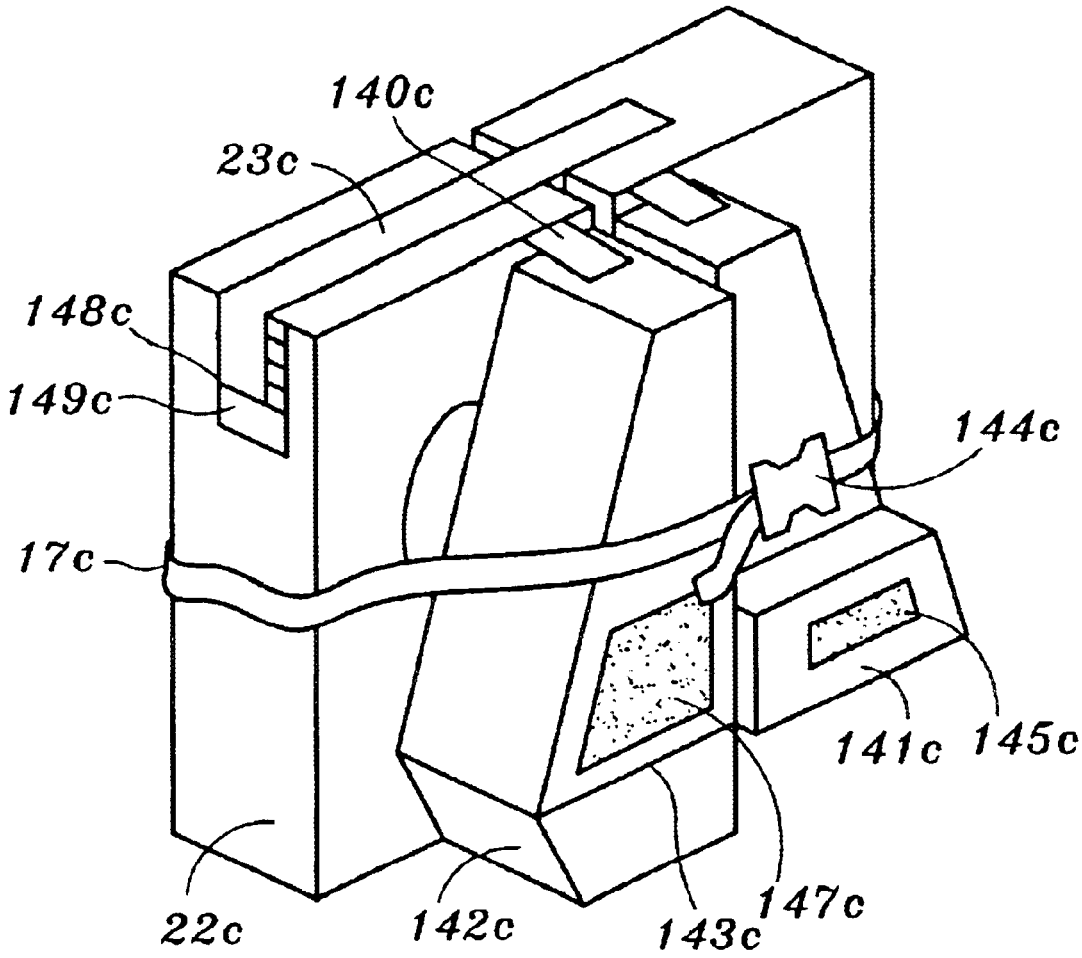
FIG. 52 is a superior three quarter view illustrating a folding PFD with dual position inferior stored and anterior active buoyant member.
Figure 53:
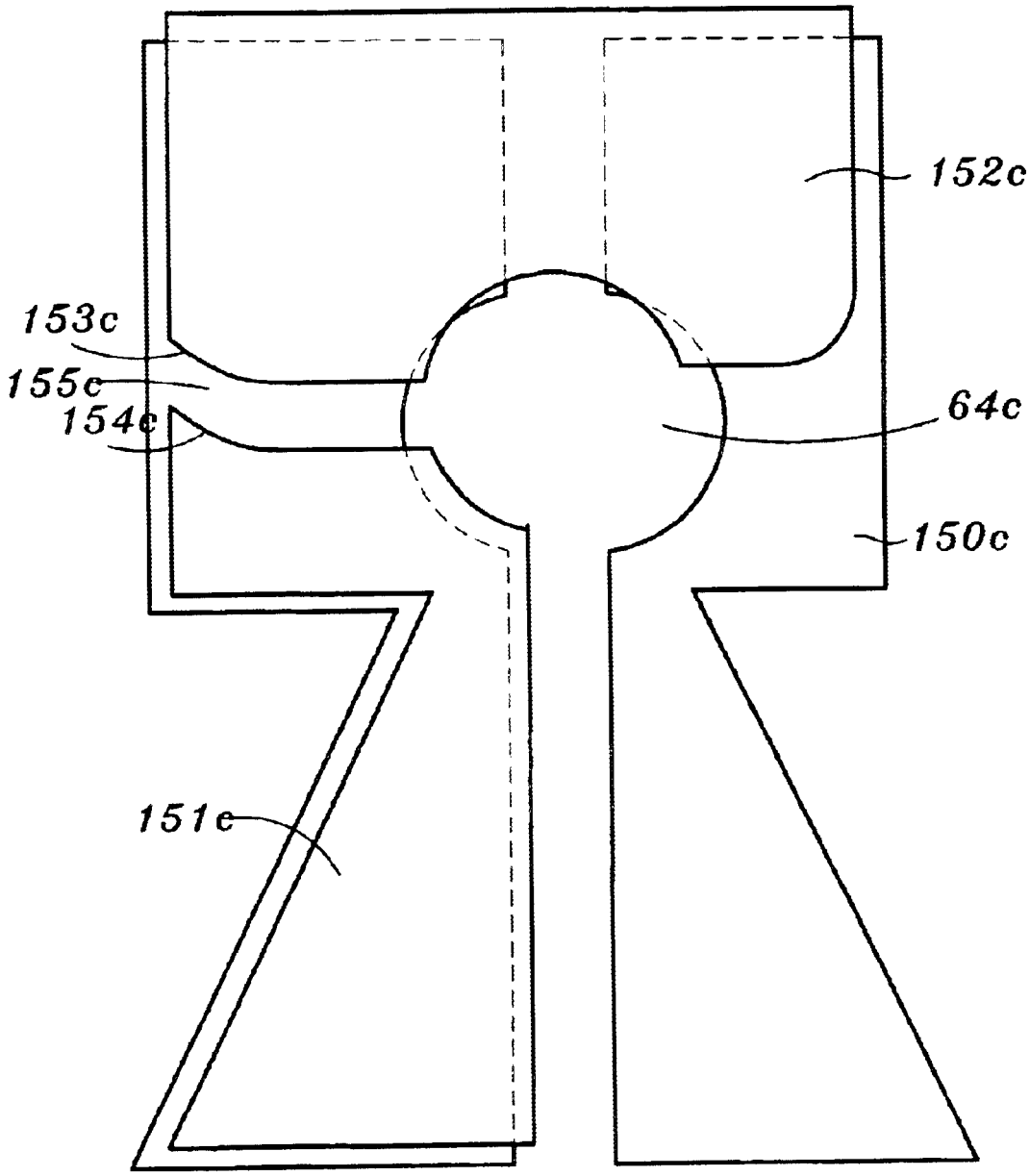
FIG. 53 is an anterior view illustrating an alternative adjustable collar that maintains the continuous base layer and allows for rotation of the ventral arms to for entry and adjusting the diameter of the neck opening to the wearer.
Figure 57:
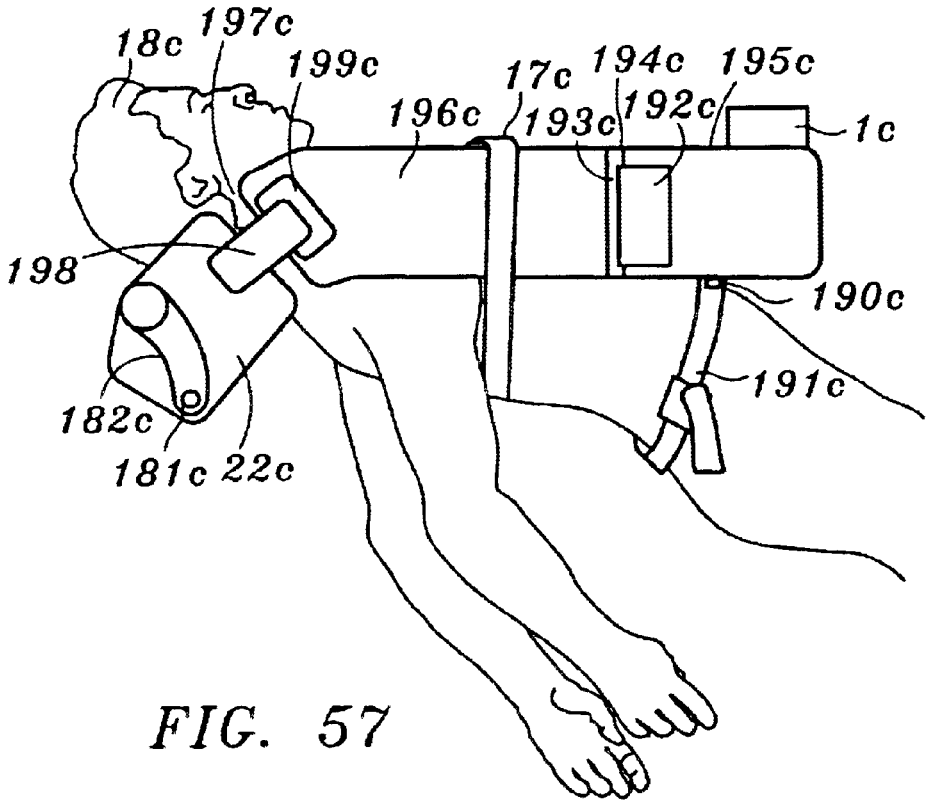
FIG. 57 is a lateral view illustrating the use of an inferior chest strap to retain but not restrict the motion of the lower mobile buoyant member. Rigid apical interface allows lower resistance to rotation of the apex of the lower unit about the upper ventral buoyant member. Lateral neck opening decreases chance of the neck moving forward and shifting the center of gravity into a face down position.

In FIG. 48 mobile buoyancy 100*c* turns about pivot point 101*c* shifting the center of buoyancy resulting in an imbalance contributing to the rotary motion 42*c*. In FIG. 57 the apex of inferior triangular buoyant member can be capped by a harder material 192*c* that pivots upon a stiff plate 193*c*. The fabric shell 195*c* forms a hinge 194*c* connecting the mobile inferior buoyant means with the shortened main ventral buoyant means 196*c*. The mobility of the inferior buoyant means is enhanced by an inferior chest strap 191*c* that is attached at both sides by arm piece 190*c*. While the strap 191*c* can be tightened about the victim 18*c*, the arm 190*c* leaves in a degree of mobility that allows the lateral components to shift to the left or right supplying the initiating moment without which turning does not occur. The upper ventral means 196*c* are held tight against the chest by overriding chest strap means 17*c*. The use of an adjustable collar with side entrance 197*c* prevents the head and neck from being driven between the ventral arms where it shifts the distribution of ballast creating a stable face down position.

Figure 43:
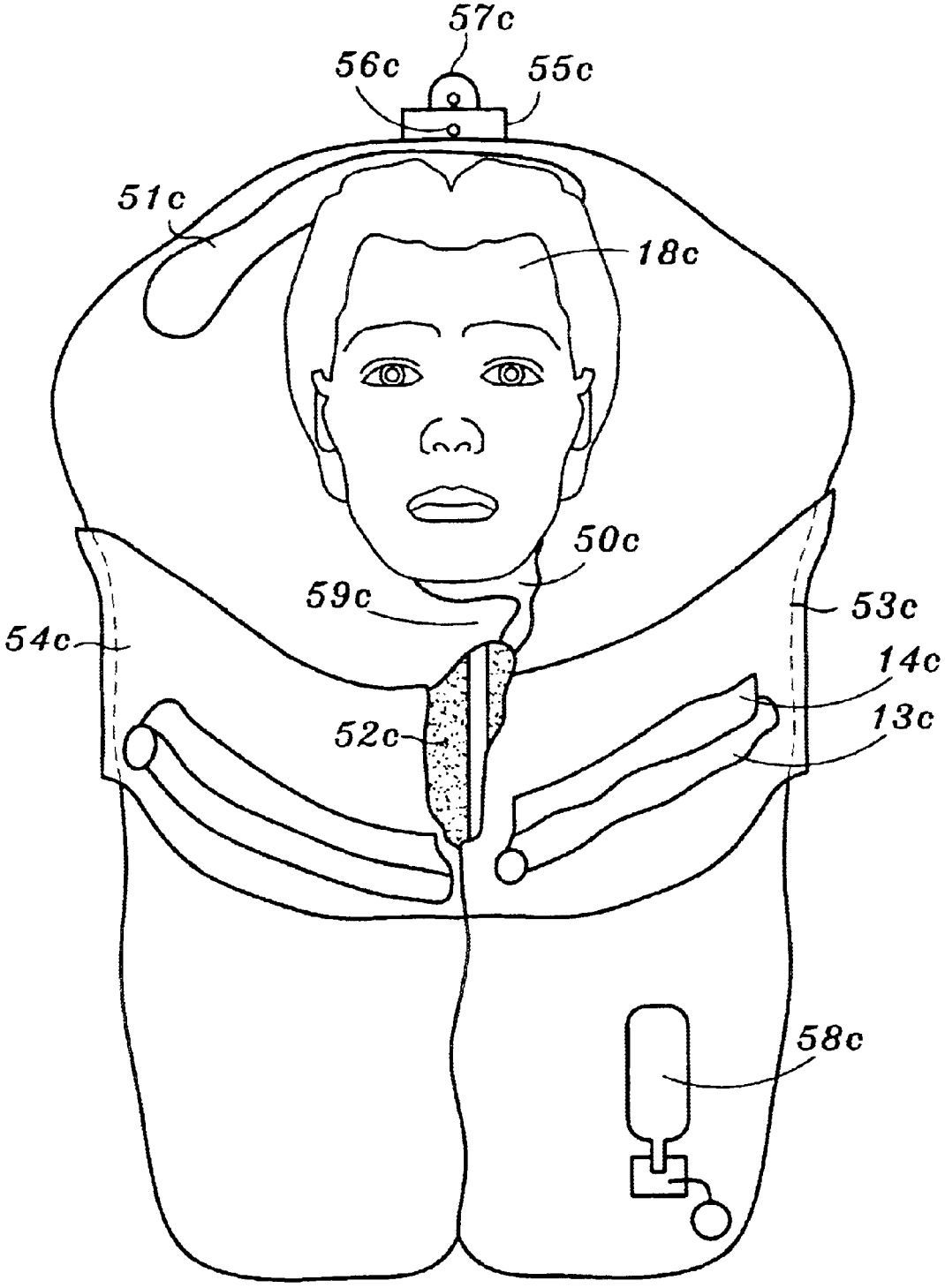
FIG. 43 is a frontal view of an inflatable PFD modified with mandibular shelf baffle and self locking pneumatically compressed vertical baffle closure means with oral nasal splash diverter system.
Figure 44:
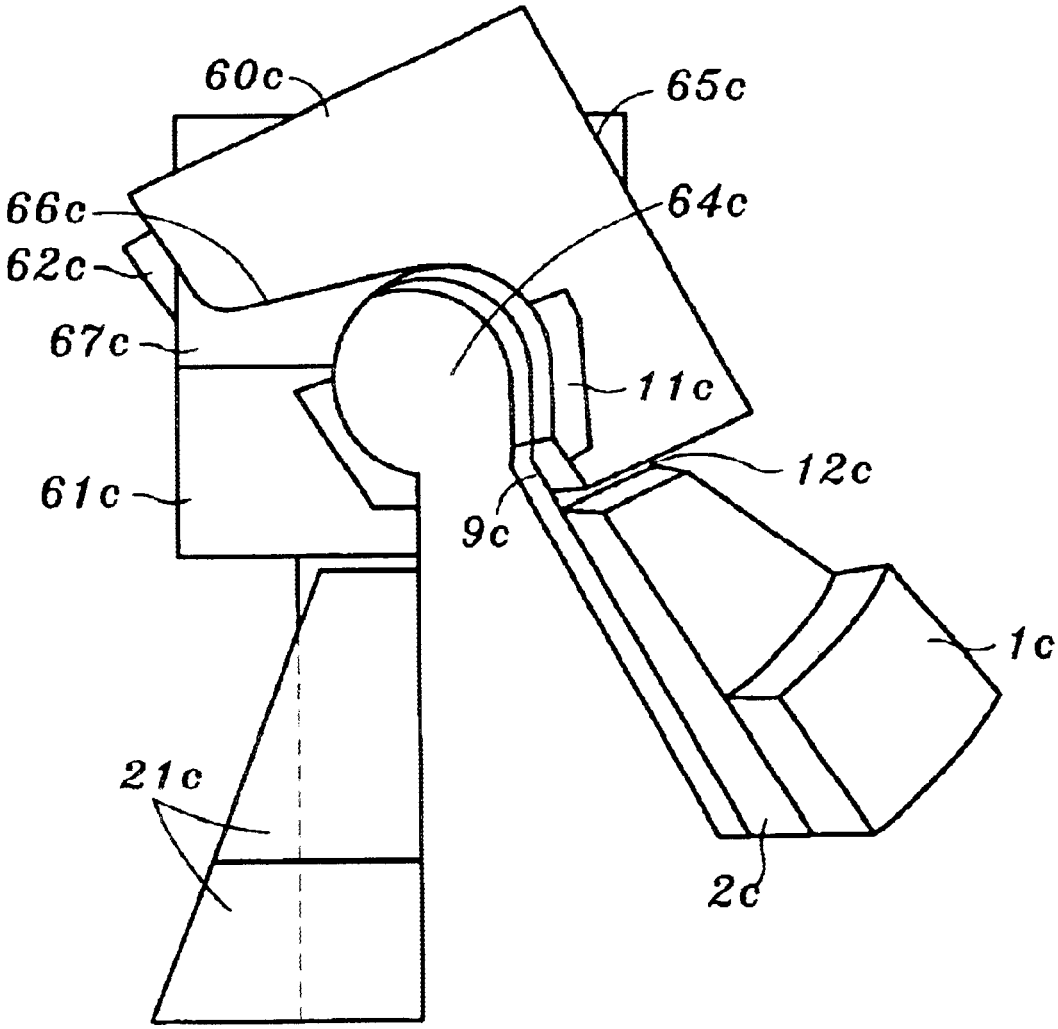
FIG. 44 is an anterio-lateral three quarter view of overlapping layers of adjustable cervical collar.
Figure 45:
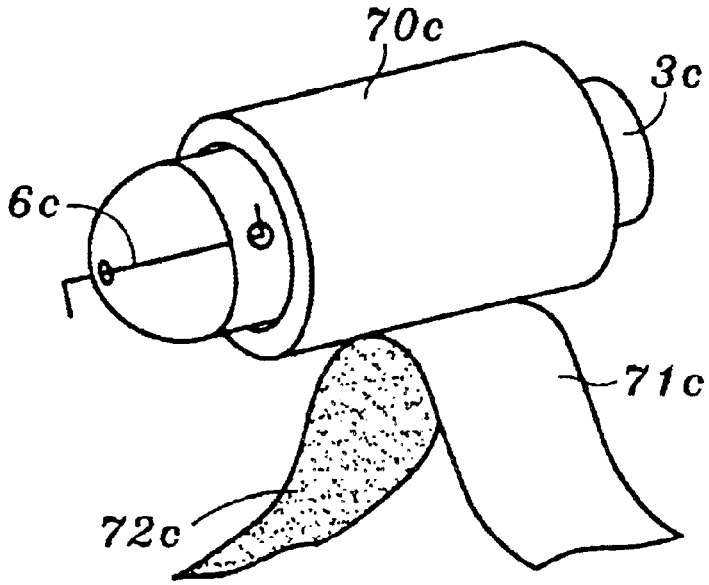
FIG. 45 is a superior view of a neutrally buoyant mobile solid and liquid ballast retrofit means.
Figure 46:
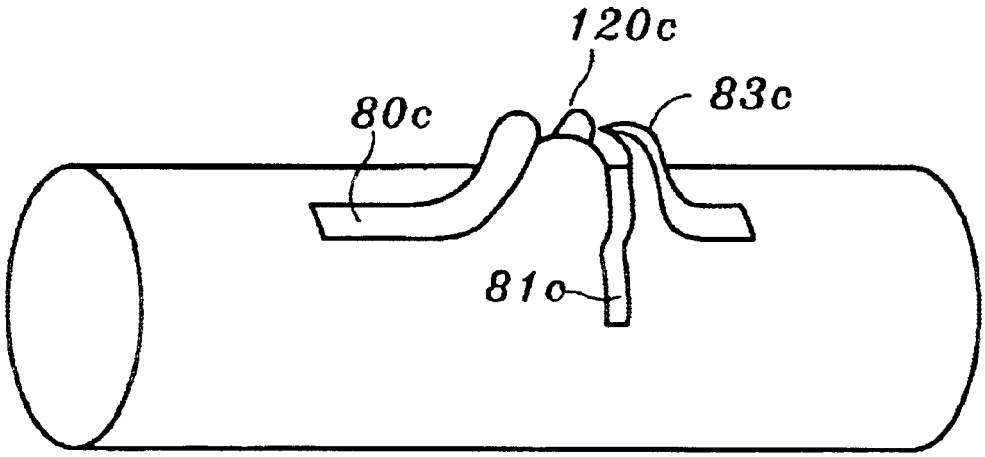
FIG. 46 is a superior view of a fabricated rigid container for mobile or mobile and liquid ballast means.
Figure 47:
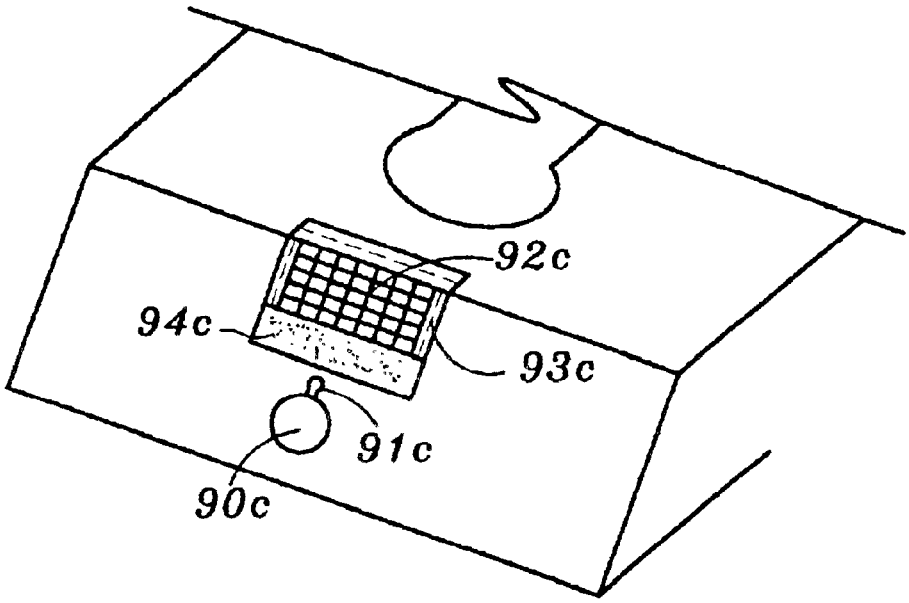
FIG. 47 is a superior exterior view of a PFD showing a vent means and mounting site for a combined ballast and battery means to reversibly replace fixed midline ballast means.

All current inflatable PFDs fail during face first entry because the ballast of the victim's head drives the neck between the ventral buoyant members into a stable airway submerged position. In FIG. 43 the inflatable PFD discloses overlapping tongue 59*c* that bridges the neck opening so that the neck cannot slide out of position. A superior baffle welded into the PFD also creates a mandibular shelf supporting the flaccid head and neck. Vertical baffles 52*c* covered by a fabric lock are compressed upon inflation further blocking the neck from sliding between the ventral arms on unconscious entry. With a double walled PFD shown in FIG. 55, the inner air bladder 170*c* is shaped by the sewn outer cover 171*c*. This construction method allows creation of very specific shapes and faces 172*c* for mounting fabric locks to automatically secure closure upon inflation. The pneumatic compression lock is a critical complement to the automatic inflation mechanism that actuates upon immersion. While mechanical ties are an alternative the pneumatic lock occurs without requiring any participation by the wearer. The inner bladder is held in place by perimeter attachment means 173*c*. The fluid ballast and fabric container 174*c* complements the soft storage of the inflatable PFD. The fabric container also allows very specific relocation of narrow diameter posterior container components 175*c* and upon active distribution the diameter increase consolidating the ballast 176*c* into a more active condensed mass. An alternative pneumatic fabric collar lock can be achieved by mounting the fabric lock on the external fabric cover. When the inflatable chamber opens upon detonation of the compressed gas cylinder, the bladder expands and rips open the outer cover. The hook and loop on complementary sides meets in the middle where continued expansion by the inner bladder compresses the lock together. The inflatable is promoted because of its convenient deflated profile, only fluid ballast in a fabric container can be transparently stored within the low profile cover.

Figure 56:
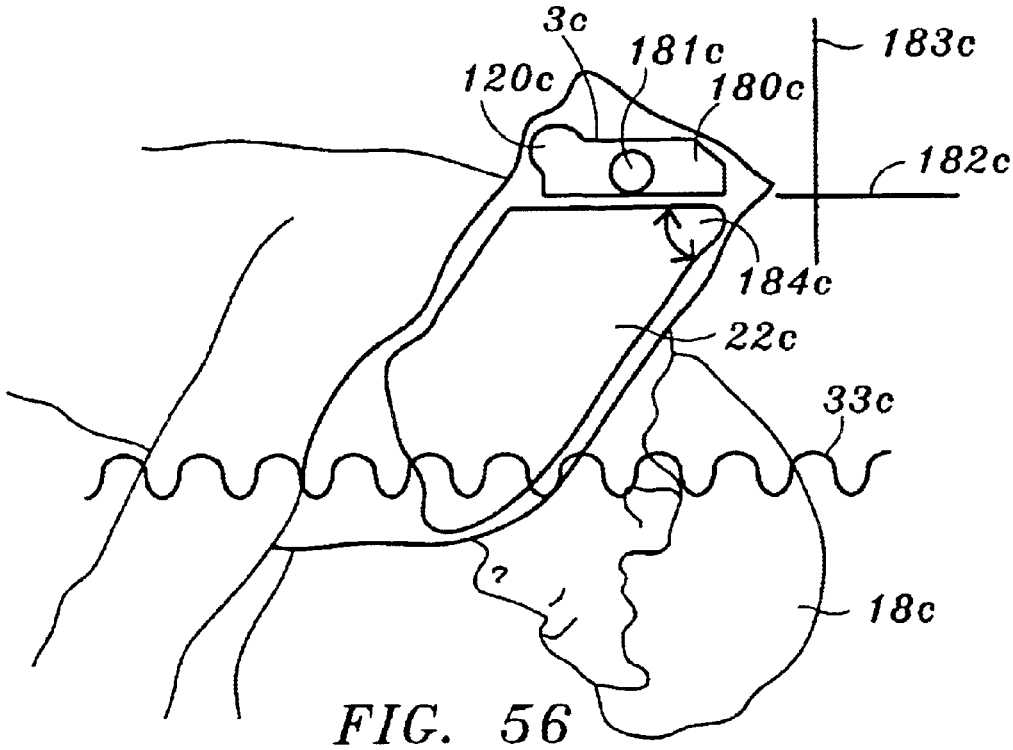
FIG. 56 is a lateral view illustrating the location of the mobile ballast container on a plane parallel with the water's surface. The cervical foam structure has a complementary angle specific to the particular PFD and the interaction of the displacement of the collar on a person in the water.

Some current inherently buoyant PFD designs require the concussive effect of solid mobile ballast. As seen in FIG. 56, the specific cervical collar angle determines the horizontal plane angle 184*c* when floating face down. The planar surface 180*c* of the ballast container 3*c* allows rigid ballast 181*c* to move quickly and freely in response to whatever lead is demonstrated by the victim. In the face up position mobile ballast trap 120*c* fixes the ballast midline where it stabilizes the victim as a keel.

Mobile ballasts either fluid 31*c* or solid 181*c* or combined benefits from concurrent fixed midline ballast 19*c*. Integration of mounting means 36*c* at the most beneficial posterior superior position assures that any attached ballast contribute to airway protection rather than opposing the jackets efforts at corrective turning action.

Figure 58:
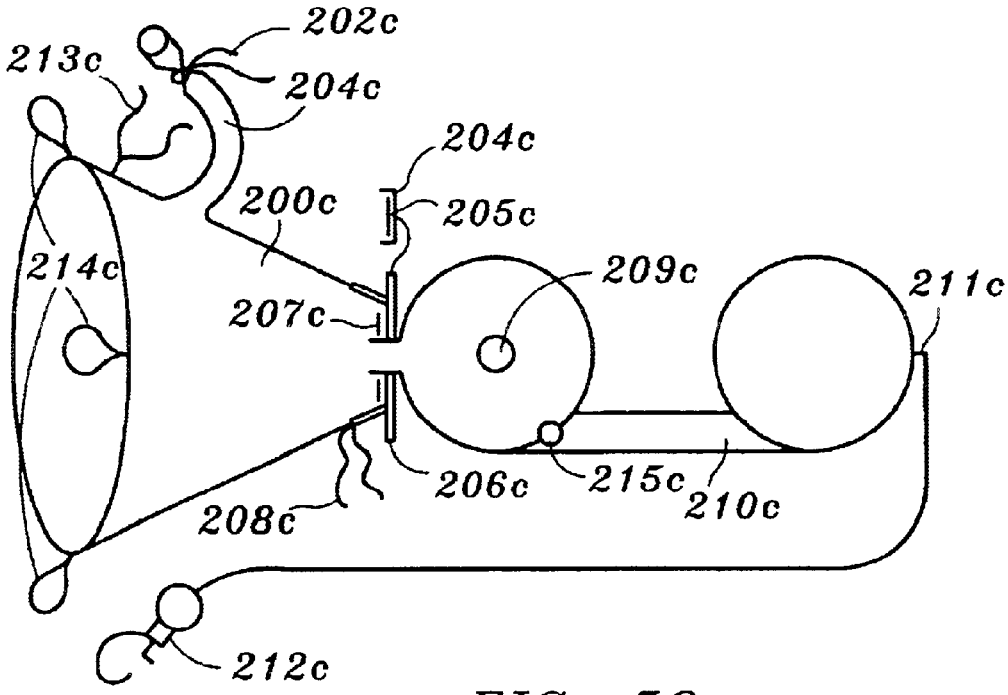
FIG. 58 is a lateral view of a life raft in accordance with the present invention illustrating a windsock inflation means releasably secured to life raft. Wrist and body lanyards keep the raft from blowing away during inflation before the sea anchor is filled.
Figure 59:
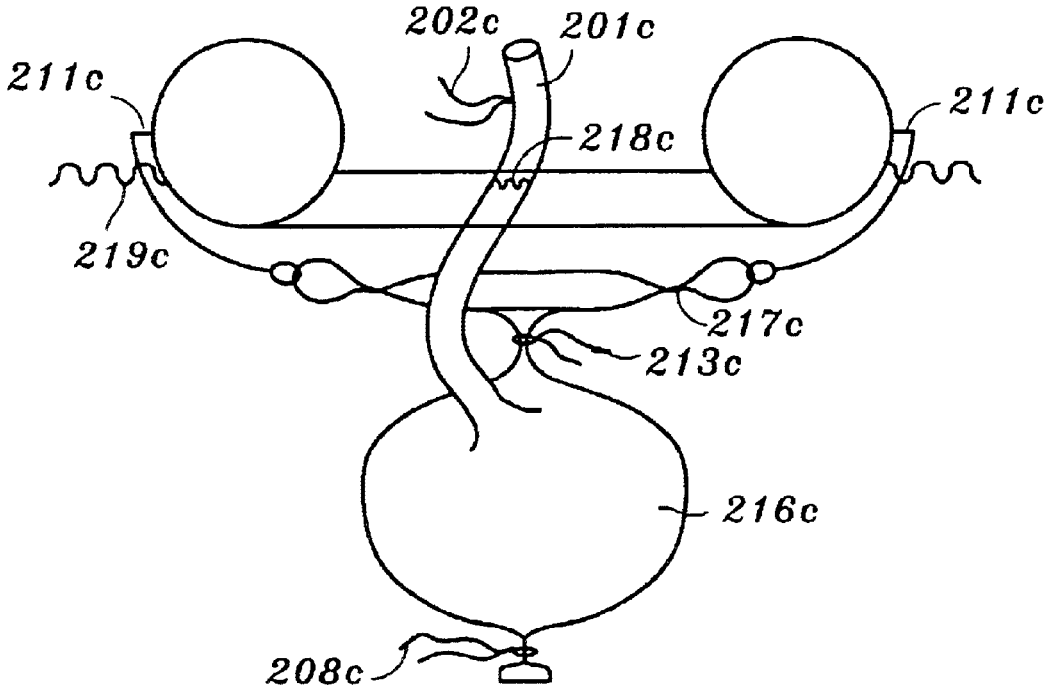
FIG. 59 is a lateral view illustrating use of windsock inflation means as a sea ballast for the life raft connected by windsock wrist lanyards.

Once the victim survives the initial shock of entry they must focus on rapidly removing themselves from the water to avoid hypothermia. As seen in FIG. 58, a windsock 200*c* gathers the wind, with sufficient wind velocity such that it will blow through the flapper valve 203*c*. If the wind is not strong enough to open the flapper valve 203*c* then the windsock is used to scoop up the air and the opening is closed by one hand while the other hand slides down the windsock transferring the air through a one way valve 203*c* into the raft. As the pressure mounts in the first chamber a medium pressure valve 209*c* opens into the adjacent raft tube in the bulkhead allowing air to fill both portions of the raft's perimeter tube. A wrist lanyard 214*c* helps the user keep hold of the raft in heavy winds. A body lanyard 212*c* attached at a reinforced seam grommet 211*c* provides a backup means for securing the raft to the victim in case the raft is kiting.

Once the raft is inflated, the attached locking nut 207*c* is loosen, freeing the reinforced windsock gasket seal 206*c* and thus the windsock is now removed. Now the attached locking caps means 204*c* can cover the opening against passive air loss or water entry. At this point the windsock can be used as a sea ballast container means 216*c*, where the attachment lanyards 217*c* are used to connect the sea ballast container to the raft at the reinforced perimeter. The sea ballast fill tube 201*c* allows the sea ballast container to be completely filled from inside the raft and the sealed with closure means 202*c*.

Figure 60:
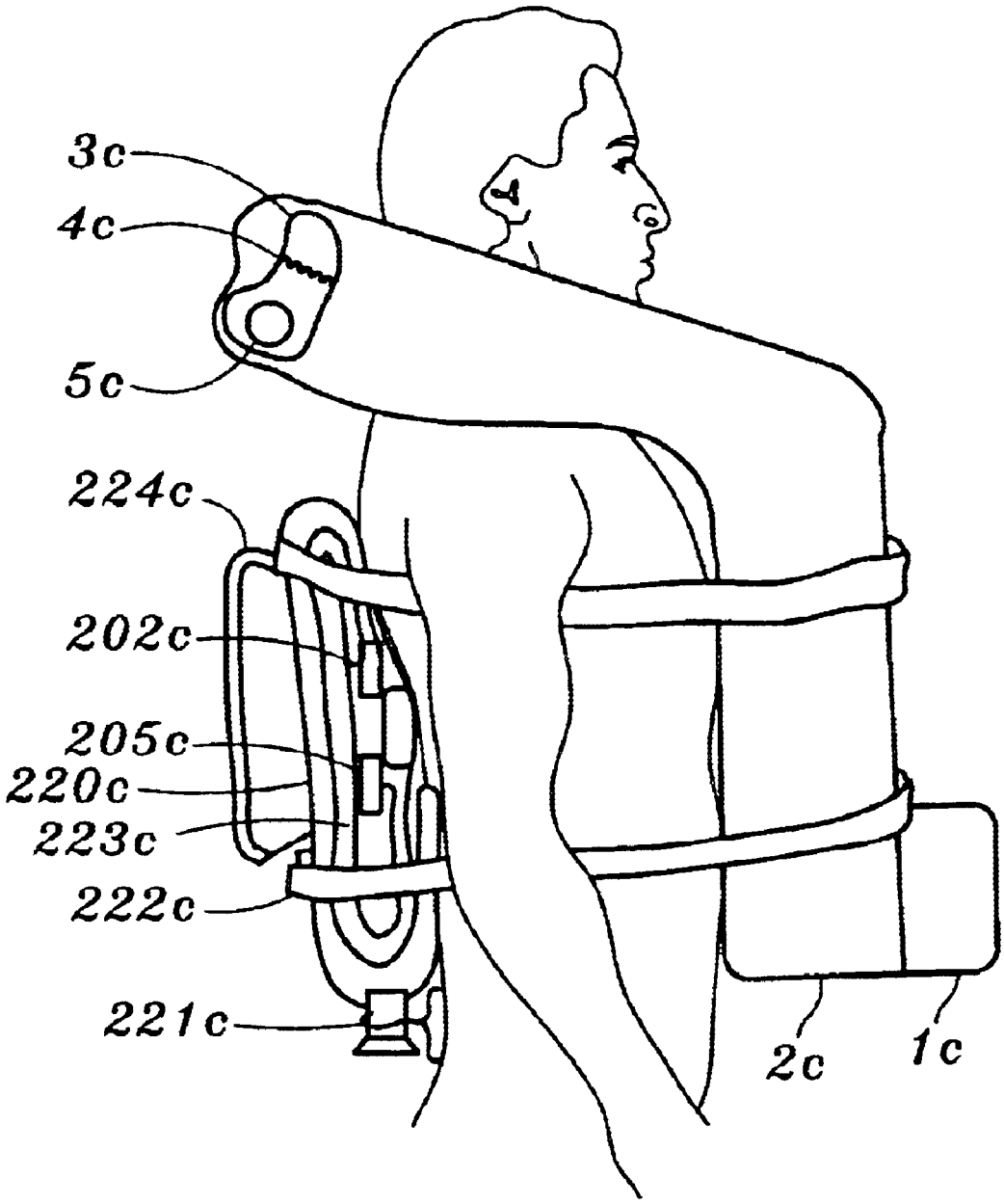
FIG. 60 is a lateral view illustrating the windsock means functioning as storage valise built into the cummerbund of the life jacket. Shoulder straps attached to valise allow independent usage of life raft.

In FIG. 60 the windsock acts a valise 220*c* for the raft 223*c* allowing it to be attached to the PFD serving as a cummerbund 222. Backpack straps 224 allow the valise to be transported separately.

Figure 61:
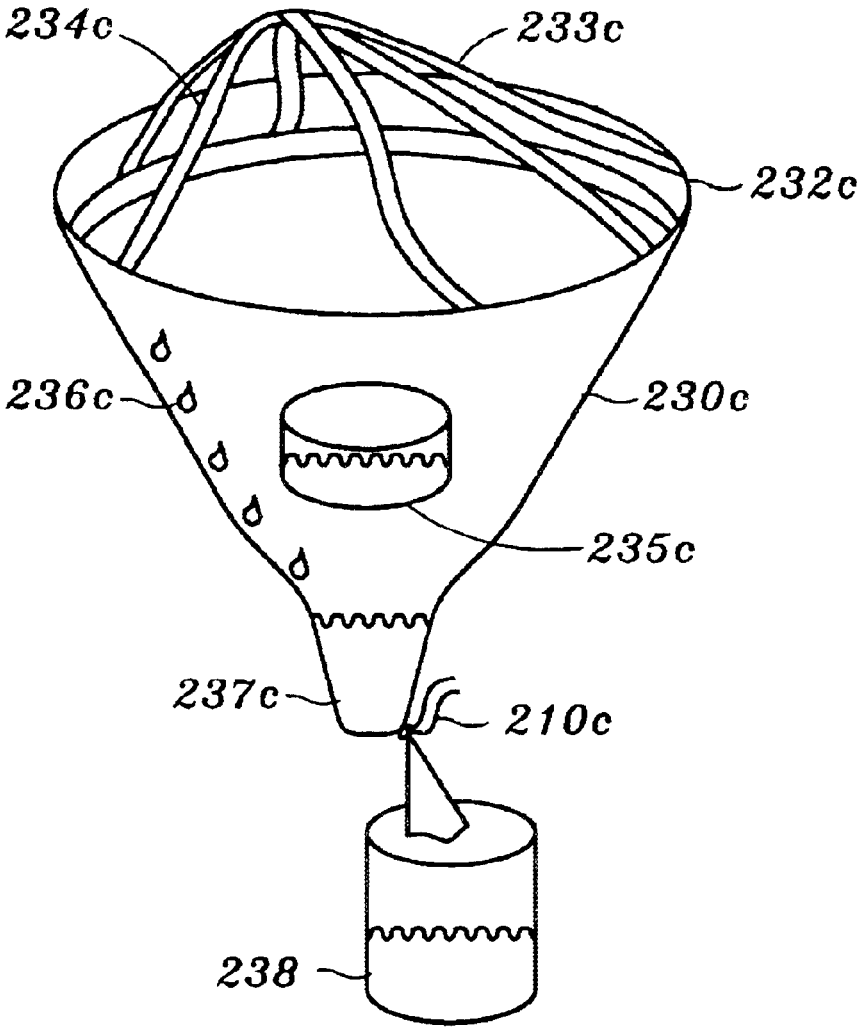
FIG. 61 is a lateral view illustrating use of the windsock as a funnel to collect and contain condensate from solar still.
Figure 62:
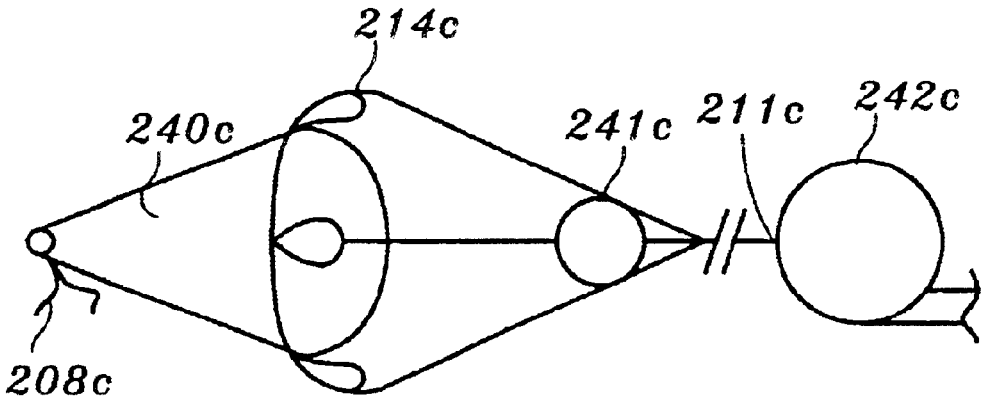
FIG. 62 is a lateral view illustrating the windsock disconnected as an inflation means and reconnected to the raft as a steering sea anchor.

FIG. 61 adapts the windsock 200*c* into a funnel 230*c* to collect and contain rain. The inclusion of a clear plastic cover 233*c* converts the windsock 200*c* into a solar still 231*c*. The clear cover can be sealed by fabric lock 232*c*. The clear cover can be held aloft by rigid supports 234*c*. The sun strikes a source of water 235*c* which is evaporated and then condenses 236*c* on the windsock where it collects within the base of the windsock or ideally in an external container 238*c*. The windsock inflator 200 c can be further adapted for use as a sea anchor windsock 240*c* as seen in FIG. 62. The wrist lanyards 214*c* that encircle the perimeter of the opening windsock opening are now attachment points for lines leading to the sea anchor spreading ring 241*c*. The lines after crossing the sea anchor spreading ring converge into a, single line that runs forward to the rear of the raft 242*c*. The sea anchor scoops up the water and forces it through the windsock vent. This drag determines the rear of the boat and keeps the boat pointed in the same direction in mounting seas.

Figure 63:
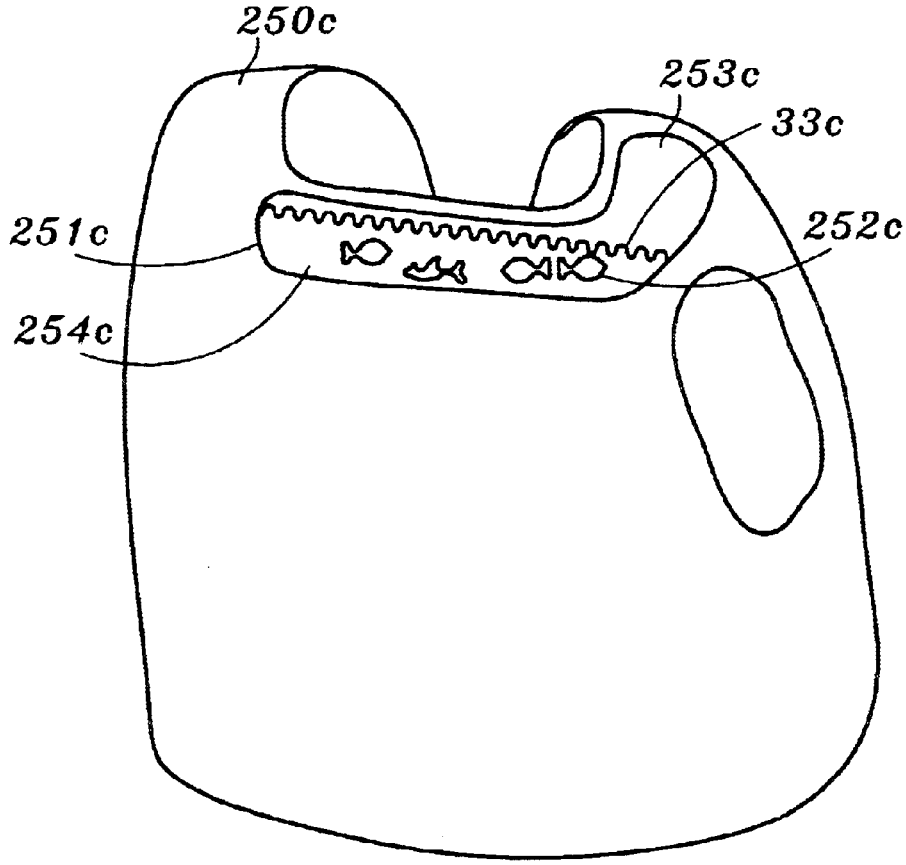
FIG. 63 is a posterior three quarter view of a child's vest style life jacket illustrating the use of a clear mobile fluid ballast container with brightly colored sea creatures in colored fluid.

As seen in FIG. 63, the mobile eccentric fluid ballast that shifts location as the child falls face forward results in the shift of the center of gravity the initiates the escape of the ventral buoyant means. When the mobile eccentric ballast container is clear 251*c* it allows the child to observe the brightly colored water 254*c* slosh back and forth. Mixing oil and water further increases the dramatic effect and the inclusion of two or more colored fluids. Given the very serious problem of willing compliance with wearing jackets the inclusion of brightly colored objects such as sea creatures or favorite cartoon characters may result in the jacket being worn home from the boat and to school as would be a welcome relief to the struggles traditional associated with wearing life jackets, which is currently not required by law in numerous states. A small pond of fish on their shoulder helps to localize the ballast thereby increasing its impact on corrective turning as is needed with vest style designs. The child's vest as well as the adults in addition benefits from the above disclosed PFD embodiments in combination with mobile eccentric fluid ballast in order to achieve reliable airway protection.

It should be recognized that an alternative pneumatic compression lock for inflatable PFDs can also be provided and is within the scope of the invention. Some inflatable PFDs are stowed with an external fabric cover that separates upon detonation of the compressed gas inflation means. If the complementary fabric lock means were distributed on the opposite sides of the external cover, upon inflation as the cover is peeled back they brush against each other along the midline. If the hook and loop connect then as the volume first increase then the pressure builds the right and left halves of the front of the jacket compress the lock securely together. This lock is sufficient to prevent the ballast of the head from driving the neck down between the left and right buoyant means. If the neck does slide down, the victim ends up in a stable face down position if the pneumatic compression lock securely closes the vest then the inflatable PFD effects a strong righting moment because of its predominance of displacement and other than face first entry of an unconscious victim, good control of ballast of the head and neck.

The adjustable collar can be provided with either a certain degree of laxity in the outer fabric cover or a stretchable element interposed along the top and sides of the cover so that as the ventral arms are separated to allow entrance of the head and neck the overlapping layers of the cervical collar to extend temporarily beyond the perimeter. After the neck is in position and the ventral arms returned to their central position, the cervical collar perimeter is restored to its minimal footprint.

Some advantages and features of this alternative pneumatic compression lock include, but are not limited to: (1) fabric lock mounted on external cover while compression is supplied by the inflating inner bladder; and (2) stretchable element built into the fabric cover of the cervical collar to allow transient expansion when the jacket is being donned.

Figure 64:
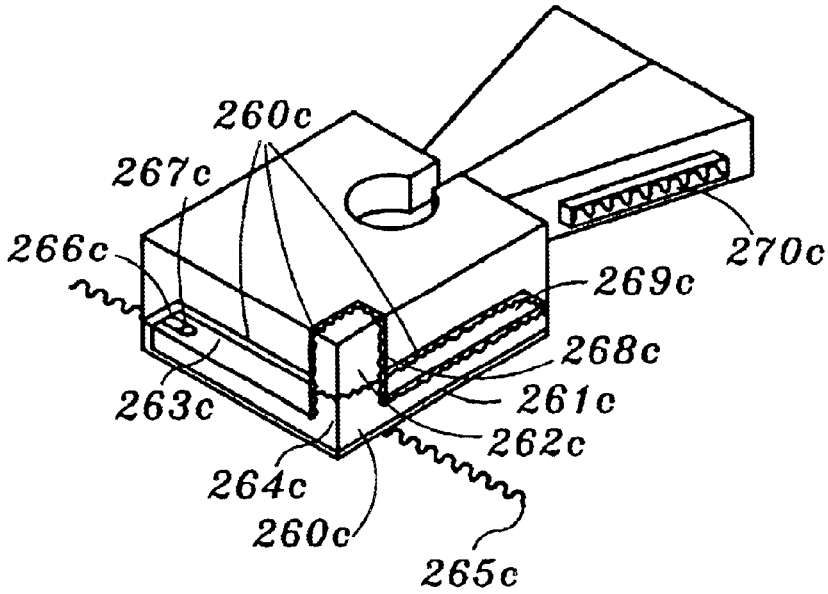
FIG. 64 is a superior lateral three quarter view illustrating the use of the cervical foam means to create a rigid container for an over sized inner bladder holding mobile eccentric liquid ballast along the perimeter.

As seen in FIG. 64, the use of a square container allows the shape of the fluid ballast to minimize the reduction in foam displacement. While the container can be made from rigid plastic ideally the container can be carved right out of the body of the cervical collar 260*c*. The flexible over sized fabric inner layer 261*c* conforms to the shape of the outer container. The use of a shallow container 263*c* along the posterior superior aspect of the collar allows the fluid to layer out below the water surface thereby neutralizing the ballast when floating face up. In this position the contained liquid acts as a sea ballast stabilizing the face up position. The gas in the container rise to the highest point available 262*c*. The lateral anterior extension of the rigid container can be enlarged 268*c* to hold more of the fluid ballast as far outboard complementing ballast shifted into the inferior lateral extension 269*c*. The combined shift from midline to lateral edge strongly initiates the corrective turning action moment. An additional mobile fluid ballast container can be located along the lateral posterior ventral buoyant means 270*c*.

Figure 65:
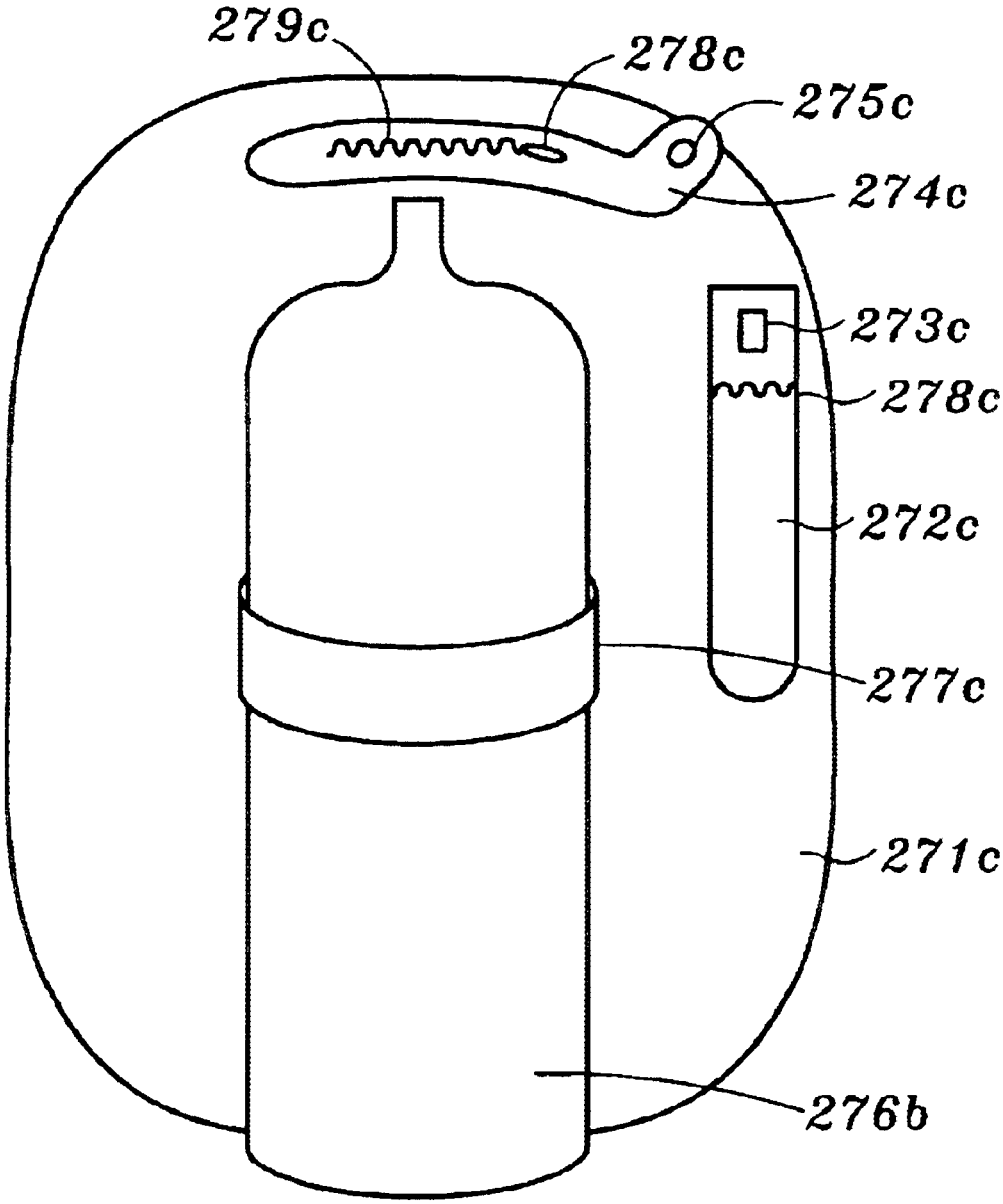
FIG. 65 is a posterior view of the diver's jacket illustrating the superior and lateral placement of mobile fluid ballast for improved corrective turning action.

FIG. 65 is a posterior view of the inflatable dive jacket or buoyancy compensator 271*c* attached to a diver's air cylinder 276*c* by means of a tank band 277*c*. The dive jacket has been constructed to include a posterior 274*c* and 272*c* locations for mounting a fluid ballast container. The lateral filling valve 273*c* and the posterior filling valve 275*c* allow independent function or can be combined into a single mobile eccentric fluid ballast container. The valve allows the ballast to be left at the sea shore after the end of the dive. The level of the fluid 278*c* within the fluid ballast container demonstrates residual air 279*c* above the mobile ballast this creates the space that allows the ballast to shift positions.

Certain advantages and/or features of the embodiment shown in FIGS. 64 and 65 include, but are not limited to: (1) Space defined by foam buoyant means to house mobile fluid ballast container; (2) Space defined by foam buoyant means to shape mobile fluid ballast container; (3) Space defined by foam buoyant means to direct mobile fluid ballast container; (4) Space defined by foam buoyant means to house, shape and direct mobile fluid ballast container; (5) Space defined by inflatable buoyant means to house mobile fluid ballast container; (6) Superior mobile fluid ballast; (7) Lateral fluid ballast; (8) Lateral mobile fluid ballast; (9) Superior and lateral mobile fluid ballast; (10) Sealed container for mobile fluid ballast; (11) Container for mobile fluid ballast with valve to fill before use drain after use; (12) Inflatable PFD modified with means to contain fluid ballast; (13) Inflatable PFD modified with means to contain mobile fluid ballast; and (14) Inflatable PFD modified with means to contain eccentric mobile fluid ballast.

Parts List (FIGS. 39 through 65)

1*c* Anterior Buoyant Element
2*c* Ventral Inferior Buoyant Element
3*c* Posterior Superior Container for Directed Mobile Ballast means
4*c* Mobile Air Fluid Level
5*c* Combined High Density Directed Mobile Ballast and liquid ballast means
6*c* Cap to contain mobile ballast elements
7*c* Buoyant Means 30 degree Head Angle Wedge
8*c* Adjustable circumference buoyant collar layers
9*c* Cervical-Ventral Structurally continuous Foam Means
10*c* Cervical Foam Structural Tie—Hinge Means
11*c* Mandibular Shelf Inferior and Lateral Bracket
12*c* Anterior Cervical Splash Gutter
13*c* Oral-Nasal Splash Diverter
14*c* Stiff Hinge Diverter Arm means
15*c* Reverse Cant Leading Wave Break
16*c* Guide Notch locating Chest Strap Fulcrum
17*c* Chest Strap
18*c* PFD User/victim
19*c* External combined midline fixed ballast and signaling device
20*c* Apical extension of pyramidal anterior buoyant means
21*c* Lateral Extensions of Inferior and Anterior Buoyant Elements
22*c* Adjustable Sized Cervical Collar
23*c* Strap Securing Means for Adjustable Collar
24*c* Quick Release Buckle
25*c* Variable Length Chest Strap
26*c* Abutted Ventral and Cervical Joint in the vertical position
27*c* Oral Nasal splash cover
28*c* Moldable nasal bridge edge
29*c* Complementary attachment means for oral nasal splash cover and collar closure means
30*c* Flexible Liquid Ballast container
31*c* Submerged, potable, dyed, signaling liquid ballast means
32*c* Liquid level
33*c* Water's surface
34*c* Collapsed fabric container creating potential space means for alternate location of liquid ballast
35*c* Liquid ballast flexible container's perimeter attachment means establishing liquid ballast's course posterior midline to lateral
36*c* Combined Vent and locator means for combined ballast and signaling device
37*c* Coated fabric weld line
40*c* Frontal Plane Pivot Point
41*c* Direction of mobile ballast's contribution to frontal plane turning
42*c* Direction of Ventral Buoyant means escape
43*c* Unopposed vector component of inferior lateral and anterior buoyant means
44*c* Vector component acting at apex of inferior lateral and anterior buoyant means
50*c* Welded horizontal baffle Mandibular Shelf
51*c* Flexible integrated fluid ballast means
52*c* Right welded baffle face allowing flush mounting of complementary interlocking closure means
53*c* Excess weldable fabric welded or sewn to secure closure mounting means
54*c* Alternative flexible mounting means for automatic secured neck closure and oral-nasal splash diverter
55*c* Combined battery and fixed midline ballast
56*c* Locator grommet for attaching fixed ballast
57*c* Signaling device
58*c* Compressed air inflation means
59*c* Protruding and overlapping inflatable neck closure means
60*c* Anterior Right overlapping collar layer
61*c* Anterior Left stop for pivoting right collar and source of displacement
62*c* Posterior Right overlapping collar layer
64*c* Frontal plane pivot point
65*c* Anterior Left overlapping adjustable collar layer
66*c* Cam flare allowing selection of neck circumference
67*c* Void between pivoting posterior cervical collar and Stop means to allow for rotation
70*c* Foam displacement offset for mobile ballast to achieve neutrality or positive buoyancy
71*c* Strap means for securing retrofit container mobile eccentric ballast to PFD
72*c* Interlocking securing means for attachment strap
80*c* Rectangular opening along middle position of mobile ballast container

81*c* Perpendicular Rectangular cut at midline
83*c* Flared quadrant forming ballast trap
90*c* Midline fixed ballast means
91*c* Secure attachment means for fixed ballast
92*c* Open mesh vent and attachment means
93*c* Permanent attachment means for mesh
94*c* Secure reversible closure means
100*c* Mobile buoyant means
101*c* Flexible arm hinge means for mobile buoyant member
102*c* Continuation of base layer behind mobile buoyant member
103*c* Opposite lateral fixed or mobile buoyant extension
104*c* Gravity filled anterior-inferior aspect of flexible or rigid ballast container
110*c* Retainer Means for open or closed container means integrated into or added onto PFD collar.
111*c* Rigid Convexity Form
112*c* Flexible Buoyant Means Conformed to Rigid container
113*c* Bilateral Steep vertical wall of midline ballast trap
114*c* Smooth Inferior Sloping wall
115*c* Small fill opening in ballast container
116*c* Semi closed cap and ballast stop
117*c* Sea Water Anchor combined with mobile ballast container means
118*c* Sealable Container integrated into mobile ballast injection molded container for midline fixed combined battery-ballast means
119*c* Fixed midline ballast-battery means
120*c* Trap for solid mobile ballast means
121*c* Left overlapping inflatable midline lock
122*c* Right overlapping inflatable midline lock
123*c* Inflatable oral nasal splash diverters
130*c* Breathable water resistant fabric oral nasal cover means
131*c* Oral nasal flap folded into cervical gutter
132*c* Open mesh vent means
133*c* Vertical Moldable stiffeners means
134*c* Permanent Fastening Means
135*c* Ocular cover means
136*c* Flexible clear view port means
137*c* Cranial edge moldable stiffener means
140*c* Hinge means to ventral buoyant member
141*c* Anterior Inferior Buoyant means active position
142*c* Anterior Inferior Buoyant means stored position
143*c* Anterior Inferior Buoyant member hinge means
144*c* Quick release buckle for chest strap
145*c* One side of fabric lock for anterior inferior buoyant member in storage position
147*c* One side of fabric lock for anterior inferior buoyant member in active position
148*c* Handle of collar closure strap
149*c* One side of fabric lock for collar closure strap
150*c* Structurally continuous base layer
151*c* Lower cervical and ventral buoyant layers
152*c* Posterior cervical layers
153*c* Complementary curve in superior cervical layers allowing for rotation about center of neck opening
154*c* Complementary curve in inferior cervical layers allowing for rotation about center of neck opening
155*c* Void between superior and inferior cervical layers allowing for rotation and for individualized variation of PFD neck diameter
160*c* Flexible oversized inner welded bladder
161*c* External fabric perimeter constraining inner bladder
162*c* Welded closure means of fluid containing inner bladder
163*c* Excess inner bladder material allowing external fabric to bear strain and direct fluid
170*c* Over sized gas containing bladder means
171*c* Size restricting external fabric shell determining final shape and bearing pressure from inner bladder
172*c* Unusual faces and planes unobtainable with planar welded fabric and simple baffles
173*c* Perimeter attachment means
174*c* Single or double walled fluid ballast container means welded to inner bladder or sewn to outer bladder
175*c* Narrow diameter superior container
176*c* Large diameter anterior and inferior extension of bladder means
170*c* Over sized gas containing bladder means
171*c* Size restricting external fabric shell determining final shape and bearing pressure from inner bladder
172*c* Unusual faces and planes unobtainable with planar welded fabric and simple baffles
173*c* Perimeter attachment means
174*c* Single or double walled fluid ballast container means welded to inner bladder or sewn to outer bladder
175*c* Narrow diameter superior container
176*c* Large diameter anterior and inferior extension of bladder means
180*c* Planar platform for solid ballast parallel to water's surface
181*c* Solid ballast means in air filled buoyant enclosed container
182*c* Container for mobile ballast set at angle specific to the angle of the posterior cervical collar off of vertical
183*c* Vertical
184*c* Complementary angle of posterior foam establishing a structural surface parallel to the waters surface for mobile ballast element
190*c* Buoyant arm means
191*c* Inferior chest strap attached at lateral perimeter of mobile buoyant means
192*c* Hard plate cover to foam apex
193*c* Hard plate cover of inferior aspect of ventral foam member
194*c* Fabric hinge attaching mobile to fixed buoyant members
195*c* Fabric cover enclosing buoyant members
196*c* Shortened fixed ventral buoyant means
197*c* Lateral neck opening
198*c* Neck opening closure strap means
199*c* Lock closure means for neck strap
200*c* Wind sock inflator
201*c* Fill Tube for sea ballast means
202*c* Fill Tube Closure means
203*c* Low pressure one way flapper valve means
204*c* Attached locking cap means
205*c* Air seal gasket means
206*c* Reinforced wind sock gasket seal
207*c* Attached locking nut
208*c* Windsock vent closure means for conversion to sea ballast
209*c* Low pressure one way check valve between raft chambers
210*c* Inflatable floor
211*c* Reinforced seam attachment grommet for lanyard
212*c* Quick release body or sea anchor lanyard
213*c* Windsock opening closure means
214*c* Wrist or sea anchor or sea ballast lanyards
215*c* Very Low pressure one way check valve to raft floor
216*c* Sea Ballast windsock container means
217*c* Sea ballast reinforced attachment lanyards
218*c* Sea ballast fluid level
219*c* Sea level

220*c* Life Raft Valise
221*c* Valise securing means
222*c* PFD Life Raft Cummerbund means
223*c* Stowed PFD Life Raft
224*c* Valise Back Pack Straps
230*c* Windsock adapted to function as funnel to capture and or contain solar condensate or clean rain water
231*c* Solar still funnel collecting condensate for solar evaporation
232*c* Fabric lock sealing clear cover to dark funnel
233*c* Clear cover of solar collector
234*c* Rigid supports for clear cover
235*c* Source of liquid for solar collector to generate condensation
236*c* Condensate
237*c* Collected condensate if no container is available
238*c* Condensate collection container
240*c* Sea Anchor windsock
241*c* Sea anchor spreader ring
242*c* Rear portion of Raft
250*c* Child's vest life jacket
251*c* Clear mobile eccentric ballast container
252*c* Brightly colored sea creatures
253*c* Enlarged active container means
254*c* Colored fluid
260*c* Carved foam mobile eccentric fluid ballast container
261*c* Flexible over sized inner sealed liner
262*c* Gas risen to highest point
263*c* Shallow rectangle keeps fluid ballast at or below water surface
264*c* Fluid level within inner liner
265*c* Water's surface
266*c* Fabric extension fill tube
267*c* Welded seal after filling with fluid
268*c* Enlarged lateral component of fluid ballast container
269*c* Inferior lateral extension for eccentric mobile fluid ballast
270*c* Perimeter eccentric fluid ballast along ventral buoyant means
271*c* Inflatable Dive Jacket or buoyancy Compensator
272*c* Lateral Perimeter liquid ballast
273*c* Valve for filling or draining
274*c* Posterior cervical mobile eccentric fluid ballast container
275*c* Posterior cervical mobile eccentric fluid ballast container valve for draining or filling fluid ballast
276*c* Diver's air cylinder
277*c* Dive Jacket tank band
278*c* Fluid gas level in mobile ballast container
279*c* Gas means in mobile eccentric fluid ballast Some of the advantages and/or features of one or more of the embodiments shown in FIGS. 39 through 65, include, but are not limited to, the following: (1) Center of buoyancy shifted inferior and anterior; (2) Pyramidal shaped buoyant means with increased lever arm to axises of rotation; (3) Increased lateral buoyant means; (4) Increased anterior buoyant means; (5) Increased inferior buoyant means; (6) Decreased central medial buoyant means; (7) Flexible arm connecting distant buoyant and ballast means; (8) Marked flexibility in the posterior direction; (9) Flexibility bilaterally restricted by type of foam and width of the connection of the apex to the cervical collar; (10) Anterior flexibility blocked by the abutted walls of the apex and collar bodies; (11) Apical attachment point of inferior buoyant arm and superior ballast arm located adjacent the centroid of buoyancy for the wearer and their life jacket; (12) Foam or inflatable buoyant means; (13) Life jacket turning torque amplified by shifting the PFDs center of buoyancy and center of ballast maximum allowed distance from the axises of rotation by reconfiguring the structure; (14) Continuous base layer integrating effect of displaced inferio-anterio-lateral buoyant means with posterior superior displaced ballast means; (15) Variable diameter neck opening; (16) Two or more overlapping cam shaped collar layers; (17) Superior and or inferior foam surfaces bilaterally notched with three-dimensional mandibular shelf variably positioned to bracket and splint the jaw; (18) Closure means to secure collar entry/exit; (19) Locking closure means; (20) Enhanced bilateral inferior displacement means; (21) Gas and Liquid ballasting means; (22) Flexible container means directing flow of liquid ballast; (23) Broad posterior and superior container means located at or beneath the water's surface to center and neutralize the fluid ballast; (24) Inferior anterior extension of container means liquid filled when upright or face down, gas filled when floating face up on the water Flexible container for liquid ballast sewn along superior and lateral fabric cover; (25) Flexible container for liquid ballast constructed of puncture proof ballistic fabric; (26) Flexible container for liquid ballast with over pressure valve; (27) Flexible weldable expandable fabric to tolerate freezing expansion; (28) Unsupported stretchable weldable fabric container for liquid ballast; (29) Rigid container means of same shape keeping the liquid centered and below the water when face up directing the fluid down and outboard when upright; (30) Liquid and Solid ballasting means; (31) High-density spherical mobile ballast means combined with fluid means; (32) Liquid, solid and gas ballasting means; (33) Combination of gas liquid and solid ballasting means; (34) Center trap in container means to convert the solid mobile ballast into fixed midline position; (35) Open rigid container for solid ballast means restricted for filling or emptying that convert container into a transient combined solid and fluid anchoring and ballasting means; (36) Offsetting buoyant covering of open rigid solid and fluid ballast container; (37) Liquid Sterile for consumption; (38) Liquid combined with potable food coloring to detect loss of ballast; (39) Liquid Search and Rescue Orange dye for signaling aerial rescue efforts from Life Raft; (40) Liquid chemically with lowered freezing point; (41) Potable liquid chemically with lowered freezing point; (42) Dyed, potable liquid with lowered freezing point; (43) Mobile buoyant means; (44) Eccentric mobile buoyant means; (45) Symmetric mobile buoyant means; (46) Laterally mobile buoyant means; (47) Anteriorly buoyant means; (48) Foam or inflatable; (49) Reverse face in the inferior end of the ventral arms redirecting wave away from victim; (50) One of more side to side oral nasal splash diverter; (51) Partially flexible arm connecting splash diverter elevating operational height; (52) Cervical Trough splash receiver; (53) Optional cover flap to cover nose and mouth; (54) Semi-rigid moldable nasal edge adjusted to shape of the bridge of the nose; (55) Securing means for attaching oral nasal cover flap; (56) Oral nasal cover flap water resistant breathable fabric-Gore-Tex™; (57) Oral nasal flap with open mesh off to sides to allow $CO_2$ to escape; (58) Oral nasal flap with stiffeners to support fabric means away from the face; (59) Oral nasal flap of stiff fabric to bridge facial features preventing occlusion; (60) Separate Ocular flap; (61) Ocular flap with moldable stiffener along superior and inferior edges; (62) Ocular flap of clear flexible means; (63) Combined Oral nasal ocular flap; (64) Combined Oral nasal ocular flap with moldable stiffeners along edge; (65) Combined Oral nasal ocular flap with moldable stiffeners along edge and through out the field; (66) Anterior inferior buoyant means attached via hinge means; (67) Dual position inferior anterior buoyant means positioned beneath ventral arm for stowage or for entry into life raft; (68) Active position of inferior anterior buoyant means attached to front face of PFD ventral arms; (69) Side entrance collar with over lapping layers for adjustability; (70) Dual bag PFD with oversized inner airtight chamber contained within sewn fabric cover to allow creation of three-dimensional shapes required to create effective inflatable lock; (71) Fluid ballast container welded to bladder of inflatable PFD; (72) Fluid ballast container of enlarged diameter in forward anterior extension consolidating water ballast in active position; (73) Fluid ballast container of reduced diameter in the posterior superior extension distributing water ballast in resting position; (74) Container for mobile eccentric solid ballast with planar base parallel to water's surface; (75) Container for mobile eccentric solid ballast with non-directing linear leading edge; (76) Inferior plane of mobile ballast container mounted upon cervical foam of angle complementary to the angle of the foam to the water's surface; (77) Inferior chest strap suspending mobile buoyant means; (78) Inferior chest strap suspending mobile buoyant member from perimeter of buoyant member by arms of a length to allow mobility sufficient for escape; (79) Inferior buoyant member with rigid cap of apex riding on rigid base of superior buoyant member; (80) Fabric hinge at apex attaches inferior and superior buoyant members allowing for movement about hinge; (81) Manual Pneumatic compression lock; (82) Automatic pneumatic compression lock; (83) Fabric cover connecting welded seams mounting opposing interlocking means; (84) One or more baffles along cervical end of ventral arms; (85) Flat faced baffles covered in interlocking securing means; (86) Protruding inflatable means overlapping joint between ventral means; (87) Protruding inflatable means covered with pneumatically compressed interlocking means; (88) Superior baffle acting as mandibular shelf and splint; (89) Overlapping superior baffle acting as cover flap and mandibular shelf and splint; (90) Windsock structurally integrated into life raft; (91) Windsock structurally integrated into multiple structurally distinct buoyant chambers of raft; (92) Windsock reversibly attached to raft; (93) Sequential inflation via varied pressure relief fill valves; (94) Fill valves with optional lock caps; (95) Wind sock with attached wrist lanyard; (96) Wind Sock with attached body lanyard; (97) Wind sock with secure closure means to converting it into an Icelandic ballast means; (98) Wind sock with low strength fabric between wind sock and raft air chamber protecting raft from excessive pressure from Icelandic ballast; (99) Wind sock with fill tube to top off Icelandic Ballast while in raft; (100) Wind Sock that can be detached from raft and attached via wrist lanyard to raft body lanyard and thereby act as steering sea anchor; (101) Wind sock that can be turned inside out to protect the raft in storage acting as the raft's valise; (102) Windsock modified with shoulder straps converting it into backpack for independent raft carriage; (103) Wind sock modified with attachment means to convert PFD's chest straps into a cummerbund; (104) Windsock modified with receptacles for paddle handle to use windsock as an air scoop for propelling raft; (105) Windsock modified to become the funnel and to seal clear solar collector for generating drinking water; (106) Windsock seal to collect and store rain water; (107) Clear mobile eccentric fluid ballast container; (108) Colored fluid as mobile ballast; (109) Bright colored objects bobbing in fluid confirming presence of fluid and that it is not frozen and as visual stimulus to small children; (110) Life Raft with integrated windsock inflator; (111) Life Raft with releasable wind sock inflator; (112) Life Raft with low strength tear fabric between wind sock inflator and raft tube; (113) One way valve between wind sock and one or more chambers of raft; (114) Locking caps on inflation valves; (115) One way over pressure valve between windsock and raft chambers; (116) Differential inflation of chambers by varying strength of opening pressures of one way valve; (117) Sea Ballast container made from windsock means; (118) Sea ballast container with fill tube to allow filling while in the raft; (119) Sea ballast lanyard attached around reinforced perimeter of windsock; (120) Windsock with wrist lanyard attached at opening to prevent loss; (121) Wind sock with closure means; (122) Reinforced attachment of lanyard connecting raft to victim; (123) Sea Anchor created out of wind sock after raft is inflated; (124) Sea anchor connected by low strength fabric protecting raft tube from damage; (125) Life raft valise that functions as integrated inflator means; (126) Valise adapted to stow with cummerbund of PFD; (127) Valise with integrated shoulder straps for independent use; (128) Wind sock with dark interior coloration; (129) Windsock adapted to serve as solar still; and (130) Windsock adapted with fabric lock to seal clear cover.

The disclosed vertically eccentric Life Jacket strikes a new balance in the distribution of buoyancy and or ballast about the victim. The prevention of airway submersion is preferred to recovery of the victim after they become face down. Elimination of the danger Zone is the outcome of shifting the buoyant moment down and away and while the ballasted component is shift up and back relative to the PFD user. This separating of the centers of gravity and buoyancy in diametric opposed directions generates the greatest amount of torque per units of displacement and ballast. While buoyancy alone can create marked improvement in several characteristics of the PFD, the combination allows reduction in the amount of foam which helps reduce size easing storage and improving mobility and comfort.

Additionally, in the event of face first entry of an unconscious user, the ballast is very active, concussing the container walls, imparting the kinetic energy to initiate corrective turning action by freeing the opposite inferior anterior buoyant means which is concurrently seeking to escape. The concurrence of two active synergistic moments markedly improves the frequency and rate of escape of the primary driving force to turning, the ventral buoyant means.

The bell bottom shape places the majority of buoyant means below the chest strap. The disclosed inverted design is exactly contrary to common knowledge and practice which advocates that buoyancy must be located high on the chest.

With the predominance ventral displacement means being located low it remains submerged, and therefore active, as compared to designs in which some of the foam is out of the water and their for inactive.

One main advantage of a rigid inverted V is all the force is trying to balance at one point. The entire force is precariously balanced through the triangular apex and is transmitted via a variably flexible member to the cervical component of the Life Jacket. Physically the lateral and anterior extensions at the base shift the buoyant moment in the opposite direction of the mobile ballast element located at the most superior posterior edge of the PFD. The lateral and anterior extension of the bell bottom base, when poised in the vertical Danger Zone, attempt to kick out to either side or to the front.

The base layer of foam runs continuously from the top of the cervical collar through to the base of the bell bottom ventral buoyant means. While alternate layers can bee glued do to the extreme flexure at the apex of the thorax, the entire adjustable cervical collar can be mechanically fastened at the angle of the jaw with something as simple as an upholstery bottom with heavy gauge nylon line or a broad based rivet of plastic or stainless. The top to bottom continuous base layer can be capable of marked flexing to the back, limited flexion side to side, and can be rigid preventing any flexion forward. This range of motion accommodates several divergent uses required of the Life Jacket. For the conscious victim wishing to swim with their head up and back, the base layer flexes completely around the upper torso and down the chest by flaring open. This separates the variably sized buoyancy collar from the lower ventral means allowing the head to flex backward to facilitate swimming or scanning the horizon. A strictly rigid PFD opposes the extension of the neck. In the extreme one PFD unitizes a strut which is mechanically fastened to the back of the PFD that continuously presses against the back of the head. The wearer is unable to straighten their neck yet alone extend the neck into a comfortable swimming or viewing angle.

When the user is upright in the water column the flat face of the lower ventral unit can abut against the lower flat face of the cervical collar so that the force is directed straight up creating the greatest freeboard. If the user has been in the water long enough that their core temperature is dropping they are at risk of losing consciousness. With the angulation introduced into the vertically eccentric Life Jacket the user must immerse their face before they can position the center of gravity above the center of buoyancy. Since it is unlikely that the person will intentionally immerse their face they remain out of balance. That is the center of gravity is to the rear and the center of buoyancy is forward. As the user loses control of their legs, which are critically involved in maintaining their vertical position, the jacket slowly pulls them backwards keeping their airway out of the water the entire time. The mechanical shift of the buoyant means down low will reinforce whatever direction is initiated by the victim. If they lean left, the bell-bottom kicks right. If they lean right, the buoyant means kicks left. In the center the anterior portion working with the rearward ballast simply pulls them back.

While numerous embodiments are obvious a continuous slope out from the front of the jacket while ascetically pleasing is more difficult to sew and stow. If the same amount of buoyancy is consolidated into the anterior inferior buoyant shelf it is simpler to build and a pair of jackets can stack in an overlapping fashion.

The Face First entry for the inherently buoyant, vertically eccentric, horizontally symmetric, Type A PFD consistently provides corrective turning action for several reasons. The adjustable collar with built in mandibular shelf brackets the jaw and holds the head erect. The collar encloses in front of the chin and securing means 23*c* secures the adjustable collar tightly about the neck.

Classically it was believed that the inflatable PFD because of it large size on inflation created huge displacements and therefore would always out perform the lower volume inherently buoyant PFD. The inflatable small size when deflated is a real advantage in assuring that the PFD is worn continuously so that it is on in the event of an emergency. PFDs are now approved that upon immersion activate the inflation device in an automatic fashion. Due to the design restriction of the inflatable PFD the cover is the source of attachment to the body. On detonation the cover is blown open and the PFD deploys around the neck. The pressure generated by inflated chamber is so tight around the neck that without restraint in design it can compress the neck to an alarming degree. The good side is that the collar firmly supports the head preventing it from flopping which is why the inflatable has such a good reputation at turning. However in face first entry from a height as minimal as the edge of a pool the ballast of the head drives the neck as a wedge between the inflatable ventral arms. In this position the PFD floats most if not all testers face down every time. Applying the discoveries disclosed herein the inclusion of a baffle along both sides of the jacket below the neck provides two advantages. It creates a flat surface and by the selection of the size of the baffle can create a bulge that when covered by an interdigitating fabric lock creates a very secure closure.

The Posterior can turn around the apex because of the flexibility in the ventral cervical joint. It is now clear that the use of horizontally eccentric ballast or buoyancy while effective in contrived in line tests can be blocked if the individual falls off to the side. That corrective turning action must be able to occur to the right or left as directed by the vagaries of the victim and attached clothing. Thus the use of any fixed ballast is ideally located along the midline where it assists the completion of active self rescue from the 90 to 180 degree position. If the ballast of an illumination device is placed off to the side it will detract from the rate or possibly prevent corrective turning.

The separation of the centers of gravity and center of buoyancy generates the torque needed to roll the diver into an airway protected position. An overlapping posterior collar allows the adjustment for both entry and sizing. Individual specific sizing is critical because it keeps the individual secured to the jacket. In the event of loss of consciousness a marked flaccidity of the neck combines with wave action to work the victim out of the jacket, particularly a jacket with a fixed opening that must accommodate a wide range of adult neck sizes. 50% of the fatalities of the Sleipner were found hanging beneath the PFD from the straps. The cover fabric of the adjustable posterior collar needs to be either very loose or ideally constructed of a flexible material such as spandex which accommodates the circumferential expansion necessary to first enter the jacket then adjust the size to the individual's neck.

The lateral superior aspect of the PFD collar is further modified to include left and riqht mandibular shelves. A reversible PFD requires mandibular shelves on both sides in order to preserve the reversibility of the jacket, a requirement of SOLAS PFDs. The disclosed mandibular shelf not only places a mandibular splint beneath the chin and jaw, but also places vertical walls along both the left and right sides of the jaw that prevents side to side droop of the head. It is the side to side droop that allows the ballast of the head to shift the center of gravity creating a cant to the face plane or worse creates a side high position allowing the airway to partially drop beneath the water's edge.

Both USCG and international standards require a head angle of 30 degrees with out which approval will not be granted. Thus between the overlapping posterior cervical layers can e inserted foam shims to mechanically adjust the collar to the correct angle. In a single sided PFD the shims can be located beneath the top layer. In a reversible PFD the shims can be placed in the center thereby elevating both sides equally. A sculpted depression in the posterior collar, while it detracts from the both freeboard elevation above the waters surface and head angle, it cradles the head and neck reducing the incidence of the head falling to one side or the other. Once again when the head drop to the side it brings the mouth within dangerous proximity of the water's surface.

Approximately 1" at the rear of the collar creates sufficient bevel to hold the head at the required angle to assist in the shedding of water off the face.

There are two broad categories of why a person would be unconscious in the water. First they enter the water unconscious or they become unconscious once in the water. Trauma is the most likely cause of entering the water unconscious, such as occurs when struck by the sail boats boom. Loss of body heat or hypothermia would be the leading cause of becoming unconscious after the victim has entered the water.

It has been proposed that PFD testing include an assessment of entering the water unconscious. The tester is to sit relaxed at the pool side breathing slowly then the tester is to fall face forward into the water with the arms, legs and neck limp. Such a simulation of unconscious entry is unexpectedly challenging to all existing PFDs whether high volume inflatable or low volume inherently buoyant. The present invention's use of contained mobile eccentric ballast creates repetitive concussive effects, as the ballast slams from side to side, end to end leading to a strong and rapid corrective turning action. Notably, the container is preferably big enough to allow kinetic energy to develop, which is imparted upon impact to the structure of the PFD. The rigid structure transfers this energy expeditiously to the ventral arms, which supply the majority of the power required to actually roll a flaccid person off their face, and onto their back. This test of high displacement inflatables, as well as the low volume inherently buoyant PFDs, is to challenging to pass.

Limiting the size of the mobile eccentric ballast's container is the need to keep the ballast away from the edge where it can impact the face plane by creating a dip to one side. This position lowers the corner of the mouth educing measured freeboard another pass fail criteria for USCG approval.

The individual that becomes unconscious once in the water secondary to hypothermia requires a different action from their PFD. While conscious the victim will be vigilant looking for fellow victims, passing ships, planes and hopefully one going rescue efforts. The best vantage point for observing then signaling help is vertical in the water column. The natural tendency is to balance on the PFD, which is achieved by legs hanging behind the jacket, arms in front, and head held straight up. In this position the center of gravity is directly above the center of buoyancy and the victim is balanced and therefore expending the least amount of energy. Any jacket that allows this positioning of the center of gravity directly above the center of buoyancy has a Danger Zone. That is defined as the vertical position that upon collapse allows the face to fall into the water. From this position 5-second corrective turning is required to prevent drowning, unfortunately a non-existent level of performance.

The present invention jacket through the use of ballast and buoyancy creates and axis through the thorax near where the PFD strap wraps around the chest. Placement of the ballast high for a reversible jacket and high and to the rear for a jacket that has a clearly identified front and optimally positions the ballast do that the conscious victim must place their face underwater in order to move their center of gravity far enough forward so that it can balance upon the center of buoyancy. This is so unlikely that when they are vertical in the water column there is an ever-present effort of the vest to pull them backward. As the victim's core temperature drops and they loose the ability of the legs to adjust their position in space as they become obtunded, the jacket gentle pulls them backward away from the water, preventing submersion of the airway. This obviates the need for the jacket to quickly roll their face out of the water. Even if a jacket could roll an unconscious victim reliably there would be some associated aspiration. Thus, the present invention PFD is the first life jacket that does not have a Danger Zone.

Once the victim is unconscious and positioned on their back by the PFD the airway remains in need of continued protection from aspiration leading to drowning. Wave tank tests disclose that the victim turns into the waves and gradually drifts backwards. As the waves mount they lap at the butt of the PFD. The USCG Reference Vest is a very sleek design that slopes up towards the face. While this places the foam high on the chest it creates a ramp that the waves slide up. Once the water passes the convexity of the USCG reference vest it rolls down a short slope into the nose and mouth. For a given wave height and frequency sensors typically on mannequins detect the beginning of water splashing against the airway.

The present invention discloses two different butt structures depending upon the type of jacket. For the non-reversible vest the but angles from the victim up and away. For the reversible PFD there is a V cut into the butt so that which ever side ends up being the top, one half of the jackets thickness remains angled against the oncoming waves where it serves to rebuff the waves. For the jacket used in the open sea the butt can be widened to increase its height above the water's surface. This bell bottom shape serves two functions. It shifts the buoyant moment down and forward which complements the shift of the center of gravity up and back by positioning the ballast high and if possible to the rear if one exists i.e. in non-reversible jackets. The butt of the ventral arms is ideally covered by a course open weaving that serves two purposes. It breaks up the water and allows rapid drainage by replacing the grommets occasionally found in that position.

The reverse cant at the end of the jacket redirects the wave away from the oral-nasal area. Once wave height and or frequency cause waves to crest over the height of the butt it will roll along the superior face of the PFD towards the oral nasal area. At this juncture the jacket that is short but fat has a purported turning advantage but is more quickly over taken by the waves. That is the present invention jacket keeps a long ventral arm to establish a break water at some distance from the face.

Given the severity of the waves upon the victim bobbing at sea, the ventral arms can be partially cut below the chest strap. This creation of a hinge below the strap does two things. The flexibility about that joint assists the backward rescue of the victim complementing the bell bottom shape and the posterior ballast moment to increase the torque applied to the vertical victim. The torque generated around the axis through the waist is critical in eliminating the danger zone from the design, thereby creating prevention as the primary response by the PFD to hypothermia leading to loss of consciousness.

Eventually, even with a ventral arm the entire length of the torso, mounting seas will eventually crest the butt then roll down the face of the PFD towards the victims nose and mouth. At a distance of a few inches from the victim's mouth one or more ridges along the surface of the PFD redirects the water off to the side away from the oral nasal area. The second ridge catches the first water that rides over the first ridge and redirects that water away. With the present invention, the wave must be big enough to first rise above the but of PFD flexed up about the chest strap, then must be big enough that it doesn't break within the distance from the butt to the face where it would be redirected away. The wave must be big enough to crest all the way over the jacket and directly down onto the face before the victim would suffer from passive intrusion of breaking seas in their airway way.

Applied specifically to Inflatable Type I and SOLAS Type I, a fabric collar carrying the oral-nasal splash guards also serves to hold a fabric lock at the top of the ventral arms beneath the chin. As the bladder is inflated it jams the fabric lock together. The fabric lock is critical to the performance of the inflatable PFD because on unexpected water entry particularly when unconscious, the ballast of the head drives the neck like a wedge between the ventral arms. In this position the inflatable fails to provide airway protection. Uniquely the fabric lock is compatible with the automatic detonator in the sense that if the individual is knocked unconscious before entry after a few seconds the jacket will inflate automatically after exposure to water. The pressure of the inflating chambers first opposes than compresses the lock keeping the head from falling from position.

Figure 66:
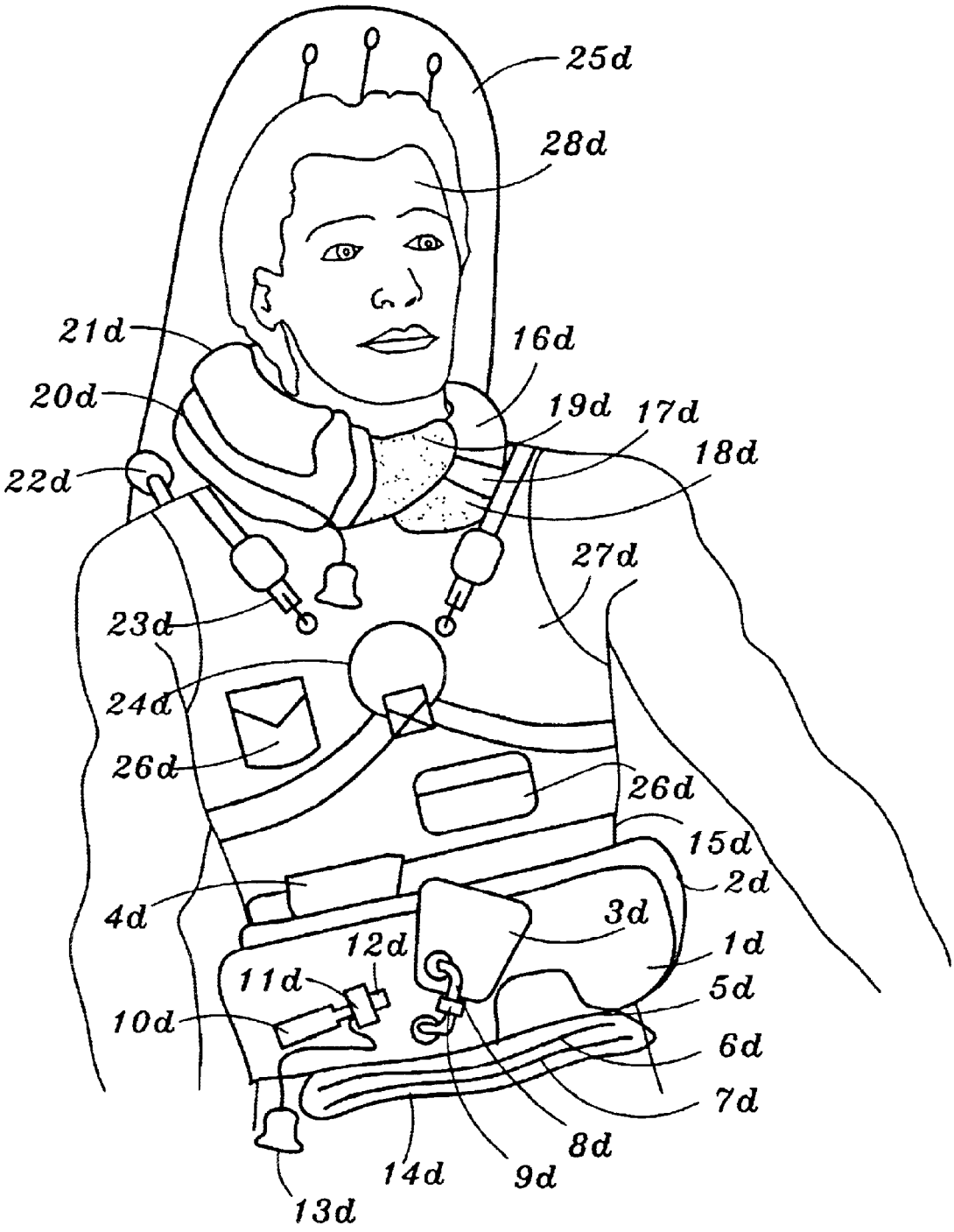
FIG. 66 is a three-quarter frontal view of a multi-chambered life jacket demonstrating dual lift chambers combined with dual mobile eccentric buoyant chambers.

FIGS. 66 through 81 illustrate the garment integrated multi-chambered personal flotation device, life jacket, and/or the like, embodiments of the present invention. The individual in FIG. 66 is wearing body armor as the garment to which the PFD is attached. The forward bladder 1*d* is referred to the inferior bladder due to its position when floating vertical in the water column. As seen in FIG. 66 the superior bladder 2*d* can be detached from the inferior bladder at the top creating a moderate amount of displacement in a relatively low profile for the victim carrying 19 lbs. of tactical plate. The offsetting buoyant displacement requires a mobile eccentric buoyant moment to initiate corrective turning. The use of buoyant chamber is so strong that it can trap the mobile element against the lower torso or legs depending on the resting location of the buoyant chambers against the flaccid victim. Consequently reliable turning requires mobile buoyant elements in both the inferior position 3*d* and superior position 4*d*. The inferior margin of bladder 1*d* can be attached by a reversible means such as zipper 5*d* to 14*d* to the bladder containment cover. For increasing amounts of buoyancy the attached edge of bladder 1*d* can be moved away from bladder 2*d* by affixing the bladder at zipper 6*d* or 7*d* depending on the amount of displacement required by the individual and their attached gear. Mobile buoyant bladder 3*d* can be attached to large volume displacement bladder 1*d* by way of flexible tube 8*d*, which can conduct inflation gas through quick release one way check valve 9*d*. The fixed bladders 1*d* and 2*d* and the mobile bladders 3*d* and 4*d* can be inflated by compressed gas cylinder 10*d* through detonator 11*d* which can be activated by water through optional device 12*d* or manually through pull cord means 13*d*. The inferior cover 14*d* and superior cover 15*d* can contain the stowed abdominal bladders in their deflated state.

The water-activated collar 16*d* can be released from cover 21*d* by automatic detonation in the event of unexpected water entry or manually via ripcord 21*d*. Illumination and signaling device 22*d* can be powered by combined battery ballast means located on the posterior centerline. The quick release means for the inflatable collar can be integrated into the quick release system 23*d* of the two part armored vest garment 27*d*. Heavy duty D-ring harness means 24*d* allows rescue and recovery of the armored water accident victim 28*d*. A water activated detonator can release and inflate a raft 25*d* stowed in the back of the garment. An unpredictable wide variety of armaments can be located about the chest and waist further increasing the need for the disclosed high torque corrective turning created by the unique combination of fixed and mobile buoyant moments.

FIG. 67 is a close up of the side of the abdominal bladder system comprised of superior bladder 31*d* folded tight upon itself by connecting the lateral edge 35*d* to the back wall 14*d*, reducing available volume for inflation/displacement. Inferior bladder 31*d* can also be held in close quarter by attaching lateral edge 36*d* also to the back wall. The excess fabric noted at 33*d* and 34*d* accounts for the relative reduced volume of the mounting configuration depicted (FIG. 67). Oral inflation tube 38*d* can connect oral/overpressure valve 37*d* to bladder 31*d*. Bladders 31*d* can be continuous so that use of pressurized gas or oral inflation fills all chambers assembled. In the low volume configuration (FIG. 67) the inferior chamber 30*d* may not have the length of arm needed to trap mobile buoyant element 3*d* and so sufficient initiation force can be generated by a single mobile element in this configuration. In the reduced volume state (FIG. 67) any excess gas on inflation can be discharged through overpressure valve 37*d*.

Figure 68:
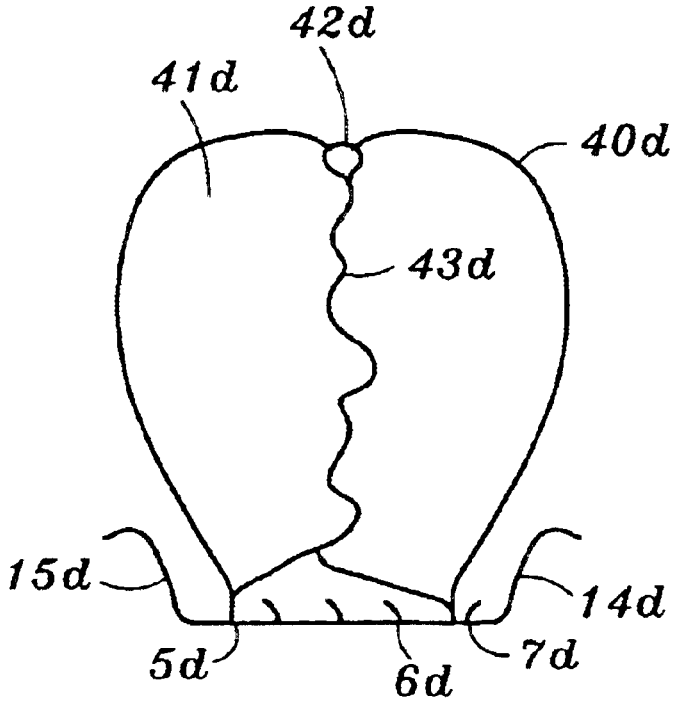
FIG. 68 is a side view of the abdominal chambers showing the inferior and superior bladders attached to the garment and to each other to produce the next lowest volume bladder.

FIG. 68 depicts the outcome of attaching the lateral edges of bladders 40*d* and 41*d* along the midline at 42*d*. This results in a moderate amount of excess fabric 43*d* reflecting the reduced volume achieved by joining the bladders in this fashion.

Figure 69:
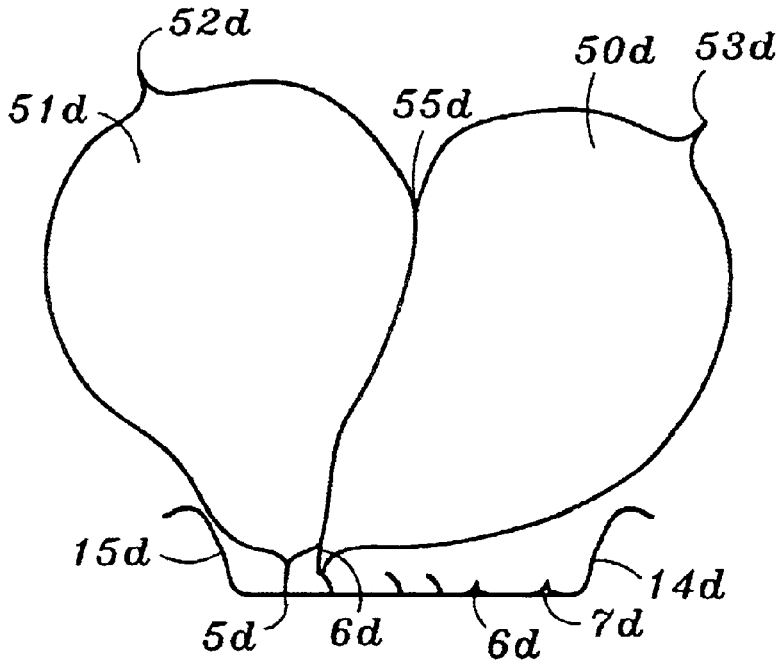
FIG. 69 is a side view of the abdominal chambers showing the inferior and superior bladders attached only at base allowing the bladders to increase their volume to near maximum.

In FIG. 69 the bladders are held to the garment wall at superior bladder junction 5*d* and inferior bladder attachment 54*d*. The lateral edge 2*d* of superior bladder 51*d* and the lateral edge 53*d* of inferior bladder 50*d* can flare apart allowing increased filling/displacement. The minimal reduction in full deployment can be achieved by closely attached medial edges at 5*d* and 54*d* as reflected in minimal compression along the midline 55*d*.

Figure 70:
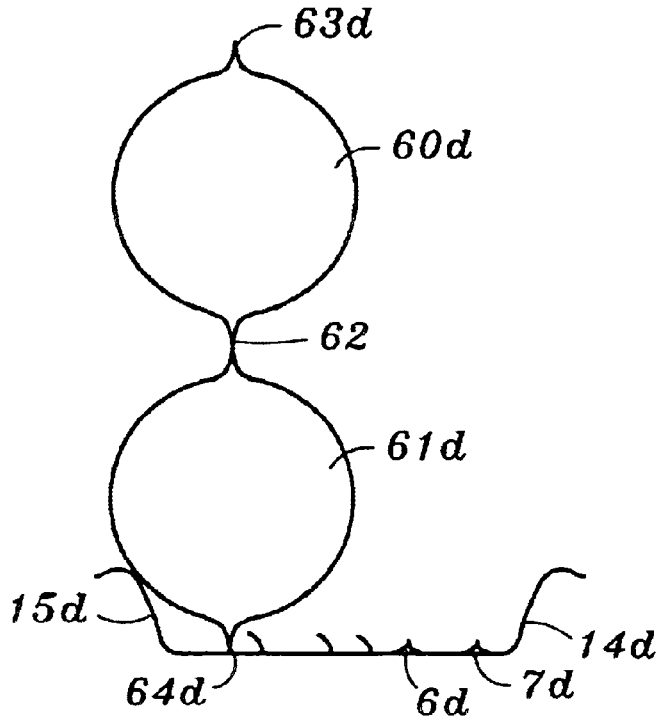
FIG. 70 is a side view of the abdominal chambers showing the inferior and superior bladders attached together with only the superior bladder attached to the garment, allowing complete inflation therefore maximum displacement.

FIG. 70 depicts both bladders unconstrained thereby producing the maximum displacement possible for their size. Inferior bladder 60*d* can float above formerly superior bladder 61*d*. The bladders can be joined at the middle 62*d* with the lateral edge 63*d* of the inferior bladder 60*d* free. The superior bladder 61*d* can attach both bladders to the garment wall at 64*d*.

Figure 71:
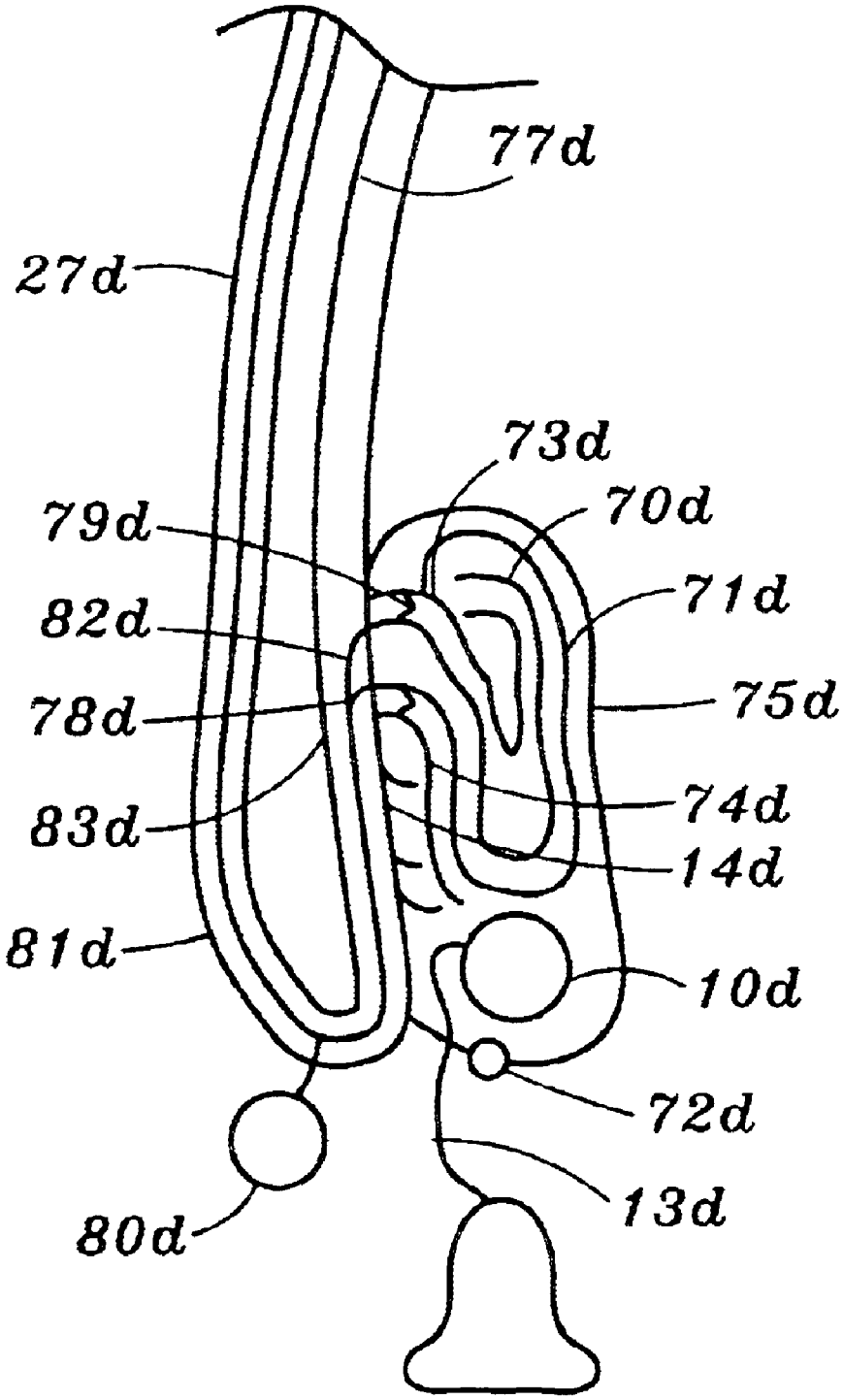
FIG. 71 is a side view of a stowed abdominal bladder demonstrating pneumatic release of the PFD from the stowed state as well as a quick release means for allowing the abdominal bladder upon release to be converted into a free standing Life Jacket. The PFD release mechanism is integrated into the armored vest quick release system.

FIG. 71 shows a quick release variable volume bladder system 75*d* stowed behind the KEVLAR brand fiber ballistics protection 77*d*, which can include a deflated inferior bladder 70*d* and deflated superior bladder 71*d*. The bladder container can be released when pressure is applied by detonation of cylinder 10*d* preferably by pulling lanyard 13*d* which activates the detonator. The expanding bladders can separate closure means 72*d*. Compressed gas can inflate fixed bladders 70*d*, 71*d* and mobile bladders 73*d* and 74*d*. In addition to the KEVLAR brand fiber fabric armor, garment 27*d* can also contain thick rigid armor 76*d* of considerable mass. Inferior quick release loops can hold the bladder to the garment preferably by ripcord 83*d*. The superior quick release means 79*d* can be secured preferably by ripcord 82*d*. When the wearer pulls on loop 80*d*, rip cords 81*d* release the shoulder and sides freeing the front and back panels to fall away. Simultaneously rip cords 82*d* and 83*d* can release the abdominal bladder to become an autonomous PFD.

Figure 72:
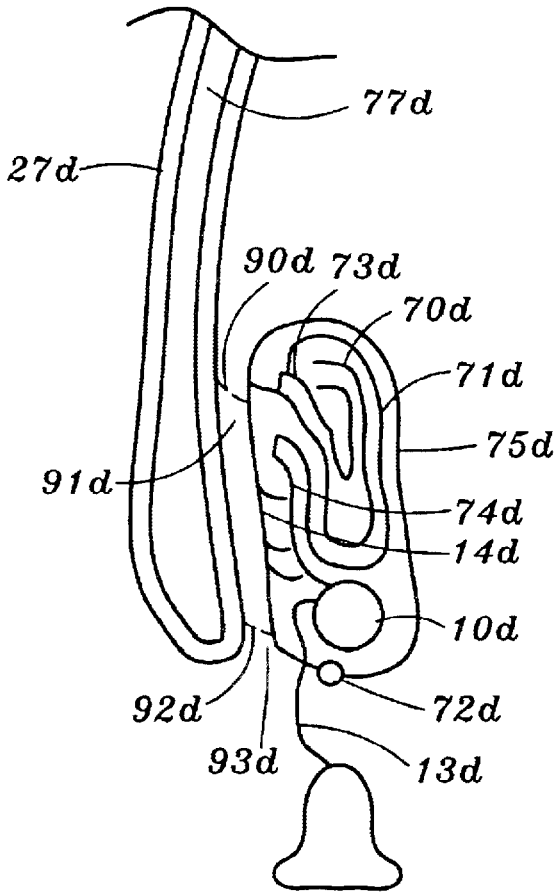
FIG. 72 is a side view of a stowed PFD ready ballistics vest demonstrating a removable abdominal bladder. The vest is constructed with complementary attachment means so that the vest can be upgraded to include the PFD means as an option at a latter date.

FIG. 72 Illustrates a contained variable volume bladder system that can be attached or removed from the garment 27*d* as indicated. In a desert operation a PFD would be needless. The safety of the same vest could be enhanced during a marine operation by the connection of complementary superior attachments means 90*d* and 91*d* and inferior attachments means 92*d* and 93*d* such as a zippers, snaps, hook and loop fasteners(i.e. VELCRO), buttons, and other conventional attachment mechanisms and assemblies.

Figure 73:
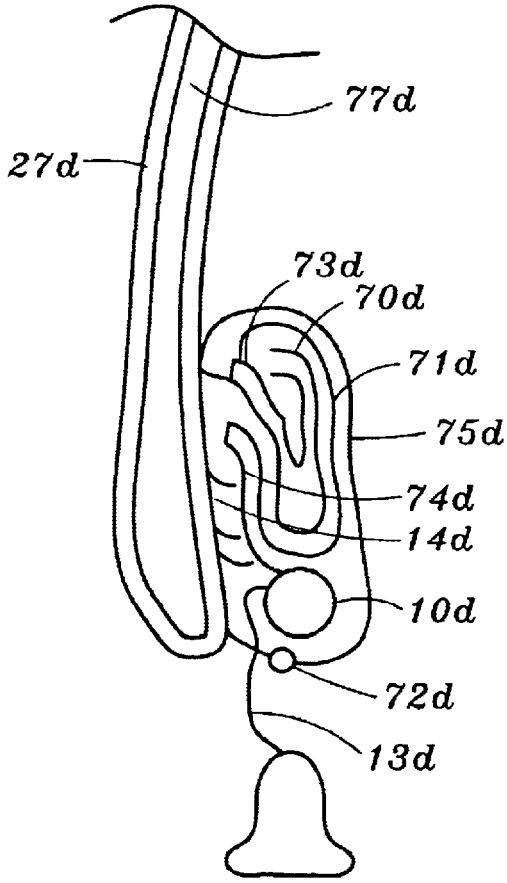
FIG. 73 is a garment with a built in variable volume abdominal bladder.

FIG. 73 demonstrates garment 27*d* with permanently attached variable volume abdominal bladder system 75*d* sewn along the superior edge at 100*d* and along the inferior edge 101*d*. Other attachment mechanisms and assemblies can also be used and are considered within the scope of the invention. Such a vest might be preferred by a maritime organization such as the USCG.

Figure 74:
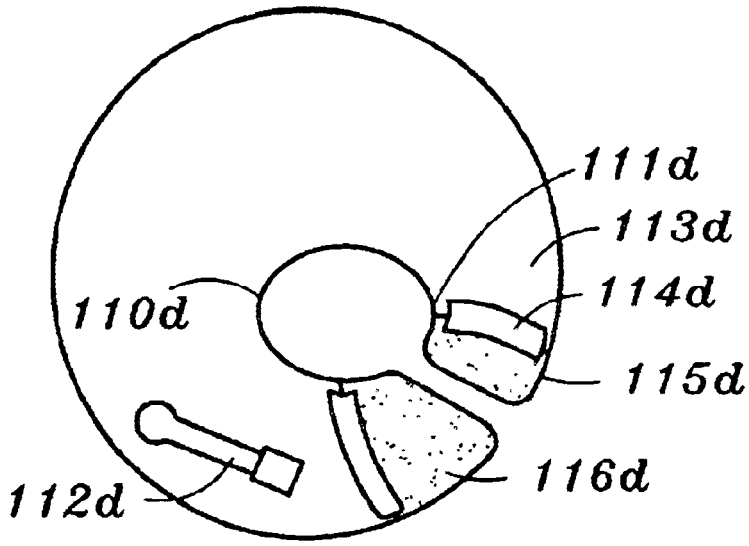
FIG. 74 is a superior view of an inflatable collar demonstrating an interior angle that upon inflation pulls arm across neck opening opposing complementary fabric lock securing the position of wearers neck in the event of loss of consciousness.

FIG. 74 demonstrates a self-closing self-locking inflatable collar. The acute angle at 110*d* can convert the two-dimensional flat fabric into a marked flexure state when inflated into three dimensions. A similar flexure at 111*d* brings the opposite around so that the arms overlap, filling the void under the flaccid victim's chin. This single wall construction can benefit from using fabric coated on both sides preferably by film responsive to welding. The exterior coating allows direct attachment of flap 114*d* to the topside of the collar 113*d* allowing the complementary fabric lock system 115*d* and 116*d* to be secured along the entire perimeter. The efficacy of the cross arm flexure created by angle 110*d* relocates oral inflator and over pressure valve 112*d* towards the victims mouth to allow adjustments in pressure/flexion to further accommodate a wide range of neck diameters.

Figure 75:
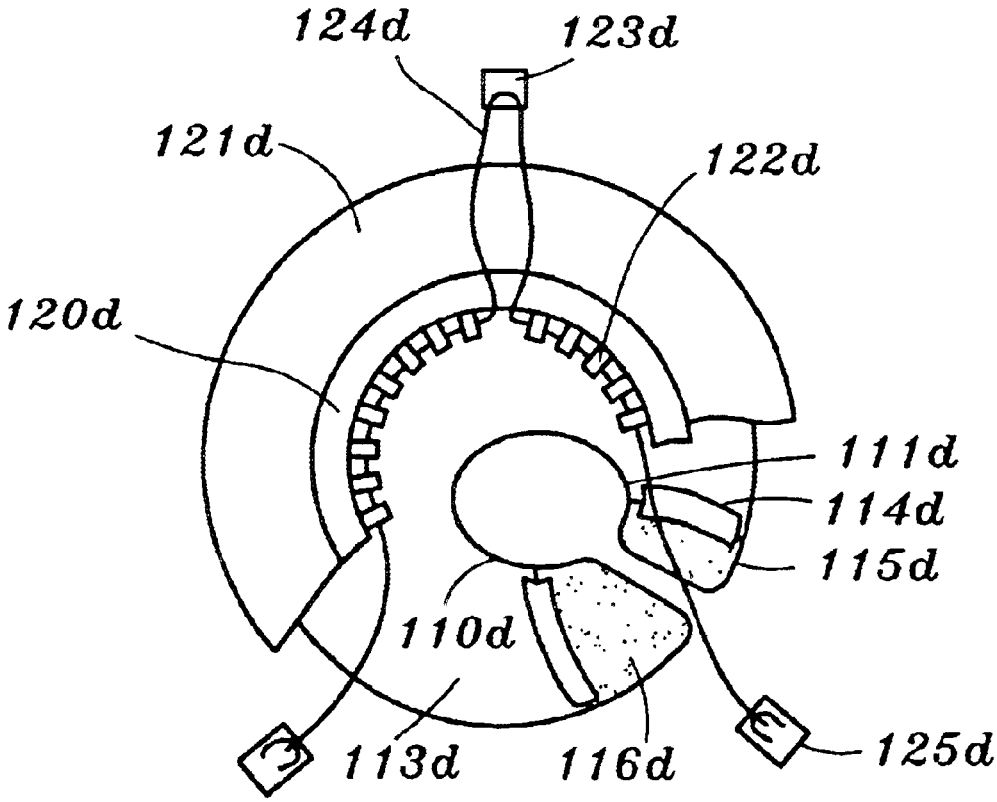
FIG. 75 is an inferior view of an automatic closing and locking inflatable collar showing quick release means.

FIG. 75 illustrates the inferior side of a quick release collar that ties into the quick release system for jettisoning the front and back panels of the armored vest. A flap of fabric 120*d*, preferably weldable, can be attached, such as by welding to collar 113, though such attachment method is not considered limiting. Retaining cover 121*d* can be attached to 120*d*, which is shown in the open position because collar 113*d* is fully inflated. Attachment means 123*d* secures ripcords 124*d* to the back of the vest. The anterior ends are secured at 125*d* on the front of the vest. In the event that the vest is released, the secured state at 125*d* is disconnected. As the rear panel of the vest falls away, the cord 124*d* can be removed from securing means 122*d* freeing the collar to remain around the victim's neck as the panel drops away.

Figure 76:
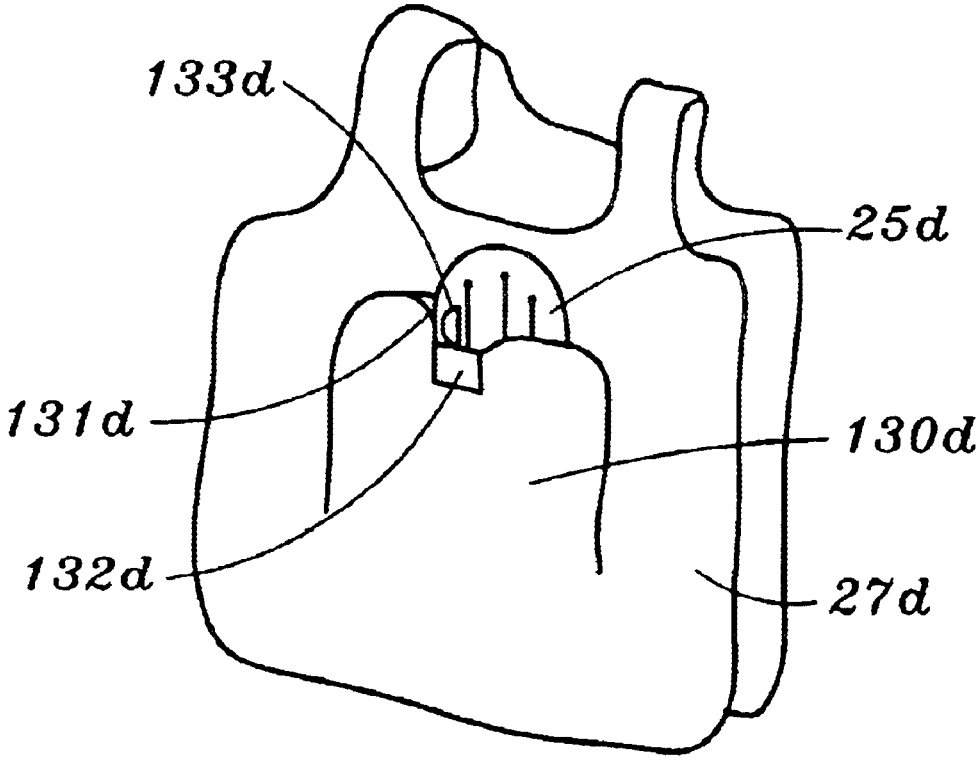
FIG. 76 is a posterior view of ballistics garment with water activated self deploying raft.

FIG. 76 is a posterior lateral view of the garment 27*d* with cover flap 130*d* stowing raft 25*d* that is inflating upon water activated release of gas from cylinder 133*d* peeling apart pressure sensitive securing means 131*d*. The initial detonation can release fabric lock 132*d* on cover flap 130*d* from the back of the garment 27*d* allowing the release of the expanding raft.

Figure 77:
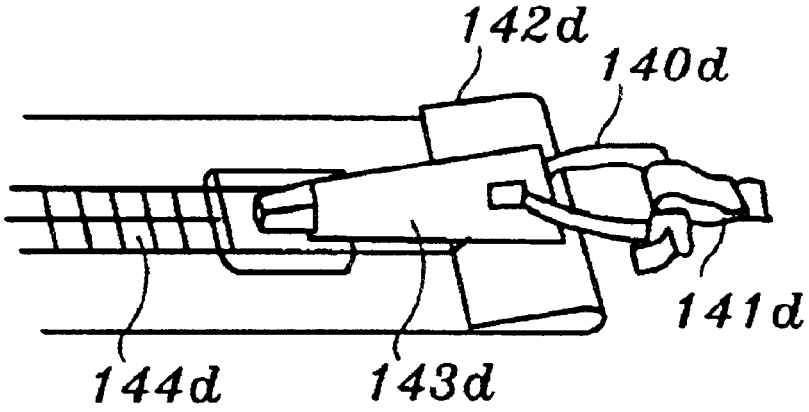
FIG. 77 is a three quarter superior view of secure means for locking zippers in the field. All zippers reversible affixing life saving devices to garment can be quickly secured in particular the zippers used to mount the PFD container to the vest and the buoyant bladders to the container.

In FIG. 77 a high strength nylon locking means 140*d* can secure the zipper pull 143*d* to the garment through loop 141*d*. Alternatively, the pull could be attached to a loop created by excess zipper fabric 142*d*. The mechanism is very secure preventing the separation of zipper 144*d* even when under the types of forces generated by a high lift bladder buffeted in a sea state. The locking means 140*d* is preferably used to mount the bladder to the housing as well as to the garment itself.

Figure 78:
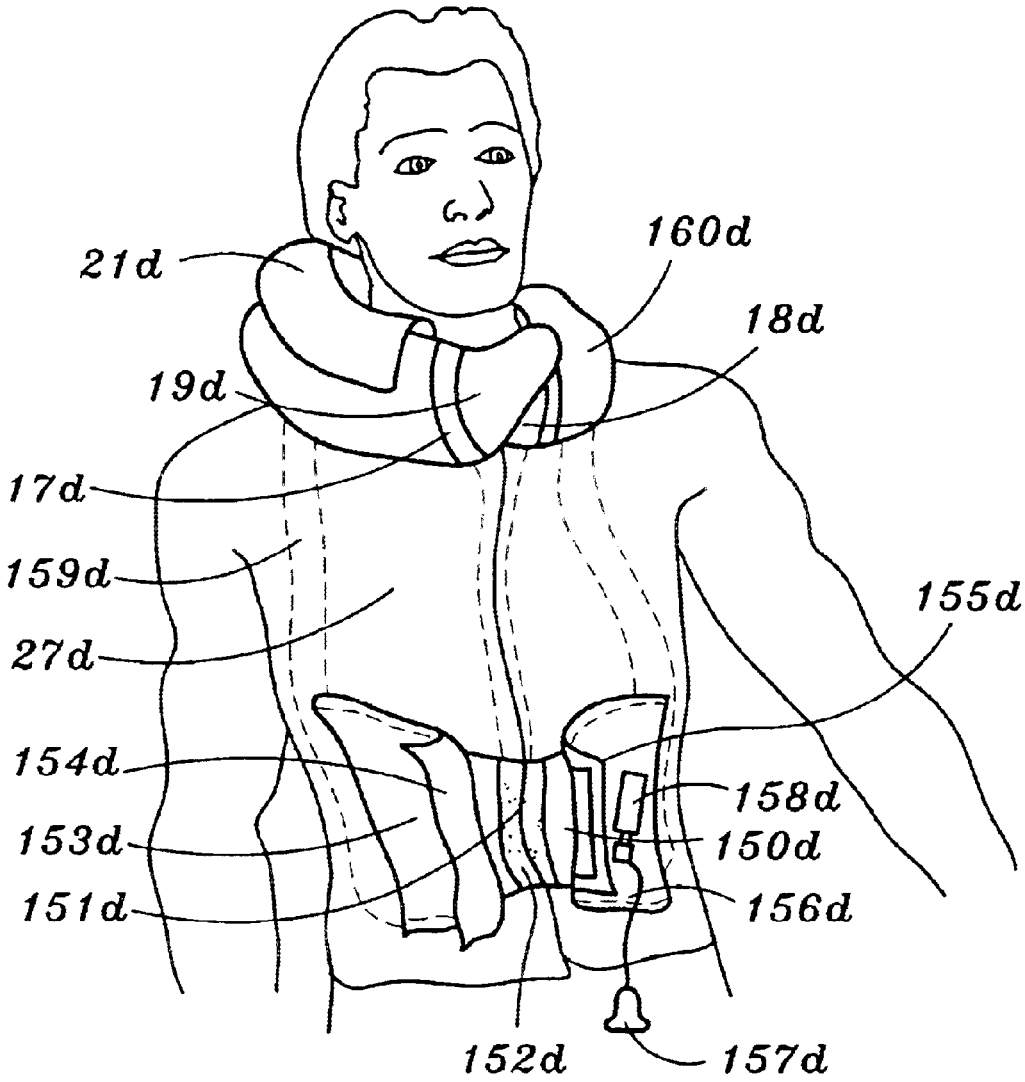
FIG. 78 is an anterior view of wind breaker garment with integrated single chamber low volume life jacket

FIG. 78 adapts the functional advantage of two chambers to a single chamber PFD for a garment that opens along the midine. The midline opening forces the abdominal bladder to be split. The left bladder 150*d* is seen extending from garment. Pocket cover 153*d* is peeled back at 154*d* showing the midline compression 151*d* of the complementary fabric lock 152*d*. The medial position of the cover can be held in place by attachment means 155*d*. The lateral margins of the pocket can be permanently sewn 156*d* to create a funnel device that directs the abdominal chambers out toward their midline union 151*d*. CO2 cylinder 158*d* can be manually activated preferably by pulling ripcord 157*d*. The abdominal 150*d* and cervical 160*d* chambers can be connected by conduit 159*d*.

Figure 79:
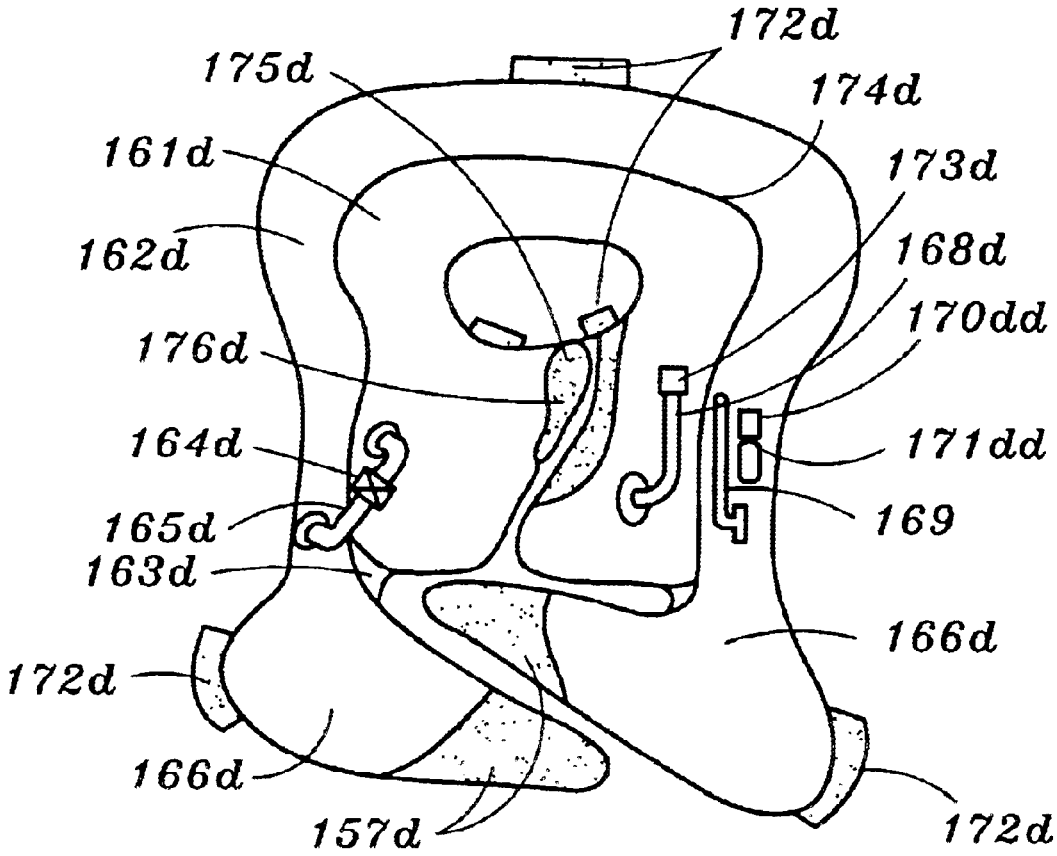
FIG. 79 is an anterior view of double layer bladder comprised of two bladders of different volume different pressure and different inflation means allowing the use of a single low cost CO2 cylinder to provide some initial assistance while user completes oral inflation of the larger chamber. To minimize cost the chamber share a wall in common

FIG. 79 illustrates a triple layered dual chamber bladder that combines a low volume and pressure primarily oral inflated chamber and high-pressure gas inflated chamber. The construction preferably can include a middle layer 162*d* to be coated on both sides while the top layer 161*d* and bottom layer 163*d* can be coated on only the inner facing side. An over pressure relief valve 164*d* can be in line in the connecting conduit 165*d* between the high and low-pressure containers. Bilaterally abdominal bladders 166*d* can be connected by fabric lock 167*d*. While both chambers can be inflated orally, the large bore inflator 168*d* can go to the smaller of the two, while the high-pressure chamber can have a small reserve oral inflator 169*d*. Both chambers can be protected from over inflation by the same over pressure relief valve 173*d*. CO2 cylinder 171*d* and detonator 170*d* can be connected to the larger chamber. The bladder can be held in place in the garment by fabric fasteners 172*d*. A weld line 14*d* can separate the two chambers. The collar can be enhanced by an overlapping mechanical component 176*d* preferably covered by complementary fabric lock 175*d*.

Figure 80:
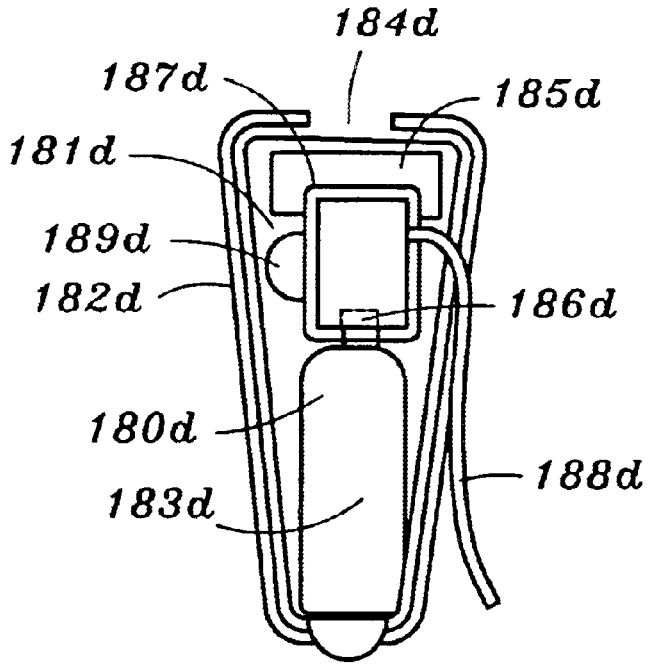
FIG. 80 is a superior view illustrating internally mounted CO2 in a single use bladder that can be replaced within the garment. Protected from water and corrosion chemically and inaccessible so that cylinder will not be accidentally removed and connected with detonator so that it will not loosen prior to use. Actuated by squeezing or striking the detonator through the bladder wall.

The compressed gas cylinder 180*d* seen in FIG. 80 can be located within the bladder. Its detonator can be radio frequency welded 189*d* to the inner bladder. A foam shelf 181*d* can protect the rear bladder wall from the cylinder. This foam can be housed 182*d* and secured to the bladder wall 183*d*. An opening 184*d* can be provided in the housing for inserting the foam. Incorporation of a desiccant reduces corrosion. The CO2 cylinder can be permanently attached at 186*d* to the detonator so that it will not become inoperable due to loosening. The superior bladder wall can also be protected from puncture by covering it with fabric 187*d*. The CO2 detonator can be actuated by squeezing or striking.

In all collar embodiments the bottom surface portion of the second end of the inflatable collar can ride along the top surface portion of the first end of the inflatable collar until the collar is properly positioned for a neck size of a user.

Figure 81:
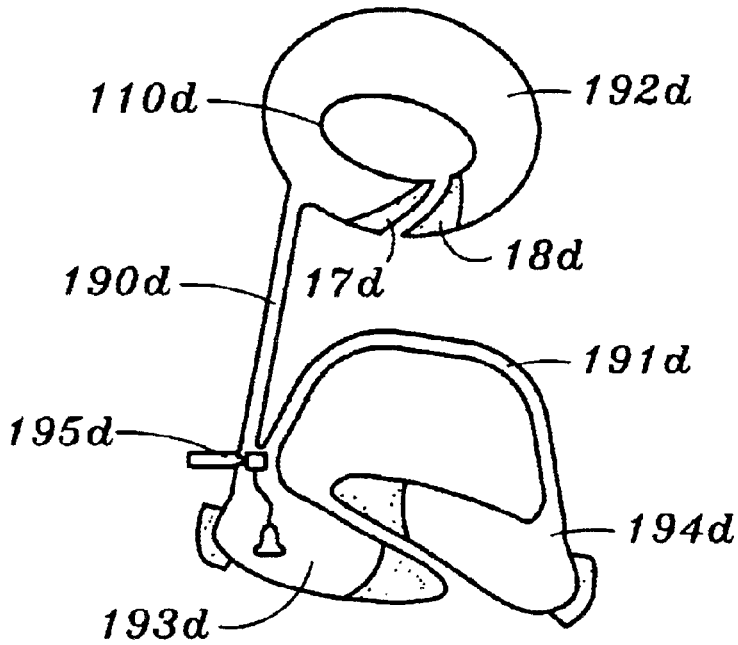
FIG. 81 is an anterior view illustrating an extremely low profile PFD to be stowed in the waistband of shorts or to be cosmetically invisible within boating garment such as a shirt.

In FIG. 81 a very low profile bladder allows use with the waistband of shorts or pants. The bilateral abdominal bladders 193*d* and 194*d* compress and lock in the midline. The attenuated abdominal bladders communicate through conduit 190*d* to the attenuated cervical collar 192*d*.

Certain advantages and/or features of the garment integrated multi-chambered embodiments shown in FIGS. 66 through 81 include, but are not limited to:

(1) A bladder whose volume can be varied as needed to supply a range of displacements; (2) A variable volume bladder which can be permanently attached; (3) A variable volume bladder whose attachment can be varied prior to use; (4) A variable volume bladder whose attachment can be varied while in use; (5) A variable volume bladder whose attachment can be quickly released while in use; (6) A bladder whose volume can be varied as needed to supply a range of displacements; (7) A variable volume bladder which can be permanently attached to the underlying garment; (8) A variable volume bladder whose attachment to the underlying garment can be varied prior to use; (9) A variable volume bladder whose attachment to the underlying garment can be varied while in use; (10) A variable volume bladder whose attachment to the underlying garment can be quickly released while in use; (11) Variable volume abdominal bladder, which is configured to provide airway protection independently once, separated; (12) A variable volume bladder contained within a pneumatically released stowage container capable of being reversibly affixed to the garment; (13) One or more buoyant bladders that have attachment means on both sides of bladder; (14) Bladder containment means having two or more complementary attachment means for securing said bladder in more than one position; (15) Multiple attachment points allowing the displacement volume of the bladder(s) to be decreased or increased according to need; (16) Distinct mobile eccentric buoyant bladder means; (17) Distinct mobile eccentric buoyant bladder attached to the inferior aspect of the primary displacement means; (18) Distinct mobile eccentric buoyant bladder attached to the superior aspect of the primary displacement means; (19) Distinct mobile eccentric buoyant bladders attached to the inferior and superior aspects of the primary displacement means; (20) Mobile eccentric buoyant bladders connected pneumatically to the main displacement bladder; (21) Mobile eccentric buoyant bladders connected pneumatically with check valve between the main displacement bladder; (22) Mobile eccentric buoyant bladders connected pneumatically with quick release check valve between the main displacement bladder; (23) Mobile eccentric bladder connected to garment; (24) Mobile eccentric bladder connected to bladder; (25) Mobile eccentric bladder connected to strain relief means; (26) High volume bladder connected to garment by functional arm so that it serves as mobile buoyant moment; (27) Self closing pneumatic inflatable collar; (28) Self locking pneumatic inflatable collar; (29) Quick release collar allowing separation from garment; (30) Sewable plastic piping and tightly conforming stiff plastic cord creating shear to prevent quick release means unintentionally activating; (31) Collar constructed from fabric coated on both sides allowing welding flanges to the surface for attaching fabric lock and attaching to container and or garment; (32) CO2 cylinder attached on posterior center as fixed midline ballast; (33) Mounting means for attaching ballast power supply midline; (34) Garment integrated multi-chambered PFD system in which one of the chambers is a raft; (35) Garment integrated multi-chambered PFD system in which one of the chambers is a raft inflated automatically upon sudden water entry; (36) Locking means for securing zipper pull to prevent separation of mounting zipper; (37) Locking means for securing zipper pull to prevent separation of mounting zipper using fabric loop attached to garment; (38) Locking means for securing zipper pull to prevent separation of mounting zipper using fabric loop constructed from excess zipper material; (39) Single chamber functioning as three chambers; (40) Bilateral abdominal chambers directed by fabric funnel to directional inflated towards midline; (41) Bilateral abdominal chambers that compress along the midline converting the two chambers into a functional single chamber; (42) Bilateral abdominal chambers stowed beneath pneumatically released covers; (43) Bilateral abdominal chambers in connection with self closing self locking pneumatic collar; (44) Triple layered chamber constructing two functional chambers allowing for a combination of low pressure and high-pressure chambers to increase net displacement above 16-gram standard cylinders; (45) Two functional chambers that share a wall in common connected by one way check valve; (46) Diagonal front entry allowing mechanical obstruction of neck opening such that downward pressure compresses fabric valve preventing shifts of the heads ballast; (47) High-pressure chamber leading to low pressure chamber where over pressure relief protection of both chambers is accomplished with a single pressure relief valve; (48) Single use PFD chamber in which the detonator and cylinder are permanently attached and sealed within bladder increased chances that all parts will be tight and present upon use; (49) PFD chamber containing desiccant; (50) PFD chamber with internal fabric means protecting both bladder walls; (51) Detonator welded to wall for support and localization; (52) Detonator activated by impact or compression; (53) Extremely low profile PFD bladder for cosmetic inclusion in routine clothing; and (54) Multiple self-closing and self-locking chambers optimize turning and surface position.

Parts List (FIGS. 66 through 81)

Manual override CO2 detonation rip cord of water activated collar inflation system

1*d* Inflated inferior chamber means detached at along upper edge;
2*d* Inflated superior chamber means detached at along upper edge
3*d* Inferior mobile eccentric buoyant means
4*d* Superior mobile eccentric buoyant means
5*d* Complementary bladder container mounted attachment means configuring bladder for smallest volume
6*d* Complementary bladder container mounted attachment for configuring bladder for medium volume
7*d* Complementary bladder container mounted attachment means for configuring bladder for largest volume
8*d* Pliable connection means for inflation serving as flexible arm for mobile eccentric buoyant means
9*d* Check valve combined with quick release disconnect means
10*d* Compressed gas cylinder
11*d* Compressed gas cylinder detonation means
12*d* Optional water activated compressed gas cylinder detonation means
13*d* Ripcord for manual activation of compressed gas detonation means
14*d* Variable bladder mounting means
15*d* Superior pneumatically released bladder cover flap in the open position
16*d* Water activated compressed gas inflated self locking quick release collar
17*d* Welded tab allowing secure lateral attachment of pneumatically located and compressed interlocking fabric means
18*d* Left complementary automatic fabric lock
19*d* Right overlapping inflated arm means supplying cervical positioning means and mechanical lock means covered with complementary automatic fabric lock means
20*d* Ripcord for manual activation override of water activated detonation means for actuating inflation means
21*d* Pneumatically released inflatable collar containing flap in the open position
22*d* Remote illumination or signaling strobe connected to posterior fixed midline ballasting power supply
23*d* Quick release means for collar bladder integrated into quick release means for vest
24*d* Integrated harness and over sized lifting D-ring means for aerial extraction
25*d* Water or manually activated pneumatically released raft means integrated into garment
26*d* Variably sized and eccentrically located ballasting armament pockets
27*d* Garment
28*d* Sudden water entry victim
30*d* Inferior, structurally or functionally distinct or structurally and functionally continuous bladder configured to provide lowest profile lowest, volume lift bladder.
31*d* Superior, structurally or functionally distinct or structurally and functionally continuous bladder configured to provide lowest profile lowest, volume lift bladder.
32*d* Excess bladder inferior and superior fabric equivalent to the amount the inferior and superior bladders are reduced in volume by conjoint compression
33*d* Excess fabric equivalent to the amount the superior bladder is reduced in volume by close attachment of both inner and outer edges of bladder in closest configuration

34*d* Excess fabric equivalent to the amount the inferior bladder is reduced in volume by close attachment of both inner and outer edges of bladder in closest configuration
35*d* Outer edge of the superior bladder attached to bladder mounting means affixed to the garment
36*d* Outer edge of the inferior bladder attached to bladder mounting means admixed to the garment
37*d* Over pressure oral inflator valve
38*d* Oral inflation tube
40*d* Inferior bladder compressed along midline
41*d* Superior bladder compressed along midline
42*d* Outer edges of inferior and superior bladders joined to limit volume of buoyancy system
43*d* Excess fabric from inferior and superior bladder equivalent to the amount the inferior and superior bladders are reduced in volume by constrained conjoint compression
50*d* Inferior bladder partially constrained from maximum displacement by close attachment at base
51*d* Superior bladder partially constrained from maximum displacement by close attachment at base
52*d* Detached inner edge of superior bladder
53*d* Detached inner edge of inferior bladder
54*d* Closely contiguous base attachment of inferior bladder to base of superior bladder limiting inflation/displacement of bladder
55*d* Minimal midline compression of contiguous bladders
60*d* Inferior bladder fully inflated providing maximum displacement
61*d* Superior bladder fully inflated providing maximum displacement
63*d* Attached inner edges of inferior and superior bladders
64*d* Single attachment of superior bladder to mounting container means
70*d* Deflated and stowed inferior bladder
71*d* Deflated and stowed superior bladder
72*d* Pressure actuated bladder container release means
73*d* Deflate inferior mobile eccentric bladders means
74*d* Deflate superior mobile eccentric bladders means
75*d* Bladder stowed in protected position behind ballistics components of garment
76*d* Rigid armor protecting from rifle shot
77*d* KEVLAR brand fiber panel protecting from pistol shot
78*d* Inferior quick release means for mounting stowed variable volume and mobile eccentric buoyant bladders
79*d* Superior bladder quick release means for mounting stowed variable volume and mobile eccentric buoyant bladders to garment
80*d* Quick release pull ring
81*d* Quick release wires to ballistic vest shoulder release means
82*d* Superior wire cable to quick release means for securing buoyant bladder to garment
83*d* Inferior wire cable to quick release means for securing buoyant bladder to garment
90*d* Superior garment attachment means integrated during construction allowing option of abdominal PFD
91*d* Superior PFD attachment means integrated during construction of variable bladder mounting means allowing option of abdominal PFD
92*d* Inferior garment attachment means integrated during construction allowing option of abdominal PFD
93*d* Inferior PFD attachment means integrated during construction of variable bladder mounting means allowing option of abdominal PFD
100*d* Superior permanent attachment means securing variable volume abdominal bladder to garment
101*d* Inferior perimeter of permanent attachment means securing variable volume abdominal bladder to garment
110*d* Acute angle on left side of neck opening sets degree of retraction of collar arm across throat of wearer
111*d* Acute angle on right side of neck opening sets degree of retraction of collar arm across throat of wearer
112*d* Angle of oral inflator such that conversion from 2 dimension into 3 dimension reorients oral inflator towards victim's mouth
113*d* Fabric coated with weldable film on both sides allows attachment of sewing tabs directly to collar
114*d* Sewing tab for lateral edge of fabric lock welded to surface of inflatable collar
115*d* Complementary hook fabric relocated and compressed upon inflation
116*d* Complementary loop fabric relocated and compressed upon inflation
120*d* Flange welded to inflatable PFD collar for securing to garment
121*d* Inflatable collar stowage cover
122*d* Collar's complementary quick release means
123*d* Posterior garment attachment means securing quick release cable to ballasted vest
124*d* Quick release cable
125*d* Anterior garment attachment locking means interfacing with vest quick release system
130*d* Cover flap containing raft
131*d* Pneumatically driven release means
132*d* Locking means reducing accidental deployment
133*d* Compressed gas cylinder water activated
140*d* Field locking means
141*d* Loop sewn to garment
142*d* Loop sewn from extra cloth at end of zipper
143*d* Zipper pull
144*d* Zipper locked in closed position
150*d* Left abdominal bladder
151*d* Midline compression of right and left abdominal bladders
152*d* Complementary pneumatically compressed fabric lock
153*d* Pocket cover flap
154*d* Portion of flap peeled back by expanded abdominal bladder
155*d* Complementary fabric lock formerly sealing pocket flap closed
156*d* Permanent stitching securing back half of pocket creating a funnel directing the expansion of the abdominal bladder toward the midline to compress the fabric lock
157*d* Rip cord
158*d* Compressed gas cylinder
159*d* conduit for transferring gas from cylinder to other chambers in low volume PFD
160*d* Compressed gas inflated self-closing and self-locking inflatable collar
161*d* Top layer coated on inferior or inner facing side
162*d* Middle layer, coated with weldable plastic on both superior and inferior sides
163*d* Bottom Layer coated on superior or inner facing side
164*d* Over pressure relief valve between top bladder and bottom bladder
165*d* Conduit connecting high pressure and low pressure chambers
166*d* Bilateral abdominal bladder means
167*d* Complementary fabric lock elements such as hook and loop
168*d* Large Bore inflation tube with over pressure oral inflation valve
169*d* Small bore emergency back up oral inflator
170*d* External detonator either manual or water activated
171*d* Cylinder selected to either inflate only high pressure chamber or high and low pressure

172*d* Bladder half of fabric lock for accurately securing bladder displacement means from migrating from operational position within garment upon impact
173*d* Combined oral inflation valve and over pressure relief valve for both the high and low pressure chambers
174*d* Weld line separating high and low pressure bladders
175*d* Overlapping Midline Pneumatic Fabric Lock
176*d* Diagonal mechanical jam lock
180*d* CO2 Cylinder Retaining Sleeve
181*d* Compressible foam shelf elevates the cylinder and handle from the posterior bladder wall
182*d* Foam shelf housing
183*d* Foam shelf housing perimeter attachment means
184*d* Opening in foam shelf housing for inserting foam shelf and desiccant means
185*d* Desiccant mean
186*d* CO2 cylinder permanently affixed to detonator means
187*d* Fabric protector enveloping sharp detonator surfaces and edges
188*d* CO2 detonator handle actuated through bladder wall
189*d* RF Welded mount for detonator
190*d* Vertical conduit for expanding gas between abdominal and cervical displacement means
191*d* Circumferential waist conduit for expanding gas connecting bilateral abdominal bladders
192*d* Reduced size cervical collar
193*d* Reduced left abdominal bladder
194*d* Reduced right abdominal bladder
195*d* Water activated and manual activated CO2 detonator and cylinder assembly The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A garment integrated personal flotation device or life jacket, comprising:

a garment member; and a personal flotation device attached to the garment member;

wherein said personal flotation device comprises an inflatable collar associated with the garment member, said collar having a first end and a second end which are positioned in an overlapping relationship with respect to each other when the inflatable collar is in an inflated state.

2. The garment integrated personal flotation device or life jacket of claim 1 further including a cover member for stowing said inflatable collar in a deflated state.

3. The garment integrated personal flotation device or life jacket of claim 1 wherein said inflatable collar comprises:

a collar bladder; and means for inflating the collar bladder.

4. The garment integrated personal flotation device or life jacket of claim 3 wherein said means for inflating comprises:

a compressed gas cylinder; and a detonator in communication with said compressed gas cylinder.

5. The garment integrated personal flotation device or life jacket of claim 4 wherein the compressed gas cylinder is attached at approximately a posterior center position of the inflatable collar to act as a fixed midline ballast.

6. The garment integrated personal flotation device or life jacket of claim 3 wherein said means for inflating comprises an oral inflator attached to said inflatable collar.

7. The garment integrated personal flotation device or life jacket of claim 6 wherein said oral inflator is attached at an desired angle and location of inflatable collar such that in an inflated state the oral inflator is oriented towards a user's mouth.

8. The garment integrated personal flotation device or life jacket of claim 1 further including an inflatable raft disposed in a deflated state between the garment member and a user wearing the garment member.

9. The garment integrated personal flotation device or life jacket of claim 1 wherein an outer surface portion of the first end of the inflatable collar is provided with a hook fabric and an outer surface portion of the second end of the inflatable collar is provided with a loop fabric, wherein in an inflated state a portion of the hook fabric mates with a portion of the loop fabric.

10. The garment integrated personal flotation device or life jacket of claim 1 wherein said inflatable collar is constructed from a single wall fabric which is coated with on both sides with a weldable film.

11. The garment integrated personal flotation device or life jacket of claim 1 wherein said inflatable collar is attached to the garment member by a flange, said flange attached to the inflatable collar and to the garment member.

12. The garment integrated personal flotation device of claim 1 wherein said inflatable collar defining a first acute angle on a left side of the inflatable collar and a second acute angle on a right side of the inflatable collar, wherein said first acute angle and said second acute angle set a degree of retraction of the first end and the second end of the inflatable collar across a user's throat.

13. The garment integrated personal flotation device or life jacket of claim 1 wherein said inflatable collar is self-closing and self-locking upon inflation around a user's neck and throat.

14. The garment integrated personal flotation device or life jacket of claim 1 wherein said garment member is body armor.

15. The garment integrated personal flotation device or life jacket of claim 1 wherein said garment member is routine wearing apparel.

16. The garment integrated personal flotation device or life jacket of claim 1 wherein said personal flotation device is releasably attached to said garment member.

17. A garment integrated personal flotation device or life jacket, comprising:

a garment member; and a personal flotation device attached to the garment member;

wherein said personal flotation device comprises an inflatable collar associated with the garment member;

wherein said inflatable collar is self-closing and self-locking upon inflation around a user's neck and throat.

18. A garment integrated personal flotation device or life jacket, comprising:

a garment member; and a personal flotation device attached to the garment member;

wherein said personal flotation device comprises an inflatable collar associated with the garment member;

wherein said inflatable collar defining a first acute angle on a left side of the inflatable collar and a second acute angle on a right side of the inflatable collar, wherein said first acute angle and said second acute angle set a degree of retraction of the first end and the second end of the inflatable collar across a user's throat.

19. The garment integrated personal flotation device or life jacket of claim 18 further including means for retaining the position of the second end with respect to the first end.

20. The garment integrated personal flotation device or life jacket of claim 19 wherein said means for retaining is a hook and loop assembly associated with the first end and the second end.

21. The garment integrated personal flotation device or life jacket of claim 18 wherein said inflatable collar is self-closing and self-locking upon inflation around a user's neck and throat.

* * * * *